US006637865B1

(12) United States Patent
Murakami et al.

(10) Patent No.: US 6,637,865 B1
(45) Date of Patent: Oct. 28, 2003

(54) LIQUID DISCHARGE HEAD, DRIVING METHOD THEREFOR, AND CARTRIDGE, AND IMAGE FORMING APPARATUS

(75) Inventors: Shuichi Murakami, Kawasaki (JP); Toshiaki Hirosawa, Hiratsuka (JP); Takayuki Murata, Kawasaki (JP); Shogo Kawamura, Numazu (JP); Tetsuya Edamura, Tama (JP)

(73) Assignee: Canon Kabushiki Kaisha, Tokyo (JP)

( * ) Notice: Subject to any disclaimer, the term of this patent is extended or adjusted under 35 U.S.C. 154(b) by 175 days.

(21) Appl. No.: 09/624,382

(22) Filed: Jul. 27, 2000

(30) Foreign Application Priority Data

| | | |
|---|---|---|
| Jul. 30, 1999 | (JP) | 11-217101 |
| Aug. 24, 1999 | (JP) | 11-236617 |
| Oct. 6, 1999 | (JP) | 11-286124 |

(51) Int. Cl.[7] ..... B41J 2/05
(52) U.S. Cl. ..... 347/56
(58) Field of Search ..... 347/56, 57, 40–41, 347/43, 69, 68, 70, 94, 22, 10–13, 14–15

(56) References Cited

U.S. PATENT DOCUMENTS

| | | | | |
|---|---|---|---|---|
| 4,536,777 A | | 8/1985 | Matsumoto | 346/140 R |
| 4,730,197 A | * | 3/1988 | Raman et al. | 347/40 |
| 5,311,214 A | | 5/1994 | Hirasawa et al. | 346/1.1 |
| 5,355,158 A | * | 10/1994 | Inada et al. | 347/22 |
| 5,394,181 A | | 2/1995 | Braun | 347/92 |
| 5,512,922 A | * | 4/1996 | Paton | 347/12 |
| 5,689,291 A | * | 11/1997 | Tence et al. | 347/10 |
| 5,774,145 A | | 6/1998 | Morita et al. | 347/43 |

FOREIGN PATENT DOCUMENTS

| | | |
|---|---|---|
| EP | 739736 | 10/1996 |
| EP | 791458 | 8/1997 |
| JP | 59-45161 | 3/1984 |
| JP | 04-52219 | 8/1992 |
| JP | 08-295033 | 11/1996 |
| JP | 11-42782 | 2/1999 |

* cited by examiner

*Primary Examiner*—John S. Hilten
*Assistant Examiner*—K. Feggins
(74) *Attorney, Agent, or Firm*—Fitzpatrick, Cella, Harper & Scinto

(57) ABSTRACT

A liquid discharge head comprises a plurality of main discharge ports arranged at predetermined intervals, at least one sub-discharge port arranged in the arrangement direction of the main discharge ports on both end sides of the arrangement direction of main discharge ports at intervals larger than the intervals of the main discharge port arrangement, a plurality of liquid chambers having these plural discharge ports open thereto, a common liquid chamber having these liquid chambers communicated therewith, and liquid being supplied thereto, and a plurality of discharge energy generating units provided for each of the liquid chambers corresponding to the main discharge ports and the sub-discharge ports to generate discharge energy utilized for discharging liquid from the main discharge ports and the sub-discharge ports. With the liquid discharge head thus arranged, bubbles residing on both end portions of the common liquid chamber are exhausted together with liquid thus exhausted from the sub-discharge ports, hence making it possible to effectively prevent drawback, such as color mixture, that may occur when different kinds of liquid enter the interior of liquid discharge head from the sub-discharge ports at the time of executing recovery process of the liquid discharge head which is performed by the overall suction operation.

31 Claims, 45 Drawing Sheets

| FIG. 8A | FIG. 8B |
|---|---|

| FIG. 9A | FIG. 9B | FIG. 9C |
|---|---|---|

LIQUID DISCHARGE HEAD, DRIVING METHOD THEREFOR, AND CARTRIDGE, AND IMAGE FORMING APPARATUS

BACKGROUND OF THE INVENTION

1. Field of the Invention

The present invention relates to a liquid discharge head for discharging liquid and the driving method therefor, and a cartridge formed integrally with a liquid tank retaining liquid to be supplied to the liquid discharge head. The invention also relates to an image forming apparatus to form images on a printing medium. The invention is not only applicable to the printing apparatuses generally in use, but also, to a copying machine, a facsimile equipment provided with communication systems, and an apparatus having a printing unit, such a word processor, as well. Further, the invention is applicable to an industrial recording system having various processing apparatuses complexly combined therein, and also, to a textile printing apparatus and a processing apparatus such as to perform etching or the like.

Here, the term "printing" or "recording" used for the specification hereof means not only the formation of meaningful information, such as characters, graphics, but also, it is meant to include, in a broad sense, images, designs, patterns, or the like formed on a printing medium, as well as to include processes such as etching, irrespective of being meaningful or meaningless, or being apparent to be visually recognizable by eyesight. Also, the term "printing medium" means not only the paper sheet that is usually used for a printing apparatus in general, but also, it means cloth, plastic film, metallic plate, glass, ceramic, wood, leather, or the like, which is capable of receiving ink. The printing medium may be a sheet, a three-dimensional object, such as a spherical or cylindrical one, among some others. Further, the term "liquid" should also be interpreted in a broad sense as in the definition of the "printing (or recording)" as described above, and it is meant to include the one used for a printing medium to form images, designs, patterns, or the like, or used for etching process of a printing medium or ink processing (such as coagulating or insolubilizing coloring materials in ink to be used for a printing medium).

2. Related Background Art

An ink jet printer is the printing apparatus of the so-called non-impact printing type, which is capable of performing printing at higher speeds on various kinds of printing mediums. Therefore, with its feature that almost no noises are generated when printing, the ink jet printer is widely adopted as an apparatus that operates a printing mechanism for a word processor, a facsimile equipment, or a copying machine.

As the typical ink jet method, there is known the one that uses the electrothermal transducing elements that generate thermal energy as energy for discharging liquid, namely, ink droplets, such as processing liquid (hereinafter, these are collectively called "ink" for convenience sake in the specification hereof) which is used for adjusting the printability of ink with respect to ink itself or a printing medium. The ink jet method makes it possible to discharge small ink droplets from extremely fine discharge ports for printing on paper or some other printing medium.

Generally, the ink jet head uses electrothermal transducing elements comprising a driving system to form ink droplets, and a supply system to supply ink to the driving system. This head has the electrothermal transducing elements in a pressurized chamber. Then, the electric pulses which become printing signals are applied to them so that thermal energy is given to ink, and the abrupt changes occurring in the phases of ink at that time, that is, the bubbling pressures generated by vaporization, are utilized for discharging ink droplets.

Also, for the ink jet head using electrothermal transducing elements, there are known an edge shooter type where ink is discharged from the surface of the base plate in the arrangement direction of the electrothermal transducing elements, and a side shooter type where ink is discharged vertically from the surface of the base plate having the electrothermal transducing elements arranged thereon.

FIG. 48 is a view which shows the external appearance of an ink jet head of side shooter type in accordance with the background art hereof. FIG. 49 is a view which schematically shows the structure thereof. FIG. 50 and FIG. 51 are cross-sectional views which illustrate the structure thereof, taken in line 50—50 and line 51—51 in FIG. 49, respectively. In other words, for each of the heat generating base plates 12 where electrothermal transducing elements 11 are arranged at specific intervals, there are formed a plurality of discharge ports 13 for discharging ink, plural ink chambers 14 having these discharge ports 13 open therefrom, and a long and narrow ink supply port 15 for supplying ink to each of these ink chambers 14. The ink supply port 15 which extends in the arrangement direction of electrothermal transducing elements 11 is generally cut and provided for the heat generating base plate 12 by means of sand blasting, anisotropic etching, or laser processing. Also, the electrothermal transducing elements 11 are connected with a wiring base plate 16 and each heat generating base plate 12 through the TAB (tape automated bonding) method for the application of electric signals for discharging ink. Further, each heat generating base plate 12 is fixed to a supporting member 17, respectively.

In recent years, along with the significant reduction of costs and higher performance of a personal computer, the use of color printers has been promoted more. The printing head of a color printer of the kind should use ink of many colors, and it is arranged in plural numbers. For example, four heads are provided to use four colors, such as yellow, magenta, cyan, and black, and also, in order to make the apparatus smaller, each of the electrothermal transducing elements 11 is arranged on the heat generating base plate 12 at as smaller intervals as possible. For a highly precise printer having an ink jet head capable of performing at 600 dpi or 1,200 dpi, for example, it is required to form each of the discharge ports 13 and ink chambers 14 with an extremely high uniformity. As a result, it is generally practiced that each ink chamber positioned on either edge in the arrangement direction of the discharge ports 13 is regularly made a dummy ink chamber 14*d*, and that each of such dummy chambers is discriminated from the ink chambers 14 which are used for the actual printing operation.

Conventionally, as an ink jet head, there has been known the one which drives the driving elements, such as piezoelectric elements or electrothermal transducing elements, to discharge, liquid by the application of pressure or by means of bubble generation. Since an ink jet head of the kind deals with liquid, the arrangement is made to exhaust the liquid which has become overly viscous outside the head from the interior thereof. For this purpose, a suction recovery mechanism that uses a cap is arranged, and the pre-discharge (that is, idle discharges without any relations to printing signals) is performed to drive the driving elements, or a cleaning mechanism is provided for the ink jet printer to clean the surface of the discharge ports.

For an ink jet printer of the kind, a mode is adopted so that the "suction recovery", "cleaning", or "pre-discharge" is performed as the operational sequence therefor or a mode is adopted so that the "pre-discharge" is performed only after the "cleaning" is executed.

Meanwhile it has been known to make a color printer available by installing a plurality of ink jet heads thereon. However, irrespective of the case where a plurality of color ink jet heads are integrally formed or where these heads are individually arranged, liquids of different colors or different properties may be mixed between a plurality of ink jet heads in some cases.

Various means have been introduced in order to overcome these drawbacks. Particularly, as-among such means, a technique has been disclosed in the specification of Japanese Patent Application Laid-Open No. 08-295033 whereby to provide dummy nozzles each between the adjacent ink jet heads for the prevention of color mixture between them. More specifically, ink is induced to the dummy nozzle from the adjacent ink jet head, and then, ink of mixed colors is discharged from the dummy nozzle to make it possible to remove such ink of mixed colors.

For the ink jet head shown in FIGS. 48 to 51, which is related to the background art, the area of each dummy ink chamber 14*d* requires a certain dimension to provide this area. Here, it is not good enough just to provide a dummy ink chamber 14*d* alone. For the ink jet head shown in FIGS. 48 to 51, which is related to the background art, each of the discharge ports 13, which is arranged corresponding to a dummy ink chamber 14*a* and a dummy ink chamber 14*a*, respectively, is formed in the same shape and dimension at the same arrangement pitches as each of the ink chambers 14 and discharge ports 13 to be used for printing. As a result, for an ink jet head having highly precise pitches at which the discharge ports 13 are arranged, the numbers of dummy ink chambers 14*d* and the discharge ports 13 are inevitably increased. Then, it becomes impossible, in some cases, to remove bubbles completely from the dummy ink chambers 14*d* when ink is sucked altogether from each of the discharge ports 13 of plural ink jet heads using ink of plural colors when the recovery process is executed to keep the ink discharge from each of the discharge ports 13 in good condition for such ink jet heads. This may lead to a condition where ink of different color is induced into each of the dummy ink chambers 14*d* the inner pressure of which has been reduced, with a possibility that ink of plural colors are mixed in the ink jet head. Also, a drawback is encountered that ink is sucked and exhausted from the dummy ink chambers 14*d* when the recovery process is executed, thus inevitably increasing the amount of ink wastefully consumed.

In the meantime, when the surface of the discharge ports is wiped off using the wiper blade, ink which adheres to the wiper blade or to the surface of the discharge port may be pressed into the discharge ports in some cases. Such ink that may be pressed into the discharge port is usually mixed with different colors or in a state of being overly viscous, which necessitates a pre-discharging operation after the wiping operation so as to exhaust such ink outside for the intended execution of a high quality printing.

In this respect, the discharge ports which have been wiped off earlier have a longer period of time during which mixed ink is dispersed in them than the discharge ports which are wiped off later. Therefore, if the pre-discharges are operated in the same order as that of the wiping operation given to the discharge ports, it becomes possible to remove ink of mixed colors with the lesser frequency of pre-discharges.

As described above, one of the objectives to operate the pre-discharges after the execution of suction recovery or wiping is to exhaust outside the ink of mixed colors which is pressed into the ink jet head or to exhaust outside the ink which has become overly viscous. The recovering capability of ink jet head with respect to the pre-discharging operation, that is, the exhausting capability of ink effectuated by such pre-discharges, may differ greatly in some cases at the discharge ports through which the actual printing operation is executed (hereinafter referred to the "main discharge ports") and at the dummy discharge ports (hereinafter referred to as the "sub-discharge ports"). In other words, with the amount of liquid discharged from the sub-discharge ports being greater than that of liquid discharged form the main discharge ports in general, the recovering capability of an ink jet recording head is better at the sub-discharge ports per pre-discharging operation. However, since the sub-discharge ports are arranged closer to the portion where the flow of liquid tends to be stagnant, such as the edge portions or the like of the long and narrow common liquid chamber which extends in the arrangement direction of the main discharge ports, it is usually required to set the amount of liquid, which is discharged from one sub-discharge port, much larger than that to be discharged from one main discharge port. Conventionally, however, the recovering capability of the main discharge port and that of the sub-discharge port are not discriminated distinctly. Then, the amount of liquid, which is needed for executing the pre-discharge of each sub-discharge port for securing the recovering capability of the pre-discharge port, is applied equally to the main discharge port. As a result, a drawback is encountered that the amount of liquid which is pre-discharged from the main discharge port should become more than actually needed.

SUMMARY OF THE INVENTION

It is an object of the present invention to provide a liquid discharge head which does not present any drawbacks, such as mixed colors, with the liquid being pressed partly into the interior thereof when liquid is sucked altogether from the discharge ports for the execution of recovery process to maintain good condition of plural kinds of liquids and the respective discharges thereof from plural kinds of discharge ports.

It is another object of the invention to provide a liquid discharge head capable of suppressing the wasteful consumption of liquid as much as possible when the recovery process is executed, at the same time, being capable of exhausting bubbles existing inclusively therein.

It is still another object of the invention to provide a method for making liquid flowable despite its tendency to be stagnated on the edge portions of the long and narrow common liquid chamber in the longitudinal direction thereof where liquid is supplied, and then, making it possible to exhaust the stagnated liquid outside reliably, and also, to provide a cartridge formed integrally with the aforesaid liquid discharge head, and a liquid tank retaining liquid to be supplied to the liquid discharge head.

It is a further object of the invention to provide an image forming apparatus for forming images on a printing medium by use of the aforesaid liquid discharge head.

It is still a further object of the invention to provide a liquid discharge head which comprises a plurality of main discharge ports arranged at predetermined intervals; at least one sub-discharge port arranged in the arrangement direction of the main discharge ports on both end sides of the arrangement direction of main discharge ports at intervals larger than the intervals of the main discharge port arrangement; a plurality of liquid chambers having these plural discharge ports open thereto; a common liquid chamber having these liquid chambers communicated therewith, and liquid being supplied thereto; and a plurality of discharge energy generating units provided for each of the liquid chambers corresponding to the main discharge ports and the sub-discharge ports to generate discharge energy utilized for discharging liquid from the main discharge ports and the sub-discharge ports. With the liquid discharge head thus arranged, liquid is discharged from the main discharge ports at the time of printing operation, while the discharge energy generating units in the liquid chambers to which the sub-discharge ports are open do not generate discharge energy so as to discharge no liquid from the sub-discharge ports. However, when pre-discharging operation is performed prior to printing operation, sub-discharge ports can discharge liquid, too. Also, with the sub-discharge ports being arranged at intervals larger than the arrangement interval of, the main discharge ports, the resultant numbers of sub-discharge ports become relatively smaller than the conventional arrangement where all the discharge ports are arranged at predetermined intervals when liquid is sucked from the main discharge ports and sub-discharge ports as well, provided that the arrangement length of discharge ports is specific. Therefore, the suction amount of liquid from the sub-discharge ports can be made relatively smaller.

It is still another object of the invention to provide a method for driving a liquid discharge head, which is provided with a plurality of main discharge ports arranged at predetermined intervals, and at least one sub-discharge port arranged in the arrangement direction of the main discharge ports on both end sides of the arrangement direction of main discharge ports at intervals larger than the intervals of the main discharge port arrangement for discharging liquid from the main discharge ports to a printing medium for printing, comprises the step of discharging liquid from the sub-discharge ports simultaneously in order to make the discharge condition of liquid from the main discharge ports excellent when liquid is discharged from the main discharge ports. With the method for driving the liquid discharge head thus arranged, it becomes possible to discharge liquid from the sub-discharge ports when pre-discharging operation is performed prior to printing operation, and liquid in the liquid chambers to which the sub-discharge ports are open is discharged together with bubbles residing in them.

It is still another object of the invention to provide a method for driving a liquid discharge head, which is provided with a long and narrow liquid common chamber having liquid to be supplied thereto; a plurality of main discharge ports arranged on both sides of the common liquid chamber at predetermined intervals, respectively, in the longitudinal direction of the common liquid chamber; a plurality of sub-discharge ports arranged on both sides of the common liquid chamber in the arrangement direction of the main discharge ports at least on one end side of the arrangement direction of main discharge ports at intervals larger than the intervals of the main discharge port arrangement; and a plurality of liquid chambers having these main discharge ports and sub-discharge ports open thereto, at the same time, being communicated with the common liquid chamber for discharging liquid from the main discharge ports to a printing medium for printing, comprises the step of discharging liquid simultaneously from at least two of the main discharge ports adjacent to each other with having one of the sub-discharge ports and the common liquid chamber between them, the step being executed one after another from one end side in the arrangement direction of the main discharge ports. With the method thus arranged, the step, in which liquid is discharged simultaneously from one of the sub-discharge ports and two main discharge ports adjacent to each other having the common liquid chamber between them when pre-discharging operation is executed prior to printing operation, is executed one after another from one end side in the arrangement direction of the main discharge ports, and then, the liquid, which is in a state of stagnation on one end side in the longitudinal direction of the common liquid chamber, is reliably exhausted from sub-discharge ports.

It is still another object of the invention to provide a method for driving a liquid discharge head, which is provided with a long and narrow liquid common chamber having liquid to be supplied thereto; a plurality of main discharge ports arranged on both sides of the common liquid chamber at predetermined intervals, respectively, in the longitudinal direction of the common liquid chamber; a plurality of sub-discharge ports arranged on both sides of the common liquid chamber in the arrangement direction of the main discharge ports on at least one end side of the arrangement direction of main discharge ports at intervals larger than the intervals of the main discharge port arrangement; and a plurality of liquid chambers having these main discharge ports and sub-discharge ports open thereto, at the same time, being communicated with the common liquid chamber for discharging liquid from the main discharge ports to a printing medium for printing, comprises the steps of:

discharging liquid simultaneously from at least two of the main discharge, ports adjacent to each other with having one of the sub-discharge ports and the common liquid chamber between them when liquid is discharged from the main discharge ports in order to make the discharge condition of liquid from the main discharge ports excellent, the step being provided in plural numbers; operating liquid discharge from one of the discharge ports one after another from one end side in the arrangement direction of the main discharge ports; and operating liquid discharges from at least two of the main discharge ports adjacent to each other having the common liquid chamber between them on one end side and the other end side alternately in the arrangement direction of the main discharge ports. With the method thus arranged, when the pre-discharging operation is executed prior to printing operation, the step, in which liquid is discharged from one of the sub-discharge ports and at least two of the main discharge ports adjacent to each other having the common liquid chamber between them simultaneously, is repeated, but whereas the liquid discharge from one of the sub-discharge ports is performed one after another from one end side in the arrangement direction of the main discharge ports, the liquid discharges from at least two of the main discharge ports having the common liquid chamber between them are executed alternately on one end side and the other end side in the arrangement direction of the main discharge ports. As a result, vibration is given to the liquid which is in a state of stagnation on both end sides in the longitudinal direction of the common liquid chamber to promote its flowability, thus exhausting it from the sub-discharge ports reliably.

It is still another object of the invention to provide a method for driving a liquid discharge head, which is provided with a long and narrow liquid common chamber having liquid to be supplied thereto; a plurality of main discharge ports arranged on both sides of the common liquid chamber at predetermined intervals, respectively, in the longitudinal direction of the common liquid chamber; a plurality of sub-discharge ports arranged on both sides of the common liquid chamber in the arrangement direction of the main discharge ports on at least one end side of the arrangement direction of main discharge ports at intervals larger than the intervals of the main discharge port arrangement; and a plurality of liquid chambers having these main discharge ports and sub-discharge ports open thereto, at the same time, being communicated with the common liquid chamber for discharging liquid from the main discharge ports to a printing medium for printing, comprises the steps of discharging liquid simultaneously from at least two of the main discharge ports adjacent to each other with having one of the sub-discharge ports and the common liquid chamber between them when liquid is discharged from the main discharge ports in order to make the discharge condition of liquid from the main discharge ports excellent, the step being provided in plural numbers; dividing the-main discharge ports into a first group and a second group one after another alternately in the arrangement direction thereof from one end side in the arrangement direction thereof; operating liquid discharge from the sub-discharge ports one after another from one end side in the arrangement direction of the main discharge ports; selecting form the first group the first and last sub-discharge ports positioned on one end side in the arrangement direction of the main discharge ports, and at least two of the main discharge ports each discharging liquid simultaneously; and selecting from the second group at least one of the discharge ports other than the first and last sub-discharge ports positioned on one end side in the arrangement direction of the main discharge ports, and at least two of the main discharge ports discharging liquid simultaneously. With the method thus arranged, when the pre-discharging operation is executed prior to printing operation, the step, in which liquid is discharged from one of the sub-discharge ports and at least two of the main discharge ports adjacent to each other having the common liquid chamber between them simultaneously, is repeated, but the liquid discharge from form the sub-discharge port is executed one after another from the one end side in the arrangement direction of the main discharge ports. The main discharge ports are divided into a first group and a second group one after another from one end side in the arrangement direction thereof. The first and last sub-discharge ports positioned on the one end side in the arrangement direction of the main discharge ports, and at least two main discharge ports which discharge liquid simultaneously, respectively, are selected from the first group. However, at least one of sub-discharge ports other than the first and last sub-discharge ports positioned on one end side in the arrangement direction of the main discharge ports, and at least two of the main discharge ports which discharge liquid simultaneously are selected from the second group.

It is still another object to the invention to provide a method for driving a liquid discharge head, which is provided with a long and narrow liquid common chamber having liquid to be supplied thereto; a plurality of main discharge ports arranged on both sides of the common liquid chamber at predetermined intervals, respectively, in the longitudinal direction of the common liquid chamber; a plurality of sub-discharge ports arranged on both sides of the common liquid chamber in the arrangement direction of the main discharge ports on at least one end side of the arrangement direction of main discharge ports at intervals larger than the intervals of the main discharge port arrangement for discharging liquid from the main discharge ports to a printing medium for printing, comprises the steps of discharging liquid from at least all the main discharge ports as a first step when liquid is discharged from the main discharge ports in order to make the discharge condition of liquid from the main discharge ports excellent; and discharging liquid at least all the sub-discharge ports as a second step. With the method thus arranged, when liquid is discharged from the main discharge ports to make the liquid discharge condition from the main discharge ports excellent, the step, in which at least all the sub-discharge ports discharge liquid, is provided besides the step in which at least all the main discharge ports discharge liquid. In this manner, the discharge amount of liquid from the main discharge ports are suppressed.

It is still another object of the invention to provide a cartridge which comprises a liquid discharge head provided with a plurality of main discharge ports arranged at predetermined intervals; at least one of sub-discharge ports on both end sides in the arrangement direction of the main discharge ports at intervals larger than the arrangement intervals of the main discharge ports in the arrangement direction thereof; a plurality of liquid chambers having these liquid chambers open;thereto; a common liquid chamber communicated with each of these liquid chambers, at the same time, liquid being supplied thereto; and a plurality of discharge energy generating units for generating discharge energy utilized for discharging liquid from the main discharge ports and the sub-discharge ports; and a liquid tank retaining liquid to be supplied to the liquid discharge head.

It is still another object of the invention to provide an image forming apparatus which comprises an installation unit for a liquid discharge head provided with a plurality of main discharge ports arranged at predetermined intervals; at least one of sub-discharge ports on both end sides in the arrangement direction of the main discharge ports at intervals larger than the arrangement intervals of the main discharge ports in the arrangement direction thereof; a plurality of liquid chambers having these liquid chambers open thereto; a common liquid chamber communicated with each of these liquid chambers, at the same time, liquid being supplied thereto; and a plurality of discharge energy generating units for generating discharge energy utilized for discharging liquid from the main discharge ports and the sub-discharge ports. With the apparatus thus arranged, liquid is discharged from the main discharge ports at the time of printing operation, but the discharge energy generating unit in the liquid chambers to which the sub-discharge ports are open do not generate discharge energy. Nevertheless, when the pre-discharging operation is executed prior to printing operation, liquid can be discharged from the sub-discharge ports, too. Also, since the sub-discharge ports are arranged at intervals larger than the arrangement interval of the main discharge ports, the resultant numbers of sub-discharge ports become relatively smaller than the conventional ones where all the discharge ports are arranged at specific intervals when liquid is sucked from the main discharge ports and sub-discharge ports, provided that the arrangement length of discharge ports is specific.

In accordance with the present invention described above, a plurality of main discharge ports are arranged at predetermined intervals in the arrangement direction thereof, and then, at least one of sub-discharge ports is arranged at intervals larger than the arrangement interval of the main discharge ports on both sides in the arrangement direction of the main discharge ports. Therefore, it becomes possible to perform pre-discharges by discharging liquid also from the sub-discharge ports when the recovery process is executed for a liquid discharge head. As a result, bubbles residing on both end portions of the common liquid chamber are exhausted together with liquid thus exhausted from the sub-discharge ports, hence making it possible to not only prevent drawback, such as color mixture, that may occur when different kinds of liquid enter the interior of liquid discharge head from the sub-discharge ports at the time of recovery process of the liquid discharge head performed by the overall suction operation, but also, suppress the amount of liquid to be sucked from the sub-discharge ports. Particularly, it becomes possible to promote the liquid flow between the sub-discharge ports, and the end portions of the long and narrow common liquid chamber to which liquid is supplied, and the overly viscous liquid residing on the end portions of the common liquid chamber in the longitudinal direction, which tend to be stagnated, can be exhausted outside the liquid discharge head from the sub-discharge ports smoothly and reliably.

When at least one dummy liquid chamber having no discharge port but communicated with the common liquid chamber is arranged between the liquid chamber to which the sub-discharge port is open, and the liquid chamber having the main discharge port open thereto, and being adjacent to this sub-discharge port, it becomes possible to function this dummy liquid chamber as a buffer.

Also, when the discharge energy generating unit is formed in the dummy liquid chamber, there is only a difference between the liquid chamber having discharge ports and the dummy liquid chamber in the aspect whether or not each of them has liquid discharge ports.

When the dummy liquid chambers and the liquid chambers having sub-discharge ports are arranged alternately, it becomes possible to suppress the amount of liquid to be sucked from the sub-discharge ports at the time of executing the recovery process for the liquid jet head.

When the opening area of the main discharge port is made larger than that of the sub-discharge port, it becomes possible to enhance the buffering function of the liquid chamber to which the sub-discharge port is open at the time of printing operation.

When the opening shape of the sub-discharge port is made different from that of the main discharge port, the buffer function is optimized of the liquid chamber to which this sub-discharge port is open.

When at least two lines of discharge ports are formed in parallel to each other at intervals of 600 dpi, respectively, with the displacement of half pitch from each other for the arrangement interval per line, it becomes possible to obtain a liquid discharge head capable of executing as high performance as 1,200 dpi. When the amount of liquid discharged from the main discharge port is set at 5 picoliters or less, it becomes possible to enhance the image resolution and improve the obtainable image quality significantly.

When the pre-discharging operation is executed prior to printing operation, it becomes possible to exhaust from the sub-discharge ports the liquid residing on the one end side in the longitudinal direction of the common liquid chamber, which is in the state of stagnation, by repeating the step where liquid is discharged simultaneously from one of sub-discharge ports and at least two of the main discharge ports adjacent to each other having the common liquid chamber between them.

When the step in which liquid is discharged simultaneously from one of sub-discharge ports and at least two of the main discharge ports adjacent to each other having the common liquid chamber between them, is repeated at the time of executing the pre-discharging operation is executed prior to the printing operation, the discharge operation from one of the sub-discharge ports is executed one after another from one end side in the arrangement direction of the main discharge ports, but liquid discharge operations for at least two of the main discharge ports adjacent to each other having the common liquid chamber between them are executed alternately from one end side and the other end side in the arrangement direction of the main discharge ports. In this case, vibrations are given to the liquid which is in the sate of stagnation on both end side of the common liquid chamber in the longitudinal direction. As a result, the flowability of liquid is promoted to make it possible to exhaust it from the sub-discharge ports reliable.

When liquid is discharged from the main discharge ports to make the liquid discharge condition excellent form the main discharge ports, it becomes possible to suppress the liquid which may be unnecessarily discharged from the main discharge ports.

DETAILED DESCRIPTION OF THE PREFERRED EMBODIMENTS

With reference to the accompanying drawings, the detailed description will be made of the embodiments in which the present invention is applied to an ink jet printer. However, it is to be understood that the invention is not necessarily limited to such embodiments. The invention is applicable to the combination of such embodiments, as well as to any other techniques to be included in the conception of the invention referred to in the claims following the description of the specification hereof.

(The Main Body of the Apparatus)

Figure 1:
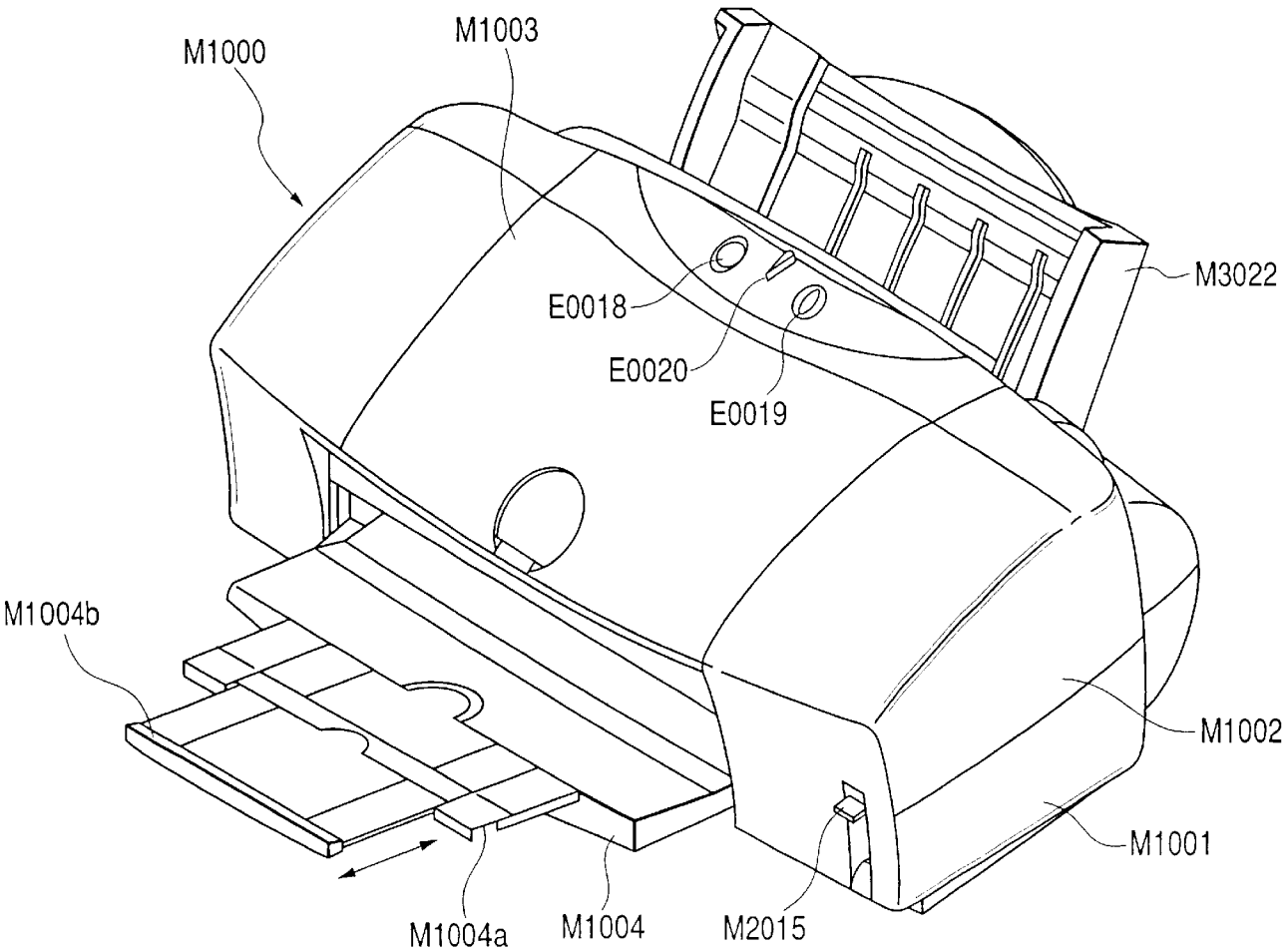
FIG. 1 is a perspective view which shows the outer appearance of an ink jet printer in accordance with the embodiment of the present invention.
Figure 2:
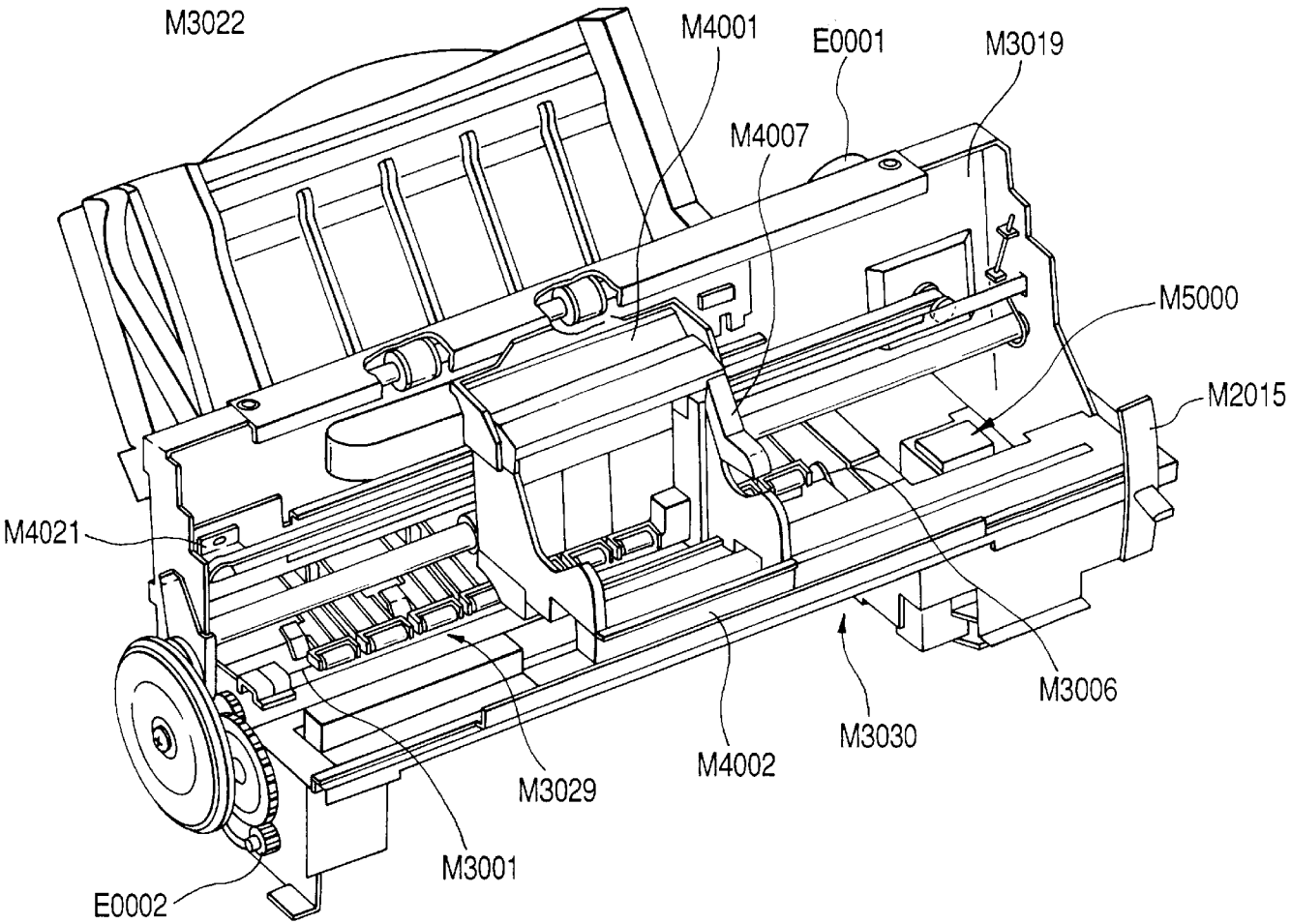
FIG. 2 is a perspective view which shows the state where the external members represented in FIG. 1 are removed.

FIG. 1 and FIG. 2 are views which schematically illustrate the structure of a printer using ink jet recording method. In FIG. 1, the apparatus main body M1000, which constitutes the outer housing of the printer in accordance with the present embodiment, comprises a lower case M1001; an upper case M1002; an access cover M1003 and an external member of an exhaust tray M1004; and a chassis M3019 (see FIG. 2) housed in the interior of the external member.

The chassis M3019 is formed by plural metallic plate members having a predetermined rigidity, which constitutes the skeleton of the recording apparatus to support each mechanism of various recording operations to be described later.

Also, the lower case M1001 forms substantially the lower half of the apparatus main body M1000, and the upper case M1002 forms substantially the upper half of the apparatus main body M1000, respectively. Then, on combining both cases, a hollow structure is formed with a space to house each of the mechanisms therein to be described later. On the upper portion and the front portion thereof, openings are formed, respectively.

Further, one edge portion of the exhaust tray M1004 is rotatively supported by the lower case M1001 to make it possible to open and close the opening formed on the front portion of the lower case M1001 by the rotation thereof. As a result, when a recording operation is performed the opening is made ready by rotating the exhaust tray M1004 to the front side, thus exhausting the recording sheet P from this opening to stack it one by one. Also, for the exhaust tray M1004, two auxiliary trays M1004*a* and M1004*b* are retractively arranged, which can be pulled out, respectively, from the front side as needed, thus making the supporting area of a recording sheet larger or smaller in three stages.

One edge portion of the access cover M1003 is rotatively supported by-the upper case M1002 to make it possible to open and close the opening formed on the upper surface. When opening this access cover M1003, it is made possible to exchange the recording head cartridges H1000 or the ink tanks H1900 which is installed on the interior of the apparatus main body. Here, although not shown particularly, it is arranged to rotate the cover open and close lever formed on the reverse side of the access cover M1003 when it is open or closed. Then, the rotated position of the lever is sensed by a microswitch or the like to detect the open or closed state of the access cover.

Also, on the upper face of the rear portion of the upper case M1002, a power source key E0018 and a resume key E0019 are arranged to be depressible, and at the same time, a LED E0020 is arranged. Then, when the power source key E0018 is depressed, the LED E0020 is illuminated to let the operator know that recording is made ready. Also, various indicating functions are arranged to let the operator know of the printer trouble or the like by the way of blinking of the LED E0020, the illuminated color thereof, or by sounding a buzzer E0021 (see FIG. 7). Here, when trouble or the like has been solved, recording is resumed by depressing the resume key E0019.

(The Mechanism of the Recording Operation)

Now, the description will be made of the mechanism of recording operation installed and supported by the main body M1000 of the printer in accordance with the present embodiment.

For the present embodiment, the mechanism of recording operation comprises an automatic feeder M3022 that automatically feeds the recording sheets P to the interior of the apparatus main body; a carrier unit M3029 that carries each of the recording sheets P fed from the automatic feeder one by one, at the same time, guiding the recording sheet P from the recording position to the exhaust unit M3030; a recording unit to perform a desired recording on the recording sheet P carried onto the carrier unit M3029; and a recovery unit (M5000) that performs recovery process for the recording unit or the like.

(Recording Unit)

Here, the aforesaid recording unit will be described.

The recording unit comprises a carriage M4001 movably supported by the carriage shaft M4021, and the recording head cartridge H1000 detachably mountable on the carriage M4001.

(Recording Head Cartridge)

At first, in conjunction with FIG. 3 to FIG. 5, the recording head cartridge will be described.

Figure 3:
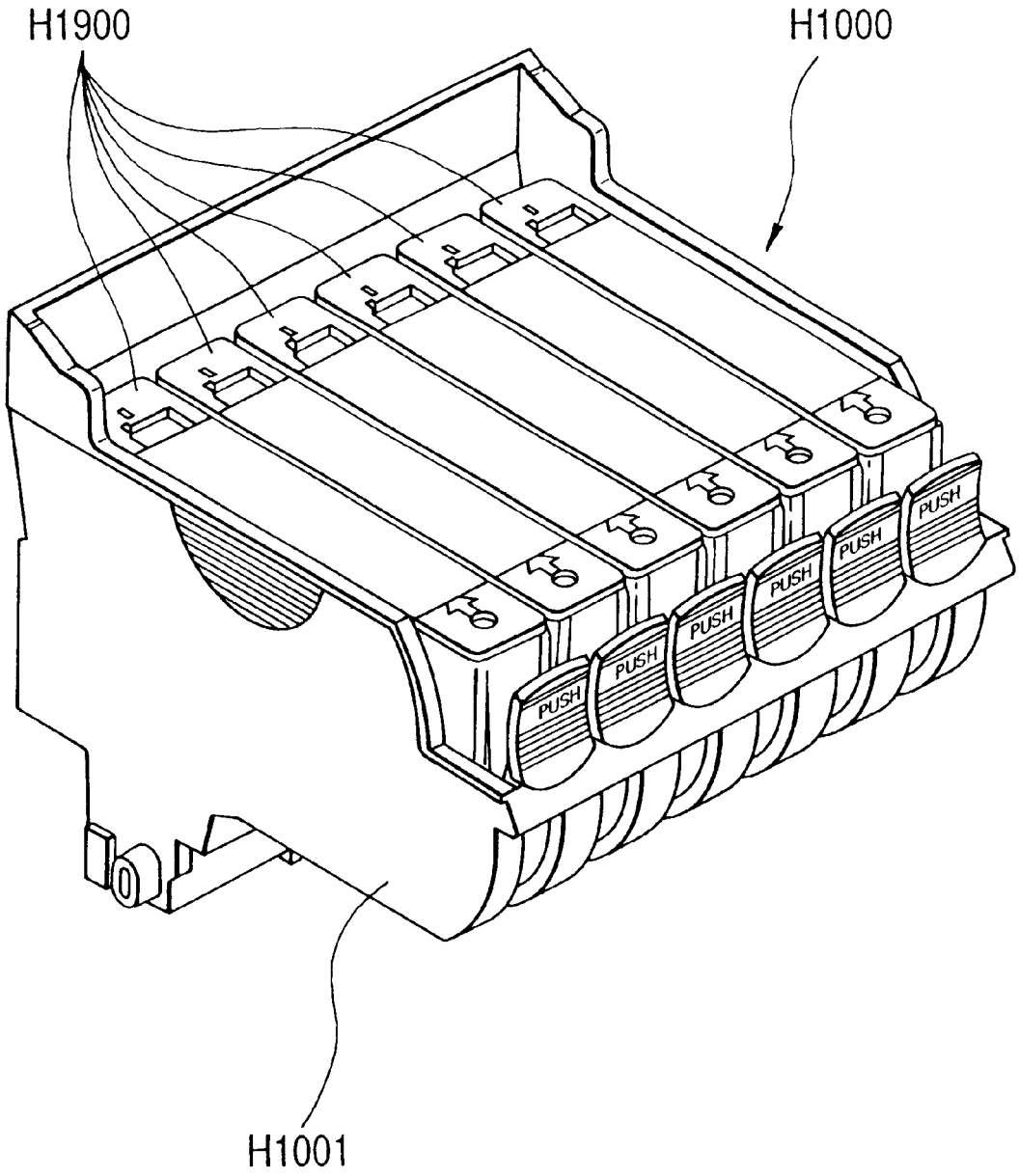
FIG. 3 is a perspective view which shows the state where a recording head cartridge is assembled for use of the embodiment of the present invention.

The recording head, cartridge H1000 of the present embodiment is provided with an ink tank H1900 that retains ink as shown in FIG. 3, and a recording head H1001 that discharges from nozzles the ink which has been supplied from the ink tank H1900 in accordance with recording information. Here, the recording head H1001 adopts the so-called cartridge system where it is made detachably mountable on the carriage M4001 to be described later.

Figure 4:
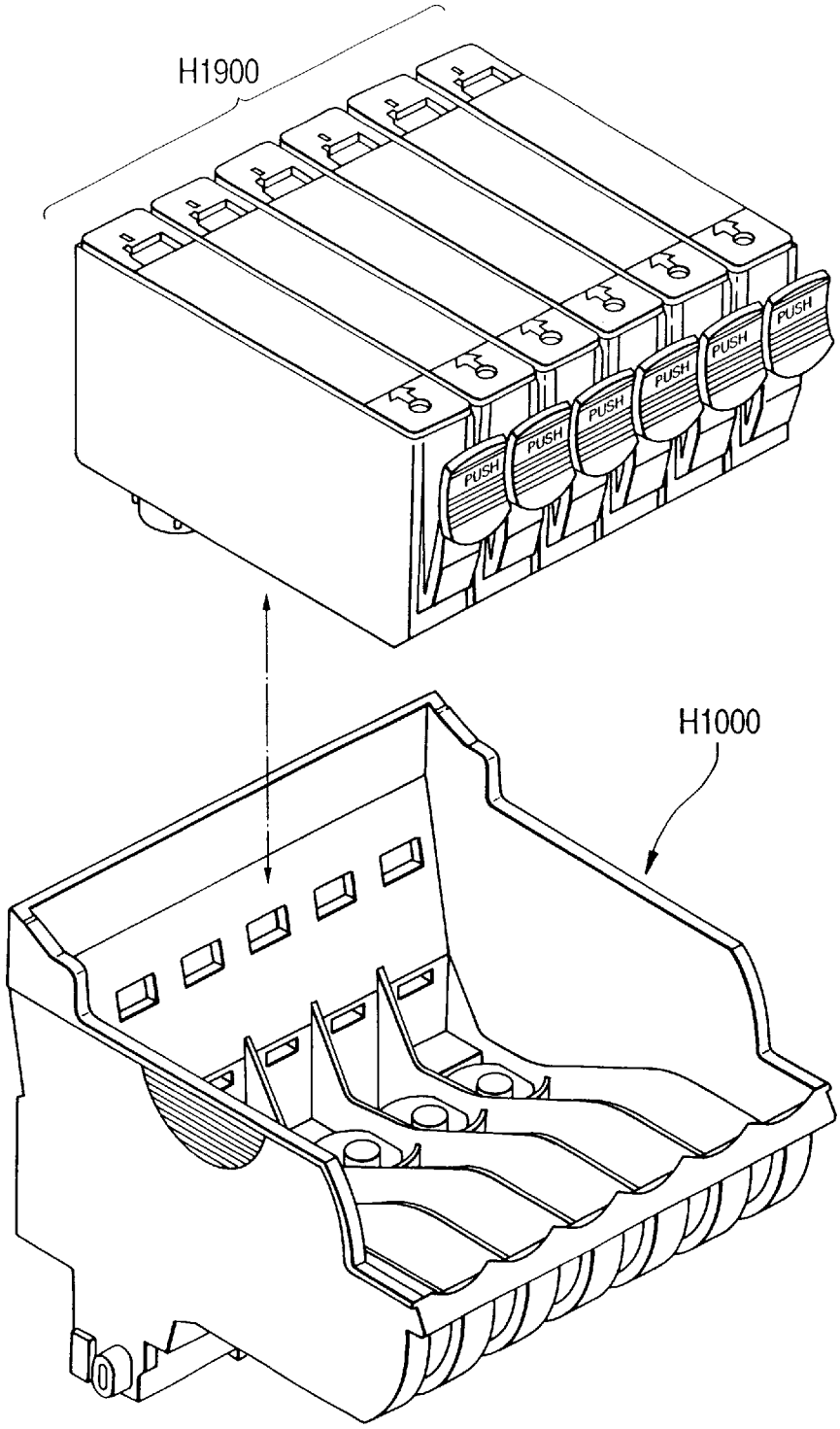
FIG. 4 is an exploded perspective view which shows the recording head cartridge represented in FIG. 3.

For the recording head cartridge H1000 shown here has ink tanks which are prepared for black, light cyan, light magenta, cyan, magenta, and yellow, respectively, as shown in FIG. 4. Each of them is arranged to be detachably mountable on the recording head H1001.

Figure 5:
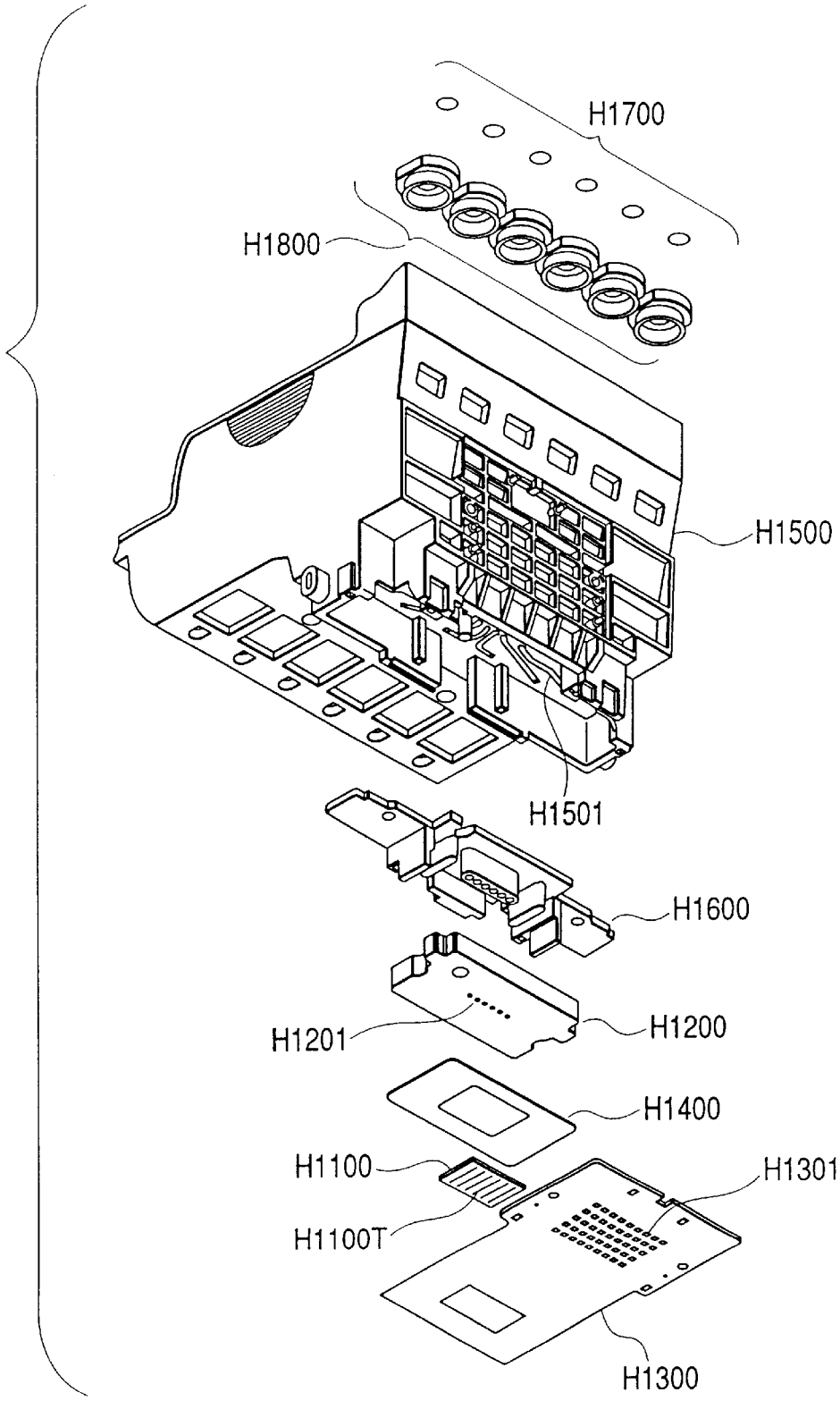
FIG. 5 is an exploded perspective view which shows the recording head represented in FIG. 4, observed from diagonally below.

Then, as shown in FIG. 5 which is an exploded perspective view, the recording head H1001 comprises a recording element base plate H1100; a first plate H1200; an electric wiring base plate H1300; a second plate H1400; a tank holder H1500; a flow path forming member H1600; a filter H1700; and a sealing rubber H1800.

For the recording element base plate H1100, a plurality of recording elements that discharge ink, and the electric wiring of Al or the like to supply electric power to each of the recording elements are formed by means of film formation technologies and techniques on one side of the Si base plate. Then, corresponding to the recording elements, a plurality of ink flow paths and discharge ports H1100T are formed by means of the photolithographic process, and at the same time, an ink supply port is formed to open to the reverse side thereof in order to supply ink to a plurality of ink flow paths. Also, the recording element base plate H1100 is bonded and fixed to the first plate H1200. Here, the ink supply port H1201 is formed to supply ink to the recording element base plate H1100. Further, the second plate H1400 having an opening is bonded and fixed to the first plate H1200. The second plate H1400 holds the electric wiring base plate H1300*a* so that the electric wiring base plate H1300 and the recording element base plate H1100 are electrically connected. The electric wiring base plate H1300 is to apply electric signals to the recording element base plate H1100 for discharging ink, which comprises the electric wiring corresponding to the recording element base plate H1100, and the external signal input terminal H1301 positioned on the electric wiring edge portion to receive electric signals from the main body. The external signal input terminal H1301 is positioned and fixed on the backside of the tank holder H1500 which will be described later.

On the other hand, the flow path forming member H1600 is welded by means of ultrasonic waves to the tank holder H1500 that detachably supports the ink tank H1900, thus forming the ink flow path H1501 from the ink tank H1900 to the first plate H1200. Also, for the edge portion of the ink flow path H1501 on the ink tank side, which engages with the ink tank H1900, the filter H1700 is installed to prevent dust particles from entering from the outside. Also, the sealing rubber H1800 is applied to the coupling portion with the ink tank H1900 in order to prevent ink from being evaporated from the coupling portion.

Further, as described earlier, the tank holder unit, which comprises the hank holder H1500, the flow path forming member H1600, the filter H1700, and the sealing rubber H1800, is coupled by bonding or the like with the recording element unit which comprises the recording element base plate H1100, the first plate H1200, the electric wiring base plate H1300, and the second plate H1400, thus forming the recording head H1001.

Now, in conjunction with FIG. 2, the carriage M4001 will be described.

As shown in FIG. 2, the carriage M4001 is provided with the carriage cover M4002 which engages with the carriage M4001 to guide the recording head H1001 to the installation position of the carriage M4001, and a head setting lever M4007 which engages with the tank holder H1500 of the recording head H1001 to compress the recording head H1001 so that it is set in the predetermined installation portion.

In other words, the head setting lever M4007 is rotatively installed on the upper part of the carriage M4001 centering on the head setting lever shaft, and at the same time, a head setting plate (not shown) is provided for the coupling portion with the recording head H1001 through a spring. Then, the structure is arranged so that with the force exerted by this spring, the recording head H1001 is compressed and installed on the carriage M4001.

Also, the coupling portion of the carriage M4001 other than the coupling portion with the recording head H1001 is provided with a contact flexible printed cable (hereinafter referred to as the contact FPC) E0011, and the contact portion of the contact FPC E0011 and the contact unit (external signal input terminal) H1301 provided for the recording head H1001 are electrically in contact to make it possible to transfer and receive various kinds of information for recording and the supply of electric power to the recording head H1001, among some others.

Here, an elastic member, such as rubber (not shown), is provided between the contact portion of the contact FPC E0011 and the carriage M4001 to keep the contact portion and the carriage M4001 securely in contact by means of the elastic force of this elastic member and the spring force of the head setting lever. Further, the contact FPC E0011 is connected with the carriage base plate E0013 installed on the reverse side of the carriage M4001 (see FIG. 7).

(Scanner)

The printer of the present embodiment is also usable as a reading apparatus by replacing the recording head with a scanner which is also configured like a recording head.

The scanner moves together with the carriage on the printer side to read the images on a source document which is carried in place of a recording medium. Then, it is arranged to read out the image information on one source document by alternately performing the operation of read and feed of the source document.

Figure 6B:
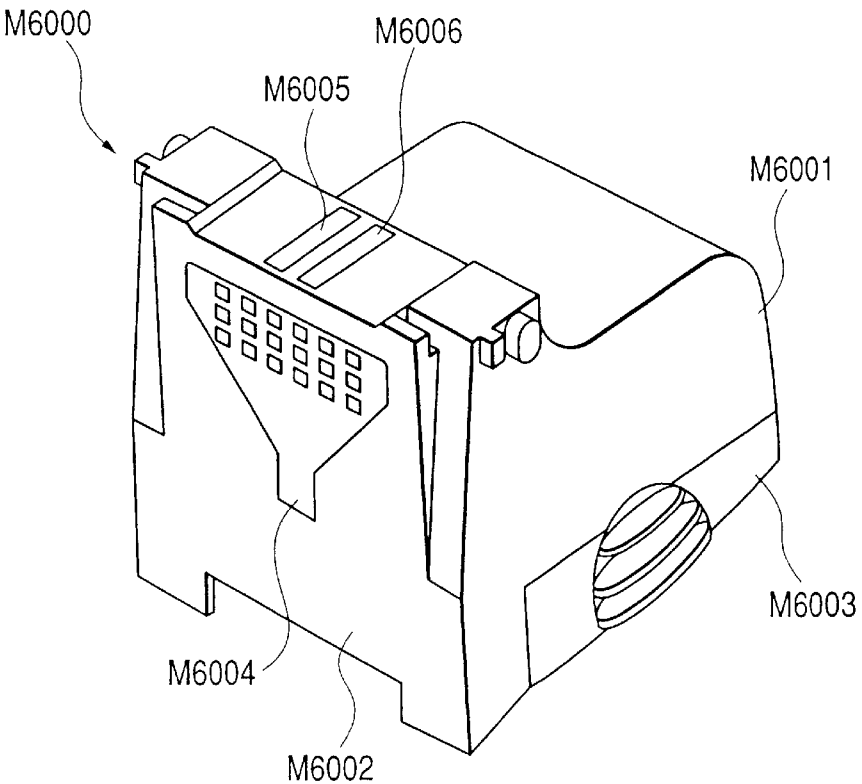
FIGS. 6A and 6B are perspective views which illustrate a scanner cartridge in accordance with the embodiment of the present invention.
Figure 6A:
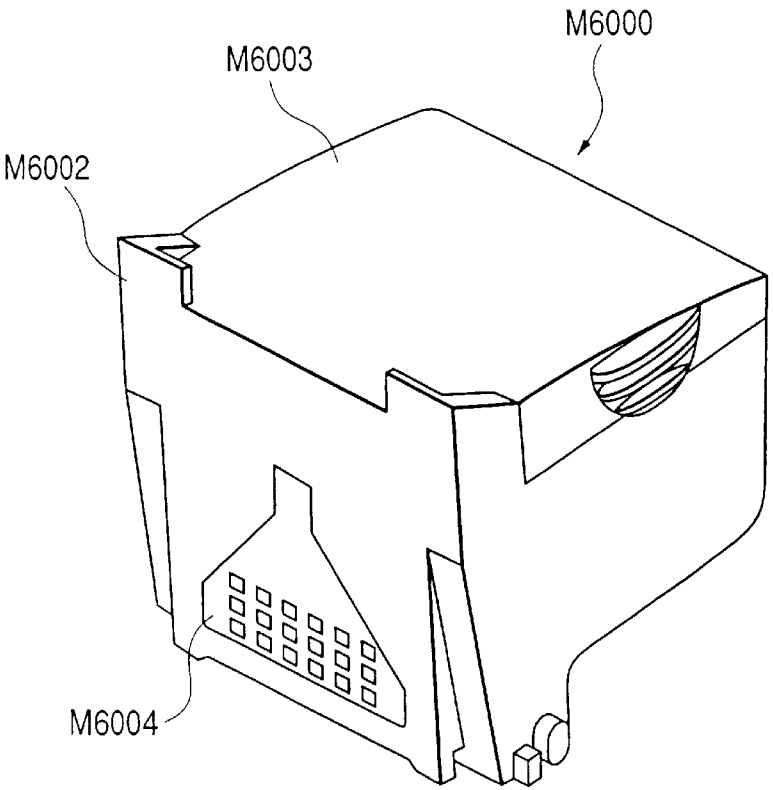

FIGS. 6A and 6B are views which schematically illustrate the structure of the scanner M6000.

As shown in FIGS. 6A and 6B, the scanner holder M6001 is of box type, in which the optical system and processing circuit are installed to effectuate reading as required. Also, a scanner reading lens M6006 is installed on the portion that faces the surface of a source document when the scanner M6000 is installed on the carriage M4001. The images of the source document are read through it. A scanner illumination lens M6005 is provided with a light source (not shown) inside the scanner to irradiate light emitted from the light source on the source document through it.

The scanner cover M6003 fixed to the bottom face of the scanner holder M6001 is fitted to the scanner holder M6001 to shield the interior thereof. Then, with the louver-like handles arranged on the side faces, it is intended to enhance the operability of the scanner M4001 for its attachment and detachment. The outer shape of the scanner holder M6001 is almost the same as that of the recording head H1001, which is detachably mountable on the carriage M4001 in the same manner as to handle the recording head cartridge H1000.

Also, for the scanner holder M6001, the base plate having the processing circuit provided therefor is incorporated, while the scanner contact PCB which is connected with this base plate is arranged to be exposed outside. Then, when the scanner M6000 is installed on the carriage M4001, the scanner contact PCB M6004 is in contact with the contact FPC E0011 on the carriage M4001 side, thus connecting the base plate with the control system on the main body side electrically through the carriage M4001.

Now, the description will be made of the structure of the electric circuit in accordance with the present embodiment of the invention.

Figure 7:
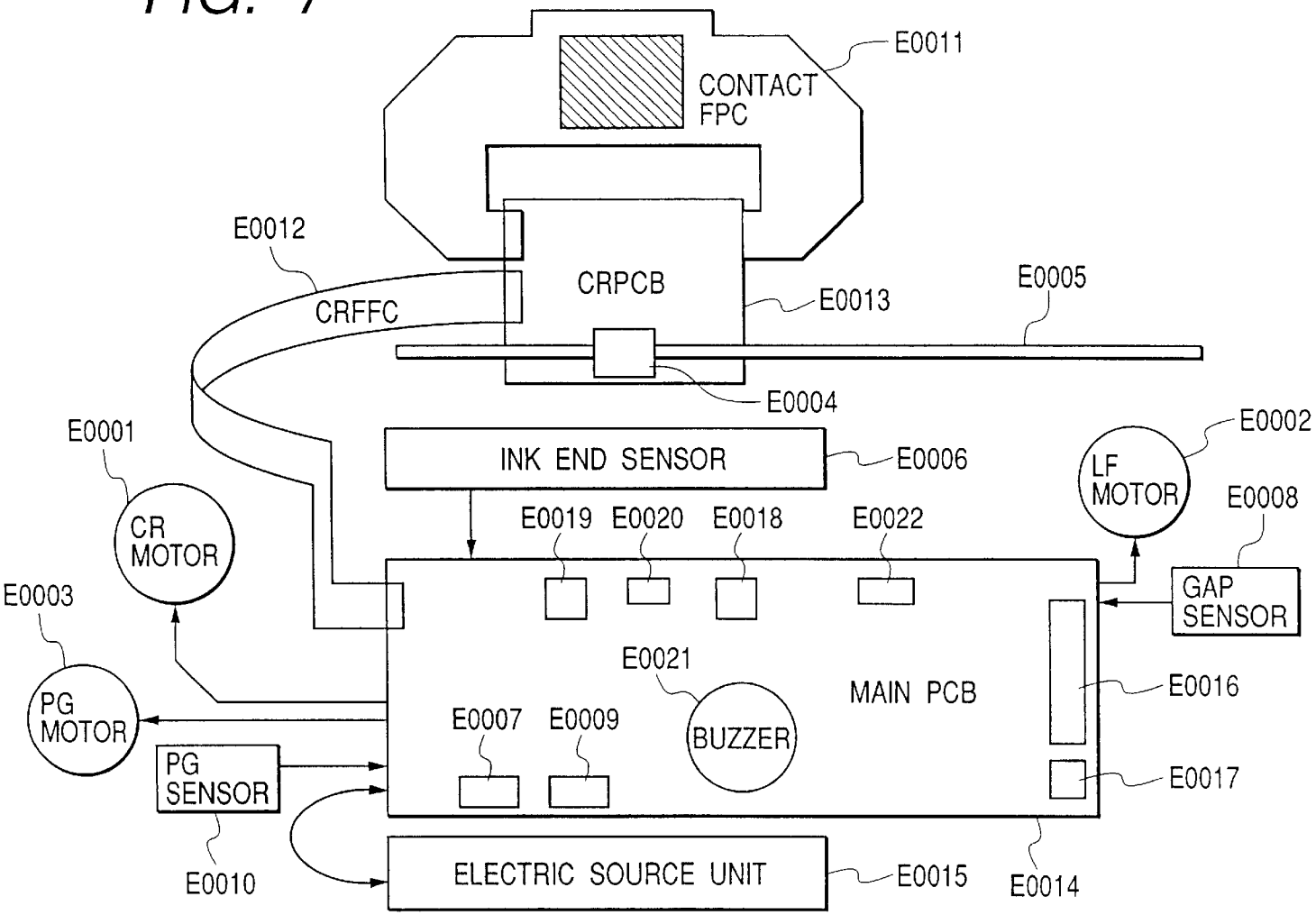
FIG. 7 is a block diagram which schematically shows the entire structure of an electric circuit in accordance with the embodiment of the present invention.

FIG. 7 is a view which schematically shows the entire structure of the electric circuit of the present embodiment.

The electric circuit here mainly comprises the carriage base plate (CRPCB) E0013, the main PCB (Printed Circuit Board) E0014, and the power source unit E0015, among some others.

In this respect, the power source unit is connected with the main. PCB E0014 to supply various driving powers.

Also, the carriage base plate E0013 is a printed base plate unit mounted on the carriage M4001 (see FIG. 2), and functions as an interface to deal with signals from and to the recording head through the contact FPC E0011. Also, along with the movement of the carriage M4001, this unit detects the positional changes between the encoder scale E0005 and the encoder sensor E0004 in accordance with the pulse signals output from the encoder sensor E0004, and then, outputs the detected output signals to the main PCB E0014 through the flexible flat cable (CRFFC) E0012.

Further, the main PCB is a printed base plate unit that controls the driving of each unit of the ink jet recording apparatus of the present embodiment, which has I/O ports for a paper edge sensor (PE sensor) E0007; an ASF sensor E0009; a cover sensor E0022; a parallel interface (parallel I/F) E0016; a serial interface (serial I/F) E0017; a resume key E0019; a LED E0020; a power source key E0018; and a buzzer E0021, among some others. This PCB is also connected with the CR motor E0001, the LF motor E0002, and the PG motor E0003 to control driving each of them. Besides, it has a connecting interface with the ink end sensor E0006; the GAP sensor E0008; the PG sensor E0010; the CRFFC E0012; and the power source unit E0015.

Figures 8, 8A:
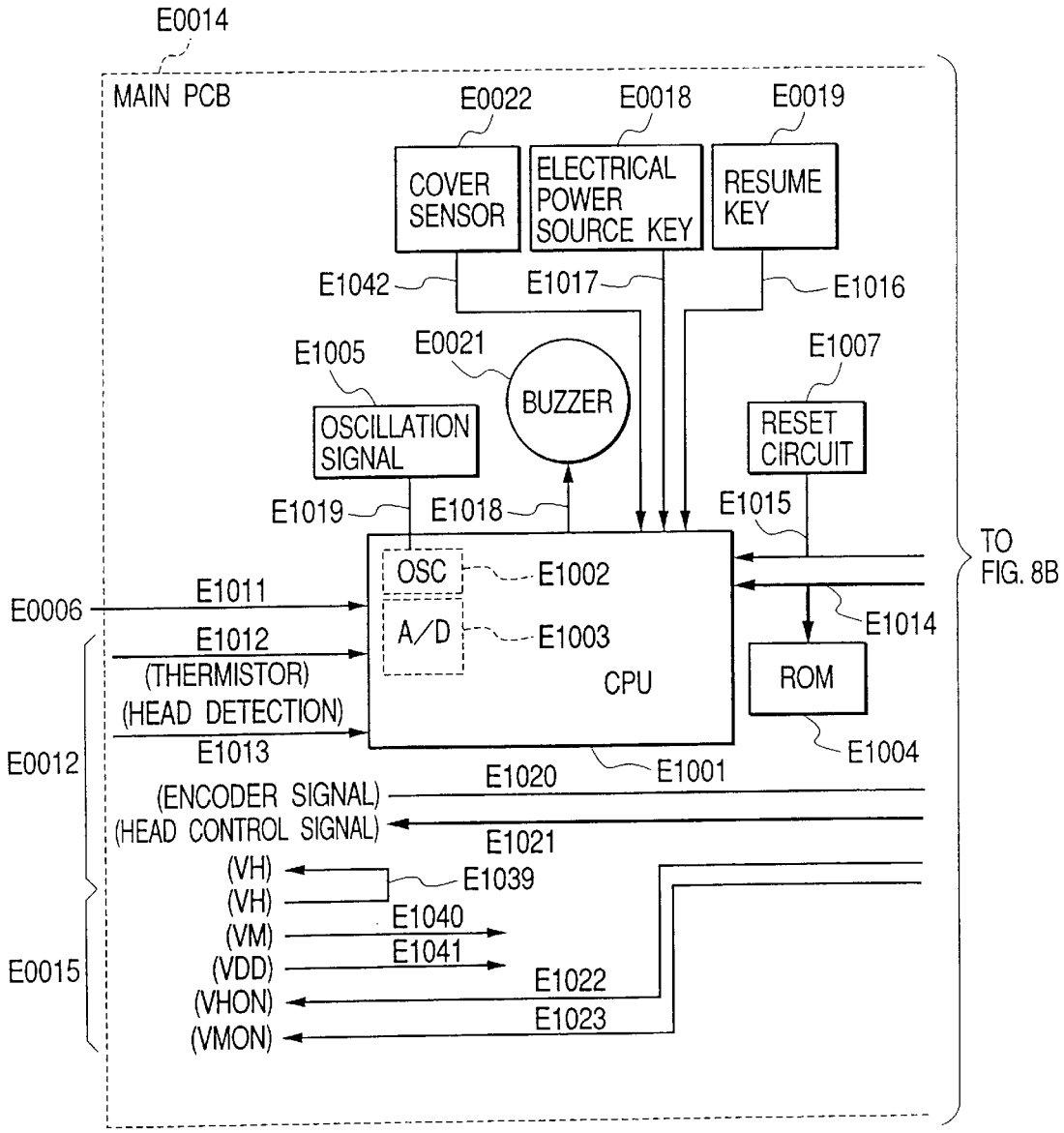
FIG. 8, composed of FIGS. 8A and 8B, is a block diagram which shows the inner structure of the main PCB board represented in FIG. 7.
Figure 8B:
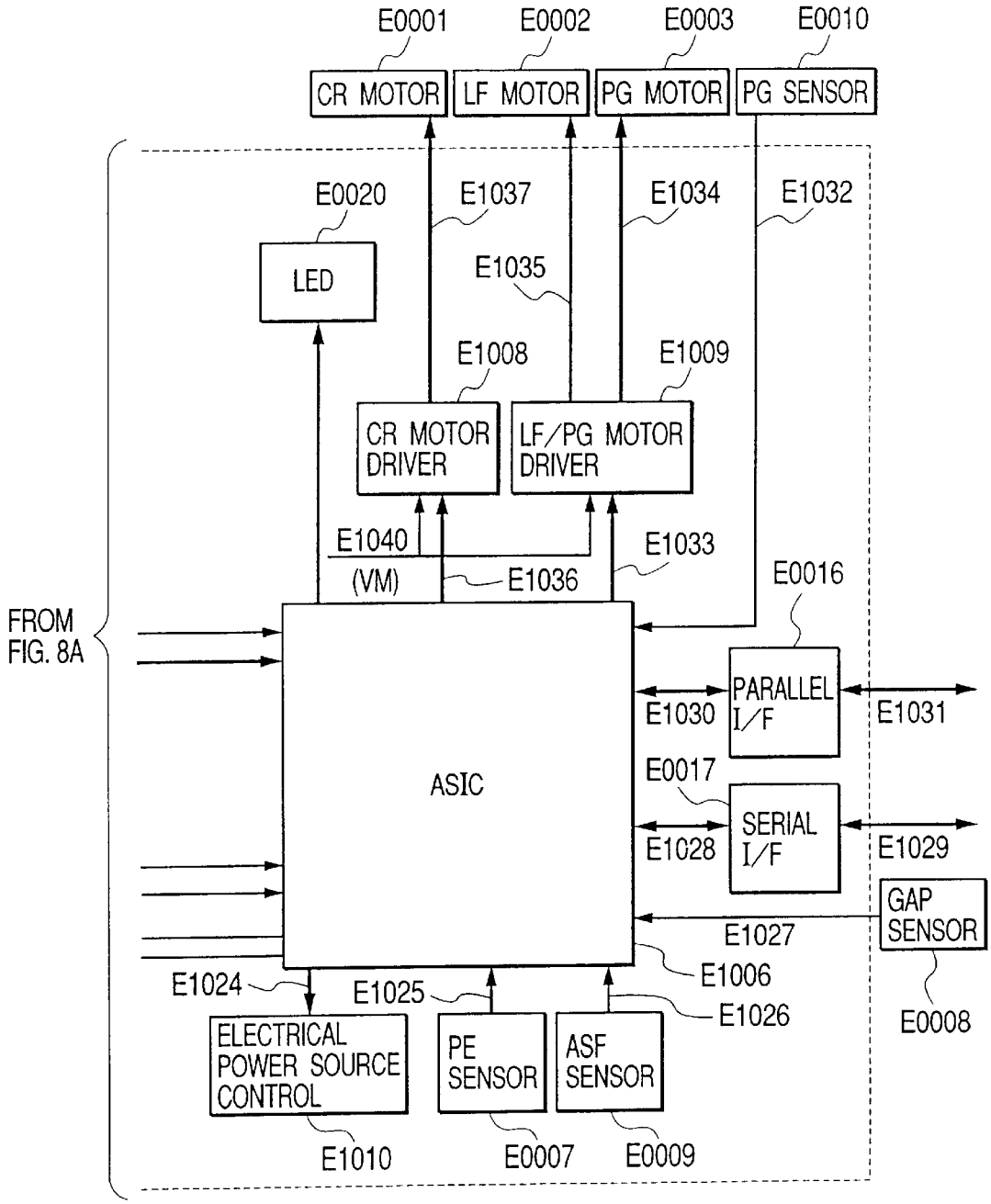

FIGS. 8A and 8B are block diagrams which show the inner structure of the main PCB.

In FIGS. 8A and 8B, a reference numeral E1001 designates a CPU. The CPU E1001 is provided with an oscillator OSC E1002, and at the same time, it is connected with the oscillating circuit E1005 to generate system clock with the output signals E1019 therefrom, and also, through the control bus E1014, it is connected with the ROM E1004 and the ASIC (Application Specific Integrated Circuit) E1006. Thus, in accordance with the program stored on the ROM, it controls the ASIC, and detects the input signals E1017 from the power sourceikey; the input signals E1016 from the resume key, as well as the current status of the cover detection signal E1042 and the head detection signal (HSENS) E1013. Further, it sounds the buzzer E0021 in accordance with the buzzer signal (BUZ) E1018. Then, while detecting the current status of the ink end detection signal (INKS) Elll and the thermistor temperature detection signal (TH) E1012, which are connected with the incorporated A/D converter E1003, it controls the driving of the ink jet recording apparatus by executing various logical operations required, as well as determining conditions or the like.

Here, the head detection signal E1013 is a head installation detecting signal which is inputted from the recording head cartridge H1000 through the flexible flat cable E0012, the carriage base plate E0013, and the contact flexible printed cable E0011. The ink end detection signal is an analogue signal output from the ink end sensor E0006. The thermistor temperature detection signal E1012 is an analogue signal output from a thermistor (not shown) installed on the carriage base plate E0013.

A reference numeral E1008 designates the CR motor driver which generates the CR motor driving signal E1037 with the motor power source (VM) E1040 as its driving power source and in accordance with the CR motor control signal E1036 output from the ASIC E1006, thus driving the CR motor E0001; E1009, the LF/PG motor driver which generatesthe LF motor driving signal E1035 with the motor power source E1040 as a driving power source, and in accordance with the pulse motor control signal (PM control signal) E1033 output from the ASIC E1006, thus driving the LF motor, at the same time, generating the PG motor driving signal E1034 to drive the PG motor.

A reference numeral E1010 designates the power source control circuit which controls power supply to each of the sensors orthe like provided with the light emitting devices in accordance with the power source control signals E1024 output from the ASIC E1006. The parallel I/F E0016 transmits the parallel I/F signals E1030 output from the ASIC E1006 to the parallel I/F cable E1031 which is externally connected, and also, transmits the signals of the parallel I/F cable E1031 to the ASIC E1006. The serial I/F E0017 transmits the serial I/F signals E1028 output from the ASIC E1006 to the serial I/F cable E1029 externally connected, and also, transmits the signals from the cable E1029 to the ASIC E1006.

On the other hand, the head power source (VH) E1039, the motor power source (VM) E1040, and the logic power sour (VDD) E1041 are supplied from the power source unit E0015. Also, from the ASIC E1006, the head power source ON signal (VHON) E1022, the motor power source ON signal (VMOM ) E1023 are inputted into the power source unit E0015, thus controlling the ON/OFF of the head power source E1039 and the motor power source E1040, respectively. The logic power source (VDD) E1041 supplied from the power source unit E0015 is given a voltage transformation as required, and then, supplied to each of the internal and external units of the main PCB E0014.

Also, the head power source E1039 is smoothed on the main PCB E0014, and then, to be transmitted to the flexible flat cable E0011 for driving the recording head cartridge H1000.

A reference numeral E1007 designates the resetting circuit to detect the drop of the logic power source voltage E1040, and supplies a resetting signal (RESET) E1015 to the CPU E1001 and the ASIC E1006 to perform initialization.

The ASIC E1006 is one-chip semiconductor integrated circuit, which is controlled by the CPU E1001 through the control bus E1014, and outputs the CR motor control signal E1036, the PM control signal E1033, the power source control signal E1024, the head power source ON signal E1022, and the motor power source ON signal E1023, among some others, and also, perform the transmission and reception of signals through the parallel I/F E0016 and the serial I/F E0017. Besides, it detects the status of the PE detection signal (PES) E1025 from the PE sensor E0007; the ASF detection signal (ASFS) E1026 from the ASF sensor E0009; the GAP detection signal (GAPS) E1027 from the GAP sensor E0008; and the PG detection signal (PGS) E1032 from the PG sensor E0007, and then, transmits the data on each of them to the CPU E1001 through the control bus E1014. The CPU E1001 controls the LED driving signals E1038 to turn on and off the LED E0020 accordingly.

Further, the condition of the encoder signal (ENC) E1020 is detected to generate the timing signals, and the recording head cartridge H1000 is interfaced by use of the head control signals E1021 to control the recording operation. Here, the encoder signals (ENC) E1020 are the output signals from the CR encoder sensor E0004, which are inputted through the flexible flat cable E0012. Also, the head control signals E1021 are supplied to the recording head H1000 through the flexible flat cable E0012, the carriage base plate E0013, and the control FPC E0011.

Figures 9, 9A:
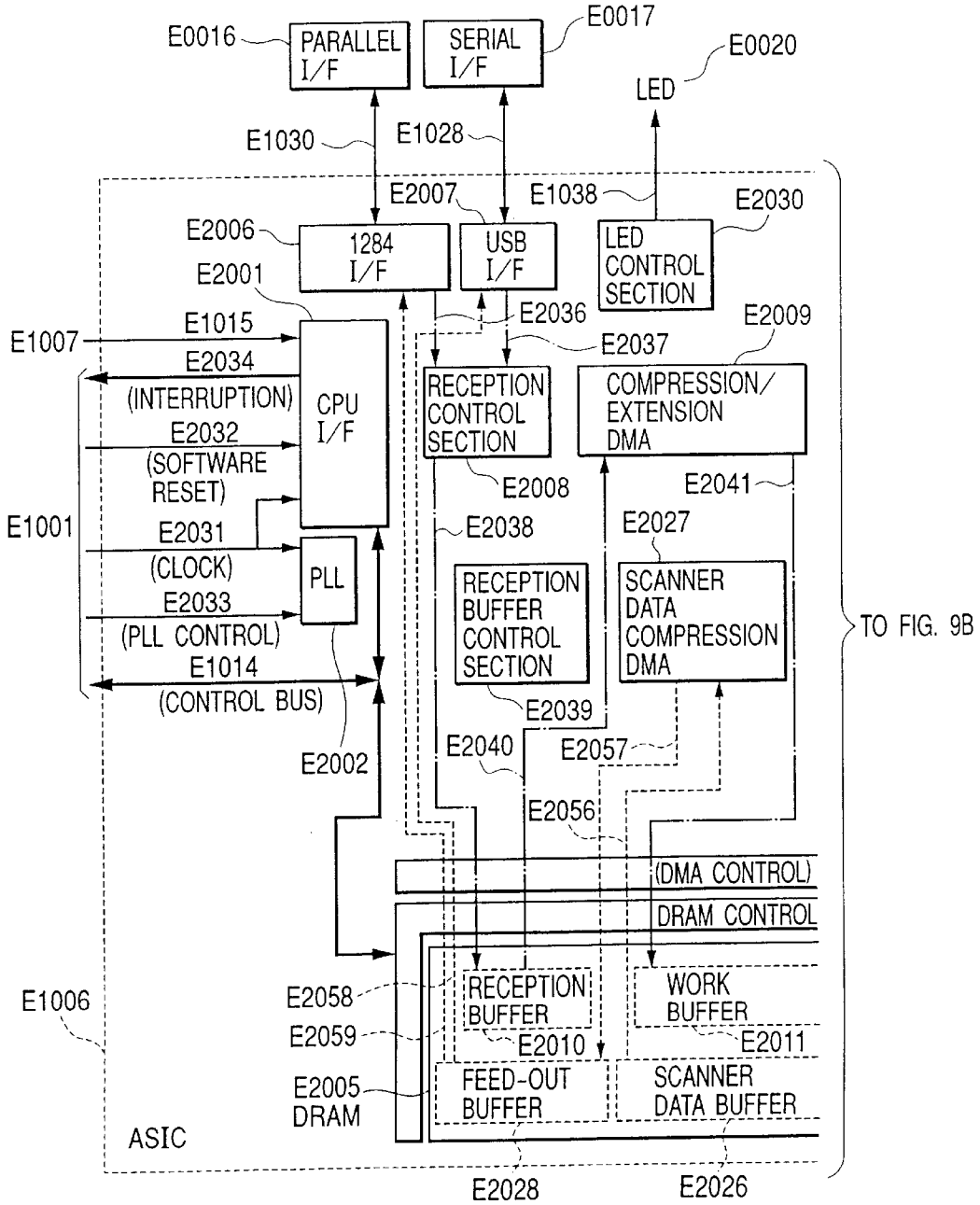
FIG. 9, composed of FIGS. 9A, 9B and 9C, is a block diagram which shows the inner structure of the ASIC represented in FIGS. 8A and 8B.
Figure 9B:
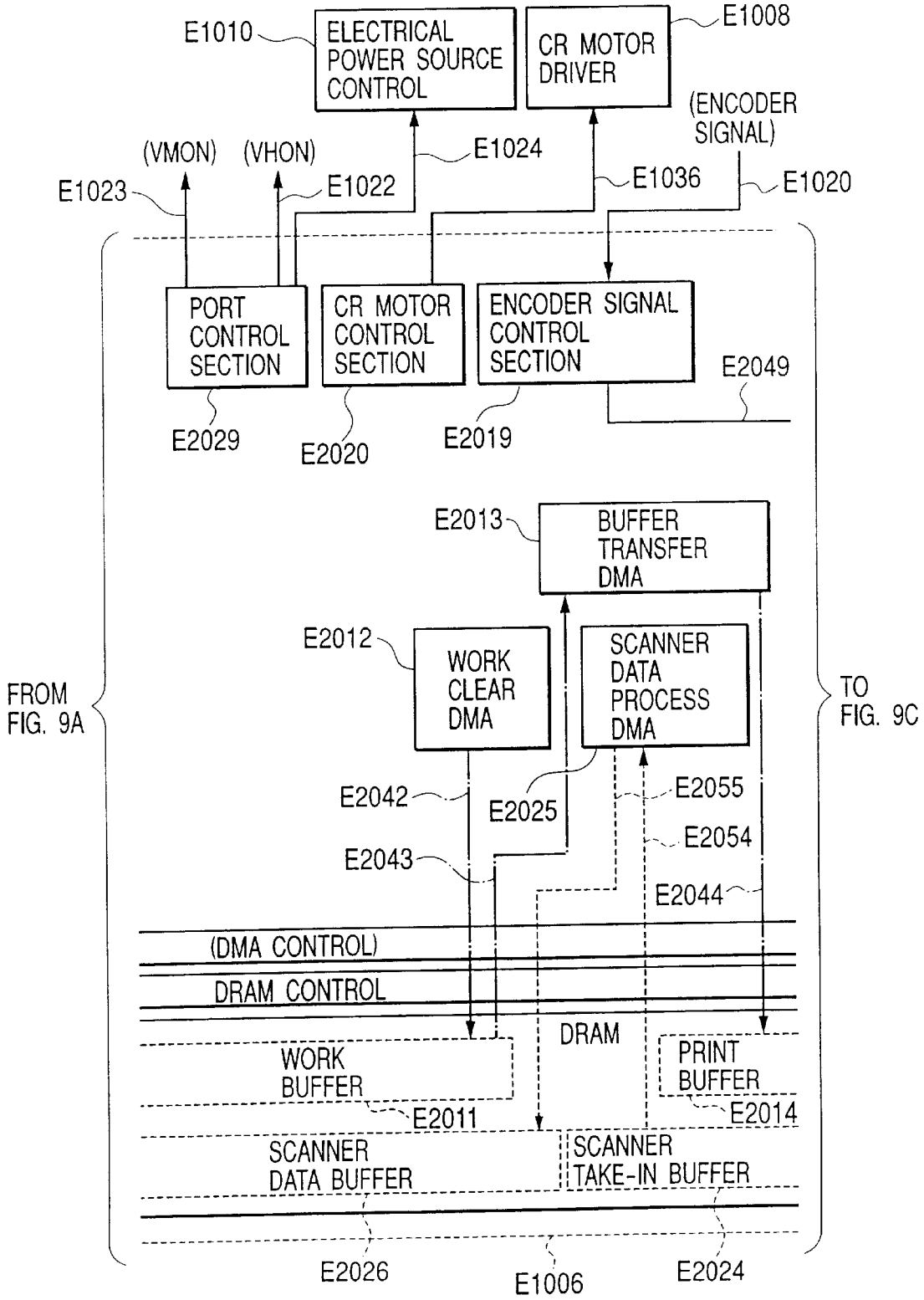
Figure 9C:
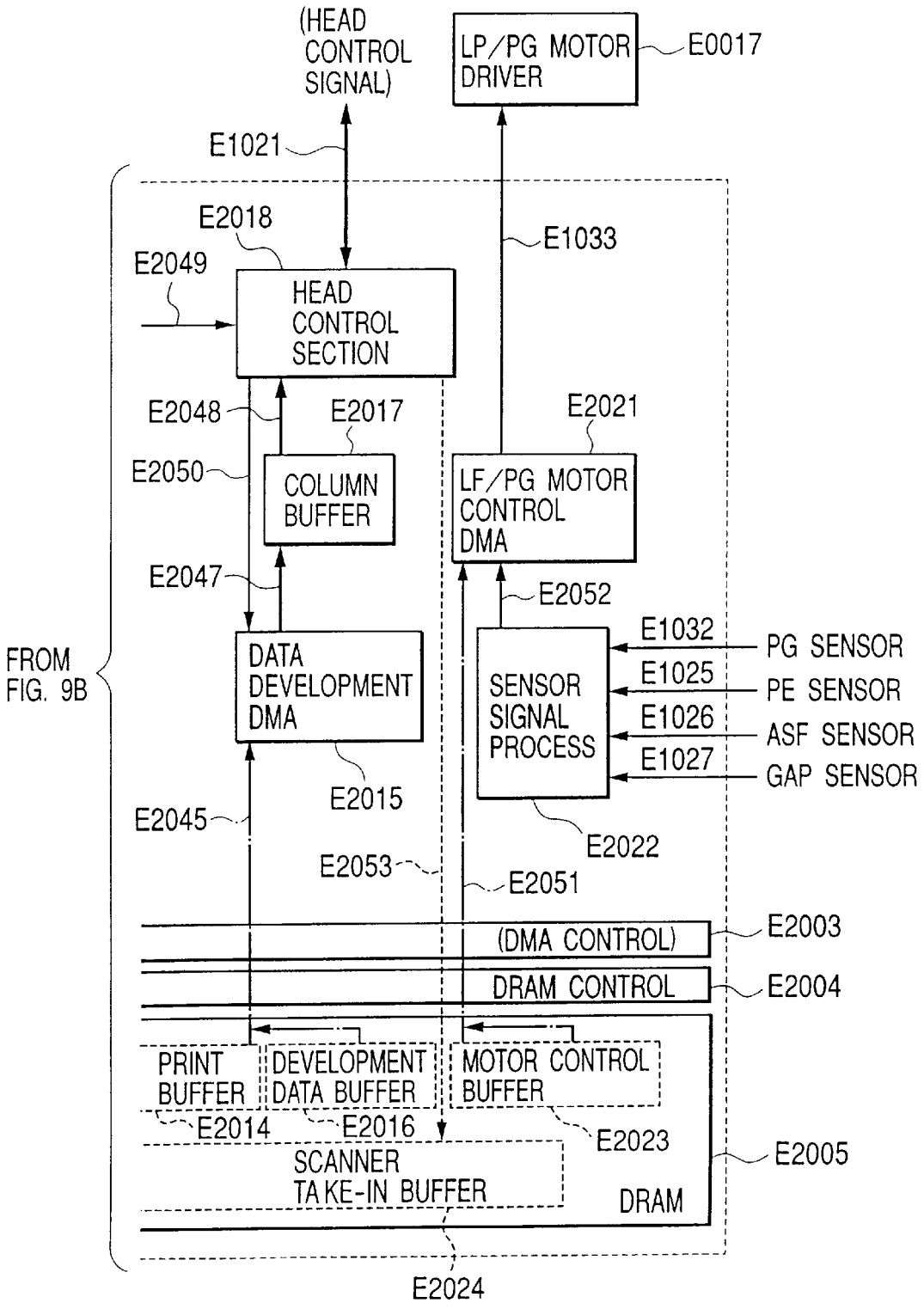

FIGS. 9A, 9B and 9C are block diagrams which show the inner structure of the ASIC E1006.

Here, in FIGS. 9A, 9B and 9C, the connection between each of the blocks indicates only the data flow related to the controls of each part of the head and various mechanisms, such as recording data, motor control data, among some others. The control signals which are related to the control signals and clocks required for reading from or writing to the registers incorporated in each of the blocks, and also, the one related to the DMA controls, among some others, are omitted in order to avoid complicated representation on FIGS. 9A, 9B and 9C.

In FIGS. 9A, 9B and 9C, a reference numeral E2002 designates PLL which generates clock (not shown) to be supplied to the major portions of the ASIC E1006 by use of the clock signals (CLK) E2031 output from the CPU E1001, and the PLL control signal (PLLON) E2033.

Also, a reference numeral E2001 designates the CPU interface (CPU I/F), which controls reading from or writing to the registers of each block to be described below, supplies clocks to a part of blocks, and receives the interruption signals (none of them is shown), among some others, and then, outputs interruption signals (INT) E2034 to the CPU E1001 to notify the interruption occurring in the interior of the ASIC E1006 in accordance with the soft resetting signal (PDWN) E2032, the clock signals (CLK) E2301, and the control signals from the control bus E1014.

Also, a reference numeral E2005 designates the DRAM serving as the recording buffer, which is provided with each area for reception buffer E2010, work buffer E2011, printing buffer E2014, development buffer E2016, and the like, and at the same time, it is provided with the buffer E2023 for controlling motors. Further, as the buffer usable in the mode of scanner operation, it is provided each area for scanner fetch buffer E2024, scanner data buffer E2026, send-out buffer E2028, and the like in place of each of the recording data buffers.

Also, the DRAM E2005 is used as the work area needed for operating the CPU E1001, too. In other words, a reference numeral E2004 designates the DRAM control unit to control access to the DRAM E2005 from the CPU E1001 by use of the control bus, as well as to control reading from and writing to the DRAM E2005 by switching access from the DMA control unit E2003 to the DRAM E2005, which will be described later.

When receiving request (not shown) from each of blocks, the DMA control unit E2003 outputs to the RAM control unit the address-signals or control signals (not shown) or writing data (E2038, E2041, E2044, E2053, E2055, and E2057) and others if a writing operation is requested, hence operating the DRAM access. Also, if reading is requested, it transmits the read-out data from the DRAM control unit E2004 (E2040, E2043, E2045, E2051, E2054, E2056, E2058, and E2059) to the block originating such request.

Also, a reference numeral E2006 designates the 1284 I/F which interfaces the operation of the bidirectional communications with the external host equipment (not shown) through the parallel I/F E0016 by the control of CPU E1001 by way of the CPU I/F E2001. Beside, it transfers reception data (PIF reception data E2036) from the parallel I/F E0016 to the reception control unit E2008 by means of the DMA process at the time of recording. It transfers the data stored on the send-out buffer E2028 on the DRAM E2005 (1284 transmission data (RDPIF) E2059) to the parallel I/F by means of the DMA process at the time of scanner operation.

A reference numeral E2007 designates the USB I/F, which controls the CPU E1001 through the CPU I/F E2001 to interface the operation for the bidirectional communications with the external host equipment (not shown) through the serial I/F E0017. Besides, it transfers the reception data (USB reception data E2037) from the serial I/F E0017 to the reception control unit E2008 by means of the DMA process at the time of printing. It transmits the data stored on the send-out buffer E2028 on the DRAM E2005 (USB transmission data (RDUSB) E2058) to the serial I/F E0017 by means of the DMA process at the time of scanner reading operation. The reception control unit E2008 writes the reception data (WDIF) E2038 on the I/F selected either from 1284 I/F E2006 or the USB I/F E2007 to the reception buffer writing addresses which are controlled by the reception buffer control unit E2039.

A reference numeral E2009 designates the compression and expansion DMA, which reads the reception data (raster data) stored on the reception buffer E2010 from the reception buffer read-out addresses control be the reception buffer control unit E2039 by the control of CPU E1001 through the CPU I/F E2001, and then, compresses or expands such data (RDWK) E2040 depending on the designated mode, and writes them on the work buffer area as the recording code array (WDWK) E2041.

A reference numeral E2013 designates the recording buffer transmission DMA, which reads out the recording codes (RDWP) E2043 on the work buffer E2011 by the control of the CPU E1007 through the CPU I/F E2001. Then, it rearranges each of the recording codes for the addresses on the printing buffer E2014 to be suitable for the order of data transfer to the recording head cartridge H1000 for the execution of transfer (WDWP E2044). Also, a reference numeral E2014 designates the work clear DMA, which writes repeatedly the designated work file data (WDWF) E2042 to the area on the work buffer where the transfer is completed by means of the recording buffer transfer DMA E2015 by the control of CPU E1001 through the CPU I/F E2001.

A reference numeral E2015 designates the recording data development DMA, which reads out the recording data rearranged and written on the printing buffer with the data development timing signals E2050 from the head control unit E2018 as trigger by the control of the CPU E1001 through the CPU I/F E2001, as well as the development data written on the development buffer E2016, and generates the developed recording data (RDHDG) E2045 and writes them on the column buffer E2017 as the column buffer writing data (WDHDG) E2047. Here, the column buffer E2017 is the SRAM which provisionally stores the transferring data (developed recording data) to the recording head cartridge H1000, and which is commonly controlled by both blocks by the handshake signals (not-shown) of the recording data development DMA and the head control unit.

A reference numeral E2018 designates the head control unit which interfaces with the recording head cartridge H1000 or the scanner by the control of the CPU E1001 through the CPU I/F E2001. Besides, it outputs the data development timing signals E2050 to the recording data development DMA in accordance with the head driving timing signals E2049 from the encoder signal processing unit E2019.

Also, at the time of printing, it reads out the developed recording data (RDHD) E2048 form the column buffer in accordance with the head driving timing signals E2049, and outputs the data to the recording head cartridge H1000 with the head control signals E1021.

Also, in the scanner reading mode, the DMA transfer is executed to transfer the fetched data (WDHD) E2053, which is inputted through the head control signals E1021, to the scanner fetching buffer E2024 on the DRAM E2005. A reference numeral E2025 designates the scanner data processing DMA, which reads out the fetched buffer reading data (RDAV) E2054 accumulated on the scanner fetching buffer E2024 by the control of the CPU E1001 through the CPU I/F E2001, and then, writes the processed data (WDAV) E2055, which are processed by averaging or the like, to the scanner data buffer E2026 on the DRAM E2005.

A reference numeral E2027 designates the scanner data compression DMA, which reads out the processed data (RDYC) E2056 on the scanner data buffer E2026 by the control of the CPU E1001 through the CPU I/F E2001 to compress data, and then, writes and transfers the compressed data (WDYC) E2057 to the send-out buffer E2028.

A reference numeral E2019 designates the encoder signal processing unit, which receives the encoder signals.(ENC) and outputs the head driving timing signals E2049 in accordance with the mode specified by the control of the CPU E1001. Besides, it stores on the resister the information regarding the position and speed of the carriage M4001 obtainable by the encoder signals E1020, which are provided for the CPU E1001. On the basis of the information thus provided, the CPU E1001 determines various parameters to control the CR motor E0001. Also, a reference numeral E2020 designates the CR motor control unit, which outputs the CR motor control signals E1036 by the control of the CPU E1001 through the CPU I/F E2001.

A reference numeral E2022 designates the sensor signal processing unit, which receives various detection signals output from the PG sensor E0010, the PE sensor E0007, the ASF sensor E0009, and the GAP sensor E0008, among some others, and then, transfers these pieces of sensor information to the CPU E1001 in accordance with the mode specified by the control of the CPU E1001. Besides, it outputs the sensor detection signal E2052 to the LF/PG motor control unit DMA E2021.

The LF/PG motor control DMA E2021 reads out the pulse motor driving table (RDPM) E2051 from the motor control buffer E2023 on the DRAM E2005 by the control of the CPU E1001 through the CPU I/F E2001, and outputs the pulse motor control signals E. Besides, it outputs the pulse motor control signals E1033 as trigger to control the sensor detection signals depending on the operational mode.

Also, a reference numeral E2030 designates the LED control unit, which outputs the LED driving signals E1038 by the control of the CPU E1001 through the CPU I/F E2001; further, E2029, the port control unit, which outputs the head power source ON signals E1022, the motor power source ON signal E1023, and the power source control signals E1024 by the control of the CPU E1001 through the CPU I/F E2001.

Figure 10:
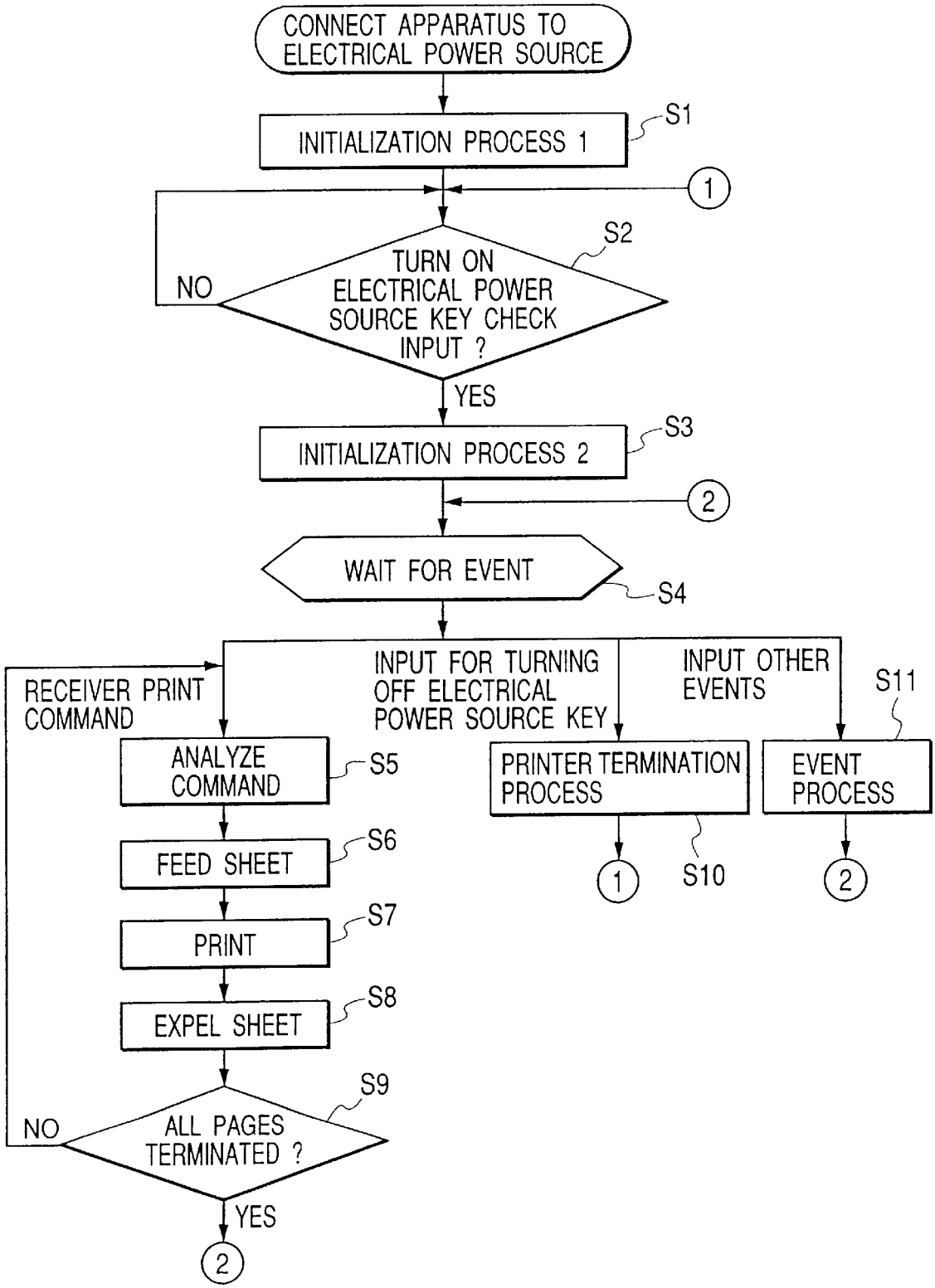
FIG. 10 is a flowchart which shows the operation of the embodiment of the present invention.

Now, in accordance with the flowchart shown in FIG. 10, the description will be made of the operation of an ink jet recording apparatus structured as described above, which embodies the present embodiment.

When the apparatus is connected with an AC power source, a first initialization process is executed for the apparatus, at first, in step S1. In the initiation process, the electric circuit system is examined to check the ROM, RAM, and the like for the apparatus, thus confirming whether or not the apparatus is normally operable electrically.

Then, in step S2, whether or not the power source key E0018, which is installed on the upper case M1002 of the apparatus main body M1000, has been turned ON.

If the power source key E0018 is turned on, the process proceeds to step S3 where a second initialization process is executed.

In the second initialization process, various driving mechanisms and head system of the apparatus are examined. In other words, it is confirmed whether or not the apparatus is normally operable when various motors are initialized and the head information is read out.

Then, in step S4, the process waits for the occurrence of an event. In other words, while monitoring the instruction event that may be given from the external I/F for the apparatus, as well as the panel key event given by the user's operation and the inner control events, the process proceeds to execute the corresponding step;when any one of such events occurs.

For example, if a printing instruction event is received from the external I/F in the step S4, the process proceeds to step S5. If a power source key event occurs in the step S4 by the user's operation, the process proceeds to step S10. If any other events should occur in the step S4, the process proceeds to step S11.

Here, in the step S5, the printing instruction from the external I/F is analyzed to determine the designated kinds of paper, size of the paper sheet, print quality, feeding method, and some others. Then, the data that carries the results of such determination are stored on RAM E2005 in the apparatus main body, and the process proceeds to step S6.

Then, in the step S6, the paper feed is initiated by the paper feeding method designated in the step S5, and the paper sheet is carried to the record starting position. Thus, the process proceeds to step S7.

In the step S7, recording is performed. In this recording operation, the recording data transferred through the external I/F are provisionally stored on the recording buffer. Then, the CR motor E0001 is driven to initiate moving the carriage M4001 in the scanning direction, and at the same time, the recording data stored on the printing buffer E2014 are supplied to the recording head H1001 for one-line recording. When the recording data of the one-line portion are recorded completely, the LF motor E0002 is driven to rotate the LF roller M3001, thus carrying the paper sheet in the sub-scanning direction. After that, the aforesaid operations are repeatedly executed until the recording data of one-page portion from the external I/F are completely recorded, and then, the process proceeds to step S8. In the step S8, the LF motor E0002 is driven to drive the sheet exhaust roller M2003 to repeat paper feed until it is ascertained that the paper sheet has been sent out of the apparatus completely. When this is completed, the paper sheet has been exhausted completely onto the exhaust tray M1004*a*.

Then, in step S9 it is ascertained whether or not the recording operation is completed for all the pages to be recorded. If negative, the precess returns to the step S5. Then, the operations in the step S5 to the step S9 are repeated. When the recording operation on all the pages to be recorded is completed, it terminates, and the process proceeds to step S4 where it waits for the next event.

In the meantime, in step S10, the printer finish process is carried out, and the operation of the apparatus is suspended. In other words, the power source shifts to the state where it can be turned off. Then, after having turned off the power source, the step proceeds to step S4 where it waits for the next event.

Also, in step S11, processing is executed for events other than those described above. For example, a process is executed for a recovery instruction from various panel keys of the apparatus or from the external I/F or for a recovery event occurring inside the apparatus, among some others. In this respect, after the completion of such processing, the process proceeds to the step S4 where it waits for the next event.

Figure 52:
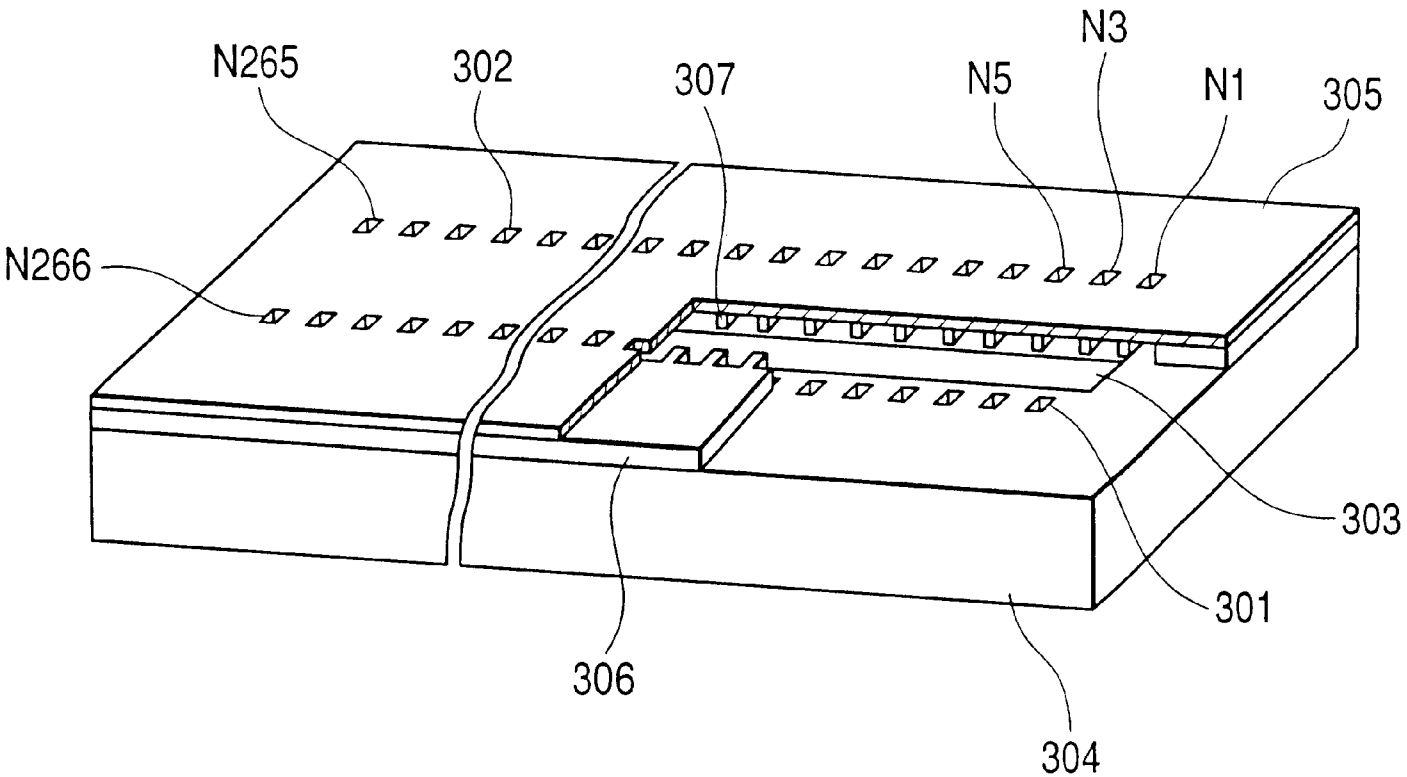
FIG. 52 is a partially broken perspective view which schematically shows a liquid discharge head in accordance with the present invention.

FIG. 52 is a partially broken perspective view which schematically shows a liquid discharge head in accordance with the present invention. The ink jet recording head has a long groove type ink supply port 303 formed on the central part thereof, and provided with base plate 304 having the electrothermal transducing elements 301 which serve as discharge energy generating means formed on both sides of the ink supply port 303 in the longitudinal direction; a covering resin layer formed on the base plate 304 to structure the flow path walls 307; and a discharge port plate 305 formed on the covering resin layer 306 with discharge ports 302 being holed on the covering resin layer 306. As the material of the base plate 304, it is possible use glass, ceramic, plastic, or metal, among some others. For the present embodiment, Si base plate (wafer) is used. On the base plate 304, 133 electrothermal transducing elements are arranged zigzag at pitches of 300 DPI (Dot Per Inch) on one side, that is, it comes to 266 elements in total on both sides. The ink flow path walls 307 and the discharge ports 302 are formed at the same pitches corresponding to the electrothermal transducing elements 301. Thus, nozzles 308 are formed. In accordance with the present embodiment, the covering resin layer 306 and the discharge port plate 305 are represented as separate members. However, it may be possible to from the covering resin layer 306 having the ink flow path walls 307 formed thereon and the discharge port plate 305 with one and the same material by forming the covering resin layer 306 on the base plate 304 by use of spin coating or the like.

Now, further, the detailed description will be made of the specific structure of the recording head H1001 described above as the liquid discharge head of the present invention.

Figure 11:
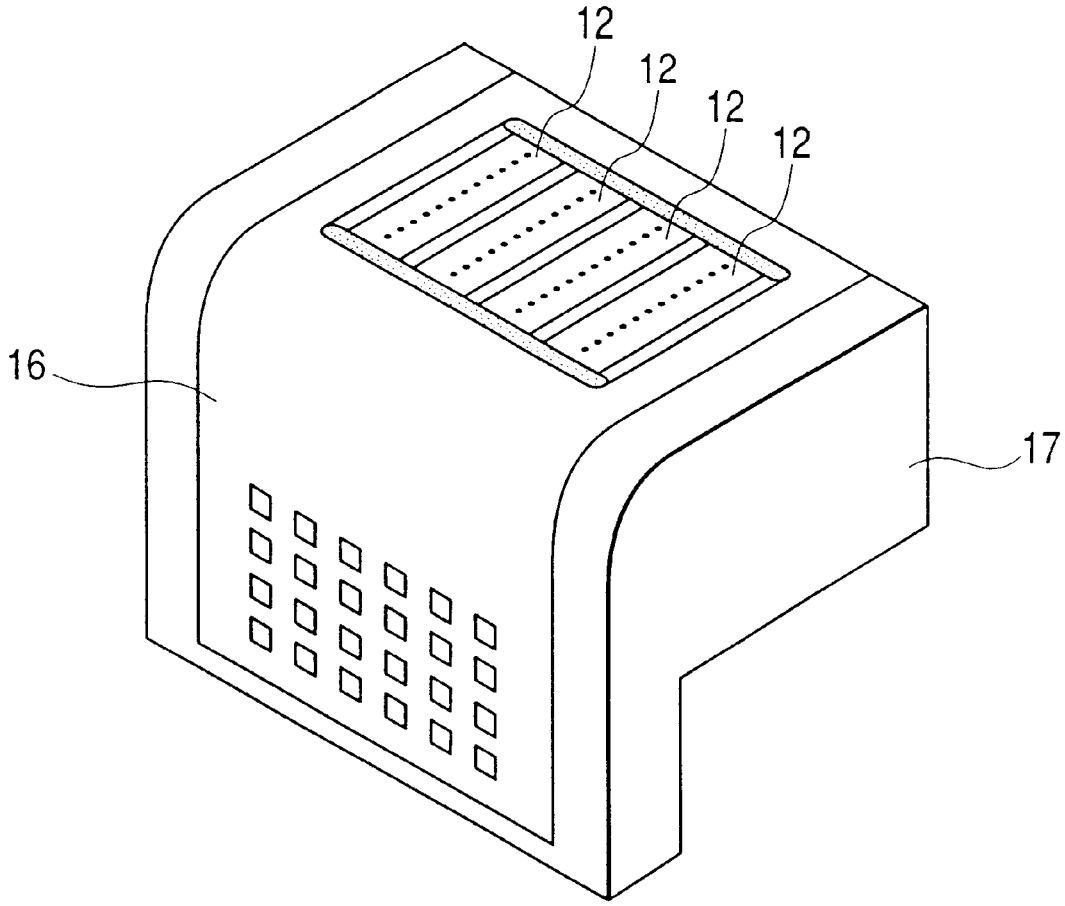
FIG. 11 is a perspective view which shows the outer appearance of one embodiment of a liquid discharge head in accordance with the present invention.
Figure 12:
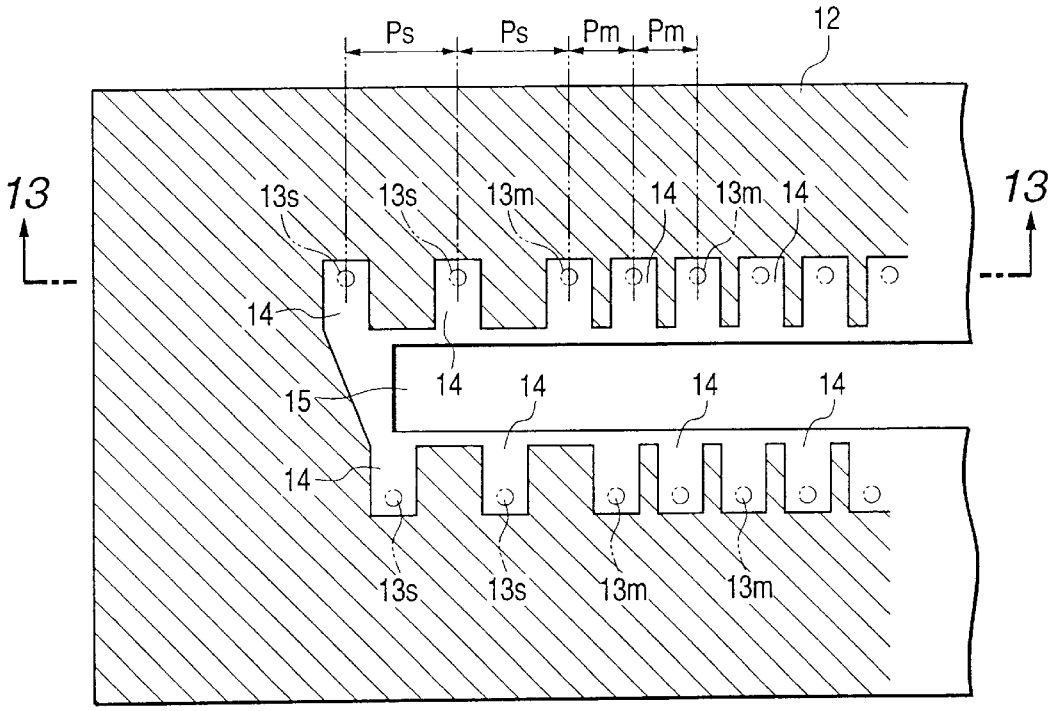
FIG. 12 is a cross-sectional view which shows the inner structure of the embodiment represented in FIG. 11.
Figure 13:
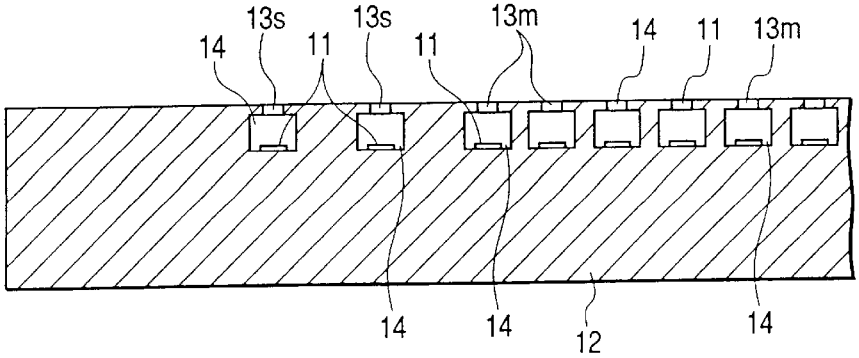
FIG. 13 is a cross-sectional view taken along line 13—13 in FIG. 12.

FIG. 11 is a view which shows the outer appearance of the recording head H1001 embodying the present invention. FIG. 12 shows schematically the structure thereof represented in a state of being broken. FIG. 13 is a cross-sectional view taken along line XII—XII in FIG. 12. In other words, a reference numeral 12 designates the recording element base plate H1100 where the aforesaid electrothermal transducing elements 11 serving as the recording elements are arranged in plural numbers; 13*m*, main discharge ports for discharging ink droplets at the time of printing operation; and 13*s*, the sub-discharge ports which do not discharge ink droplets at the time of printing operation. These two kinds of discharge ports 13*m* and 13*s* correspond to the discharge ports H1100T described above. A reference numeral 14 designates a plurality of ink chambers to supply ink to these two kinds of discharge ports 13*m* and 13*s*; 15, a common ink chamber communicated with each of the ink chambers 14, which is open to the heat generating base plate 12 where ink is supplied, and which serves as the long and narrow common ink chamber of the present invention, and corresponds to the ink supply port H1201 described above; also, 16, the wiring base plate where signal lines are arranged to give printing signals to the heat generating base plate 12, which corresponds to the electric wiring base plate H1300 described above.

For the heat generating base plate 12, the heat generating resistive layer, wiring, and others are patterned on Si wafer by means of photolithographic technique, and the ink chamber 14, and the discharge ports 13*m* and 13*s* are formed with photosensitive resin. Then, after the common ink chamber 15 is formed by means of anisotropic etching or the like, the Si wafer is cut to form each heat generating base plate. To the heat generating base plate 12, the wiring base plate 16 is connected by means of assembling technique for transmission and reception of electric signals to drive the electrothermal transducing elements 11. Further, the heat generating base plate 12 is fixed onto the supporting member 17 which serves as the first plate H1200.

For the present embodiment, two lines of discharge ports 13*m* and 13*s* are arranged zigzag in parallel having a difference of half pitch to each other with the common ink chamber 15 between them. Then, two sub-discharge ports 13*s* are arranged on both end sides of one main discharge port 13*m* line in the arrangement direction, respectively. Then, the ink chamber 14 are arranged at pitches Pm of 600 dpi corresponding to the main discharge ports 13*m* which are used for actual printing operation. On the outer side thereof, the ink chambers 14 are arranged at pitches Ps of 300 dpi corresponding to the sub-discharge ports 13*s* which are not used for the printing operation.

For each of the ink chamber 14, an electrothermal transducing element 11 is provided to discharge ink from each of the discharge ports 13*m* and 13*s*. However, as described above, no ink droplet is discharged from the sub-discharge port 13*s* at the time of actual printing. Only for the pre-discharge operation or the like, which is executed prior to the actual printing, ink droplets are discharged from the sub-discharge ports 13*s* by driving the electrothermal transducing elements 11 accordingly. In this case, it is preferable to perform the pre-discharges from the sub-discharge ports 13*s* in condition which makes it easier for them to discharge than the condition in which the pre-discharges are performed from the main discharge ports 13*m*.

When suction recoveries are performed for the discharge ports 13*m* and 13*s* for recovering defective discharges or the like, and also, for ink filling to the ink chambers 14, ink suction is performed even from the ink chambers 14 where the sub-discharge ports 13*s* are open. As a result, bubbles that exist on both end portions of the common ink chamber 15 in the longitudinal direction can be exhausted in a better condition, that is, bubble removable becomes executable in a better condition. Also, even if ink of different color should enter the ink chambers 14 where the sub-discharge ports 13*s* are open, it becomes possible to exhaust ink of mixed colors from the sub-discharge ports 13*s* by executing the pre-discharge operation after the suction recovery process so as to discharge ink droplets from the sub-discharge ports 13*s*, too. In this way, it is possible to prevent ink from being mixed in the recording head H1001.

Here, also, for the present embodiment, the arrangement pitches Pm for the ink chambers 14 which are used for the actual printing are set at 600 dpi, while the arrangement pitches Ps of the ink chambers 14 to which the sub-discharge ports 13*s* are open are set at a rougher pitch Ps of 300 dpi (or may be set at 150 dpi). As a result, the ink chambers 14 can be arranged with a comparatively small number of sub-discharge ports 13*s* in a wider area from the outermost end of the main discharge ports 13*m* in the arrangement direction, which are used for the actual printing operation, thus making it possible to reduce mixing colors for ink, and at the same time, to reduce the number of electrothermal transducing elements 11, which contributes to providing the heat at lower costs significantly.

For the embodiment described above, the arrangement pitches Ps of the ink chambers 14 having the sub-discharge ports 13*s* are set at a value which is two times the arrangement pitches Pm for the main discharge ports 13*m* used for the actual printing operation. However, it may be possible to increase it to 5 times. In this case, a number of integral times should be preferable. Also, it may be possible to arrange the dummy ink chambers 14*d* with no discharge ports alternately with the ink chambers 14 having the sub-discharge ports 13*s*.

Figure 14:
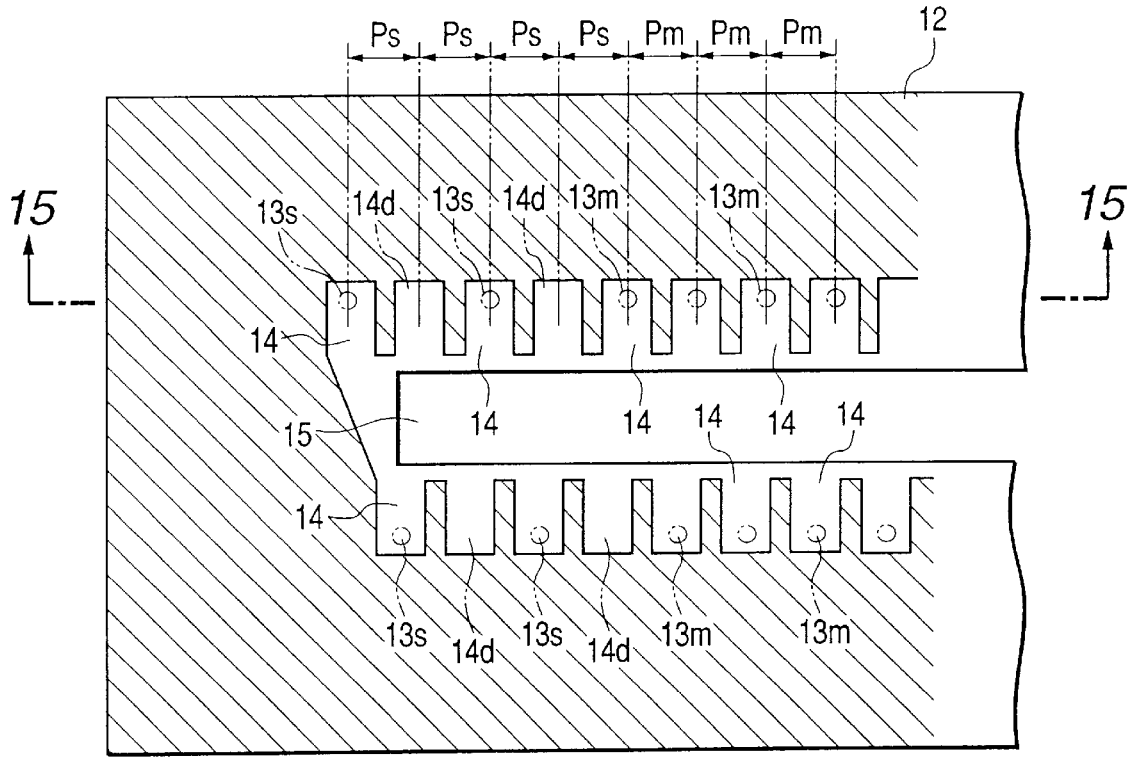
FIG. 14 is a cross-sectional view which shows the inner structure of a liquid discharge head in accordance with another embodiment of the present invention.
Figure 15:
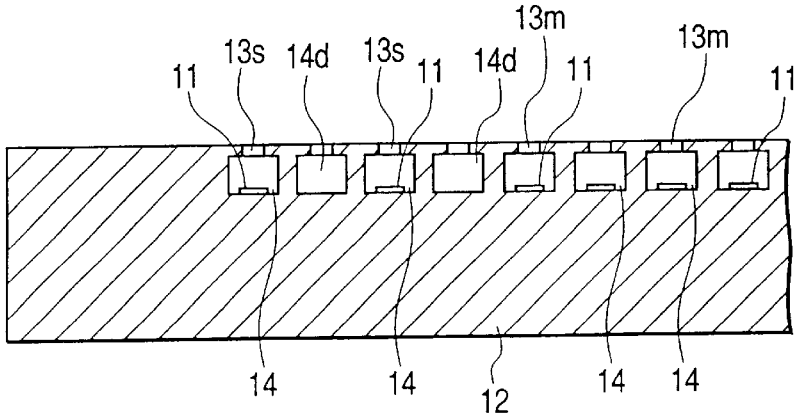
FIG. 15 is a cross-sectional view taken along line 15—15 in FIG. 14.

FIG. 14 is a view which schematically shows the structure of the liquid jet head in accordance with another embodiment of the present invention described above. FIG. 15 shows the structure thereof taken in line 15—15 in FIG. 14. The same reference marks are applied to the same members having the same functions as those shown in the previous embodiment, and the repeated description thereof will be omitted. In other words, for the present embodiment, the dummy ink chambers 14*d* having no discharge ports and the ink chambers 14 having sub-discharge ports 13*s* are arranged alternately per two chambers per line at the same pitches Pm of the ink chambers 14 where the main discharge ports 14*m* are open.

In this manner, the arrangement pitches Ps of the dummy ink chambers 14*d* and the ink chambers 14 having sub-discharge ports 13*s* are made equal to the arrangement pitches Pm of the ink chambers 14 having main discharge ports 13*m* used for the actual printing operation. Then, it becomes possible to improve more the uniformity of ink-chambers 14 when used for the actual printing operation. Particularly, it becomes possible to enhance the uniformity of the ink chambers 14 having main discharge ports 13*m* adjacent to the dummy ink chambers 14*d*, respectively.

In this respect, for the present embodiment, the description has been made of the alternate arrangements of the dummy ink chambers 14*d* and the ink chambers 14 having sub-discharge ports 13*s*. However, the ratio of the dummy ink chambers 14*d* may be increased so that each of the ink chambers 14 having sub-discharge ports 13*s* is arranged per every two or three other dummy chambers 14*d*. In this case, it becomes possible to further suppress the amount of ink to be sucked from the sub-discharge ports 13*s* when a recovery process is executed by means of suction operation.

For the embodiment described above, it has been described that the arrangement pitches Ps of the dummy ink chambers 14*d* and the ink chambers 14 having sub-discharge ports 13*s* is made equal to the arrangement pitches Pm of the ink chambers 14 having main discharge ports 13*m* used for the actual printing operation. However, the former can be made two times or more.

Figure 16:
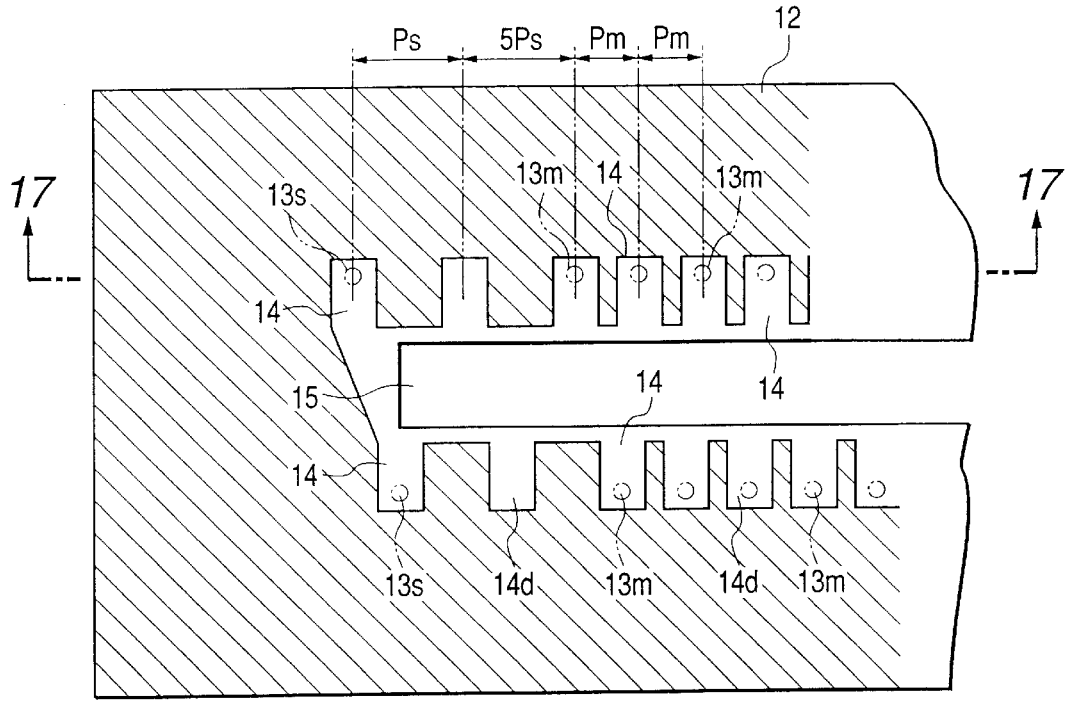
FIG. 16 is a cross-sectional view which shows the inner structure of a liquid discharge head in accordance with still another embodiment of the present invention.
Figure 17:
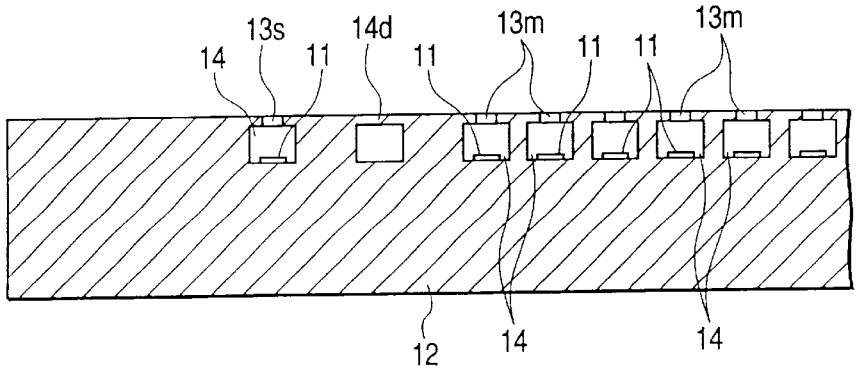
FIG. 17 is a cross-sectional view taken along line 17—17 in FIG. 16.

FIG. 16 is a view which schematically shows the structure of the liquid jet head in accordance with still another embodiment of the present invention described above. FIG. 17 shows the structure thereof taken in line 17—17 in FIG. 16. The same reference marks are applied to the same members having the same functions as those shown in the previous embodiment, and the repeated description thereof will be omitted. In other words, for the present embodiment, the dummy ink chambers 14*d* having no discharge ports and the ink chambers 14 having sub-discharge ports 13*s* are arranged per chamber per line at the pitches Ps which are two times the pitches Pm of the ink chambers 14 where the main discharge ports 13*m* are open.

As described above, with only one sub-discharge port 13*s* formed on the outermost side of the dummy ink chamber 14*d*, it becomes possible to make the velocity of ink flow higher when exhausted from the sub-discharge port 13*s*, and produce a high effect on the exhaust of bubbles residing in the common ink chamber 15 on the end portion in the longitudinal direction. Also, the number of sub-discharge ports 13*s* is minimized in the arrangement direction of the main discharge ports 13*m*. As a result, it becomes possible to suppress ink mixture to the minimum in the recording head H1001.

For the embodiment described above, the dimension and shape of the sub-discharge port 13*s* are made the same as those of the main discharge port 13*m*. However, it may be possible to change them appropriately.

Figure 18:
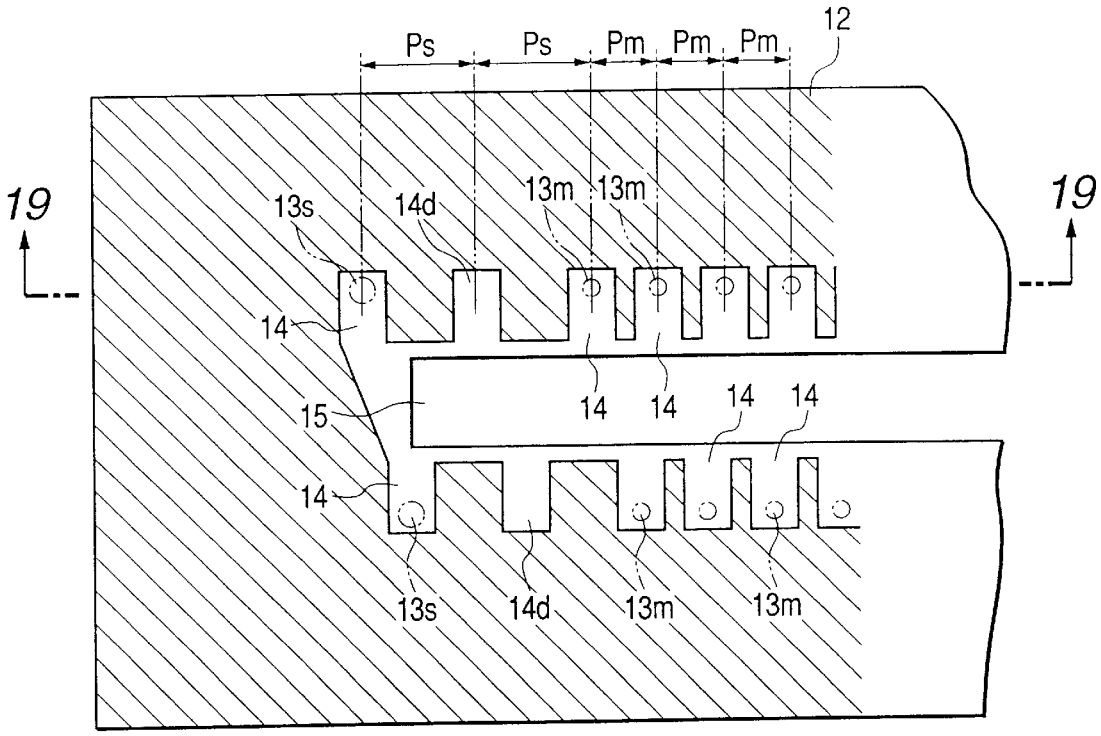
FIG. 18 is a cross-sectional view which shows the inner structure of a liquid discharge head in accordance with still another embodiment of the present invention.
Figure 19:
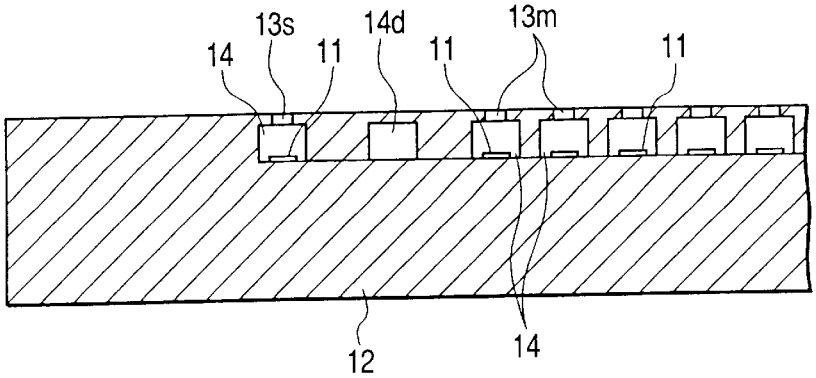
FIG. 19 is a cross-sectional view taken along line 19—19 in FIG. 18.

FIG. 18 is a view which schematically shows the structure of the liquid jet head in accordance with still another embodiment of the present invention described above. FIG. 19 shows the structure thereof taken in line 19—19 in FIG. 18. The same reference marks are applied to the same members having the same functions as those shown in the previous embodiment, and the repeated description thereof will be omitted. In other words, for the present embodiment, the dimension and shape of the sub-discharge port 13*s* shown in FIG. 16 is made larger than those of the main discharge port 13*m*.

In the case of a highly precise recording head H1001 such as having 1,200 dpi as in the present embodiment, the opening area of the main discharge port 13*m*, through which ink droplets are discharged at the time of actual printing, becomes considerably smaller (for example, the diameter is 16 $\mu$m or less). Then, there is a disadvantage as to the removability of bubbles at the time of suction recovery or the like. Now, therefore, with the sub-discharge port 13*s* whose diameter is made to be 20 to 30 $\mu$m, for example, it becomes possible to enhance the removability of bubbles from each of the sub-discharge ports 13*s*. The opening area of each sub-discharge port 13*s* is determined at an optimal value in accordance with the area of each main discharge port 13*m*, the number of arrangement thereof, and the bubble exhaust capability at the time of suction recovery, as well as the meniscus maintenance thereof, among some others.

Figure 20:
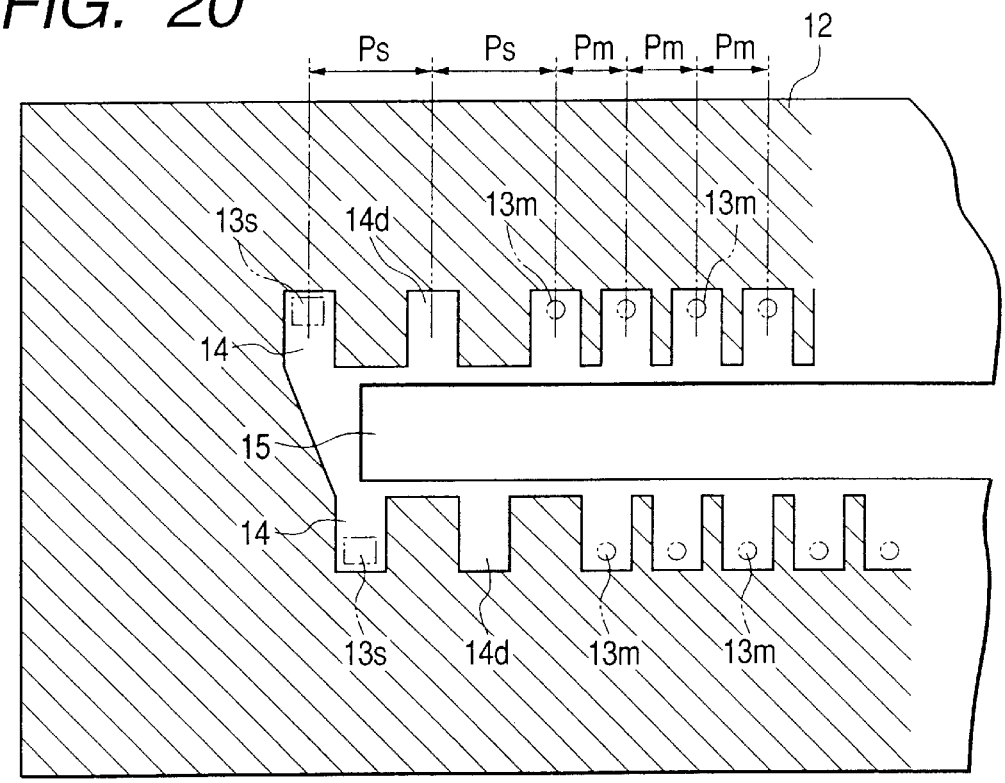
FIG. 20 is a cross-sectional view which shows the inner structure of a liquid discharge head in accordance with still another embodiment of the present invention.
Figure 21:
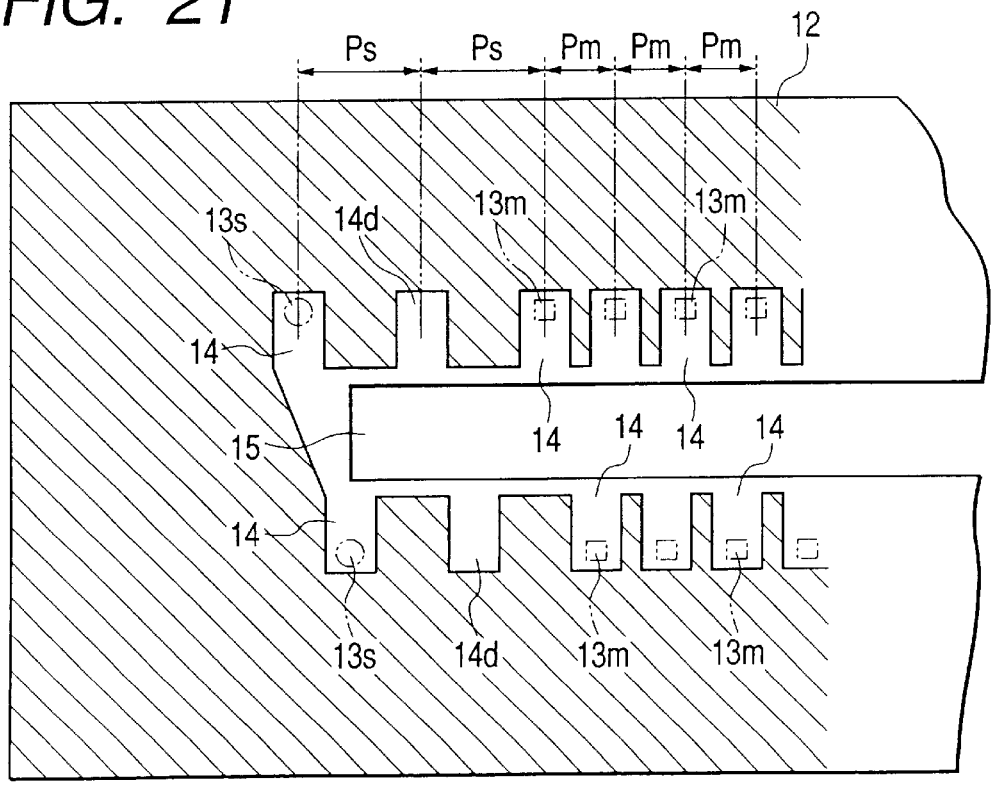
FIG. 21 is a cross sectional view which shows the inner structure of a liquid discharge head in accordance with still another embodiment of the present invention.

Also, the shape of the main discharge port 13*m* and that of the sub-discharge port 13*s* may be rectangular as shown in FIG. 20 and FIG. 21, besides being circular as described above or either one of them may be circular. In either case, there is no need for the shapes of the main discharge port 13*m* and sub-discharge port 13*s* being made analogous. It is desirable to decide on the optimal shape in consideration of the stability with which the sub-discharge ports 13*s* are formed, the capability of bubble exhaustion, or the like when the aforesaid opening area is determined. In FIG. 20 and FIG. 21, the same reference marks are applied to the members having the same functions as those appearing in the previous embodiment.

Figure 53:
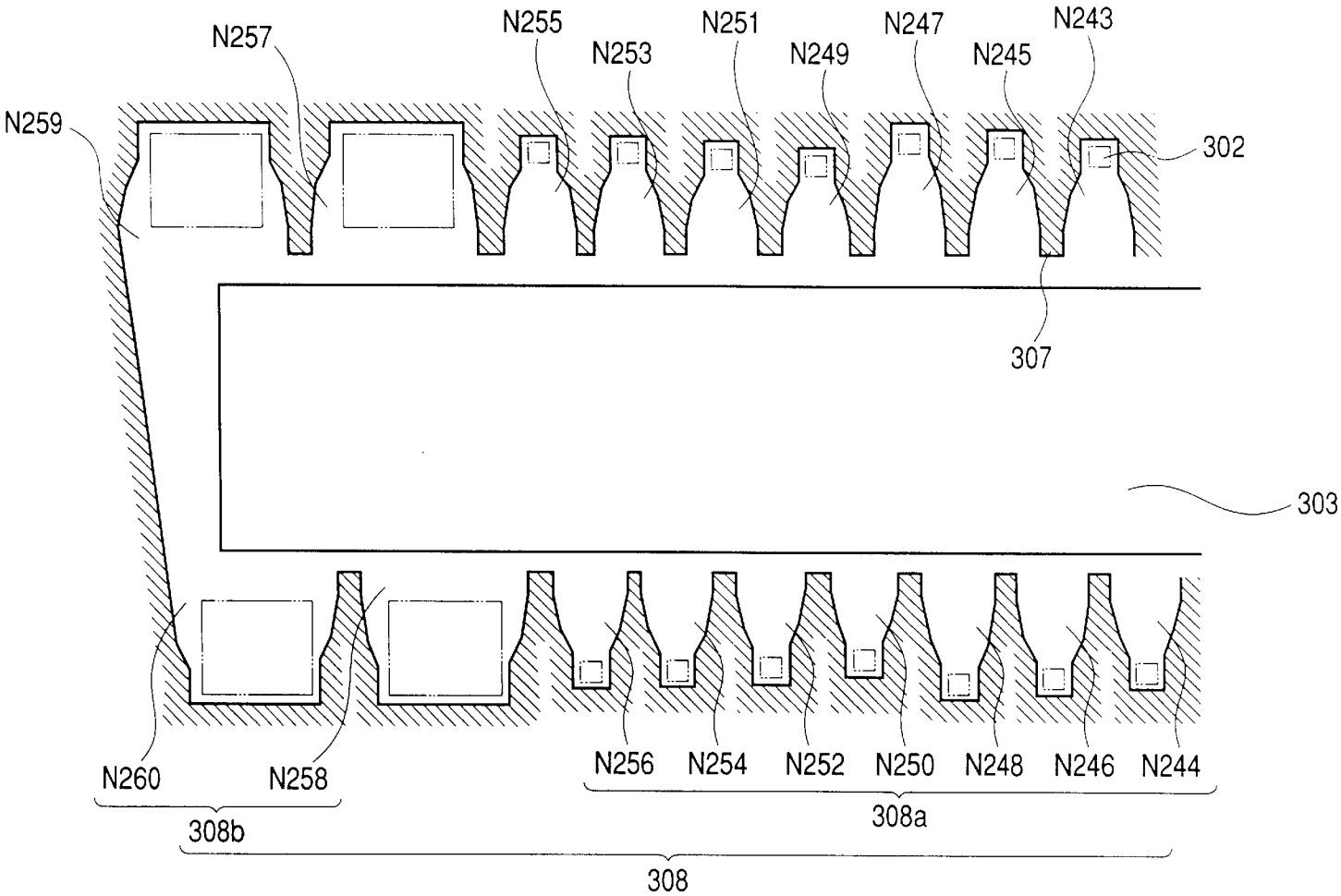
FIG. 53 is a plan sectional view which shows an ink jet head in accordance with still another embodiment of the present invention.

FIG. 53 is a plane sectional view which shows an ink jet head in accordance with still another embodiment of the present invention. For the ink jet recording head of the present embodiment, the arrangement pitches of the cleaning nozzles 308*b* are different from the arrangement pitches of the printing nozzles 308*a*. In other words, whereas the printing nozzles 308*a* are formed at a pitches of 300 DPI, the cleaning nozzles 308*b* are formed at a pitches of 150 DPI. The way in which the nozzle numbers are applied is: 128 nozzles on one side with ink discharge ports 303 whose nozzle numbers are 1 to 256 for the printing nozzles 308*a*, and 256 nozzles in total on both sides; and two nozzles on side with nozzles numbers being 257 to 260 for the cleaning nozzles 308*b*, and four nozzles in total on both sides. For the present embodiment, the arrangement pitches of the cleaning nozzles 308*b* is longer than the arrangement pitches of the printing nozzles 308*a*, while the nozzle width of the cleaning nozzle 308*b* is larger than the nozzle width of the printing nozzle 308*a*. Also, the discharge port 302 of the cleaning nozzle 308*b* is larger than the discharge 302 of the printing nozzle 308*a*.

Figure 22:
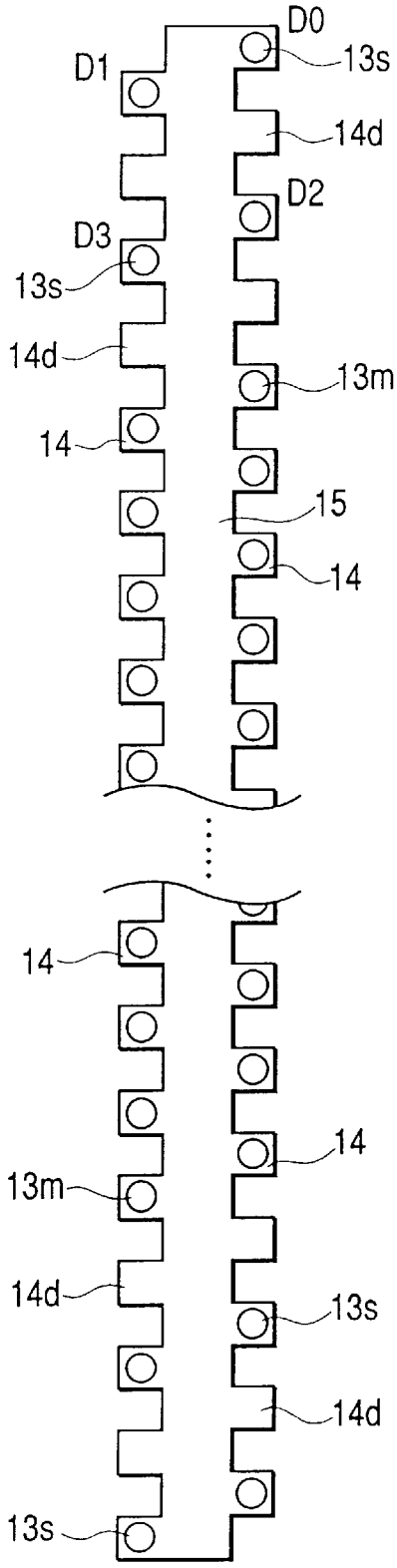
FIG. 22 is a cross-sectional view which shows the broken state of the discharge port arrangement for a liquid discharge head in accordance with the present invention.

Further, another embodiment of the present invention will be described as follows. FIG. 22 is a view which shows the arrangement condition of the discharge ports 13*m* and13*s* of a recording head H1001 in accordance with the present embodiment. The main discharge ports 13*m* that discharge different kinds of ink (for the present embodiment, 6 kinds) are arranged in such a manner that 128 pieces each on one side at pitches of 600 dpi with a common ink chamber 15 between them in a state of being displaced by half pitch each in the arrangement direction. Ink is supplied from the common ink chamber 15. In other words, 256 main discharge ports 13*m* are arranged in total per color, and on both end in the arrangement direction, four sub-discharge ports 13*s* are arranged at pitches of 300 dpi, respectively.

Figure 23:
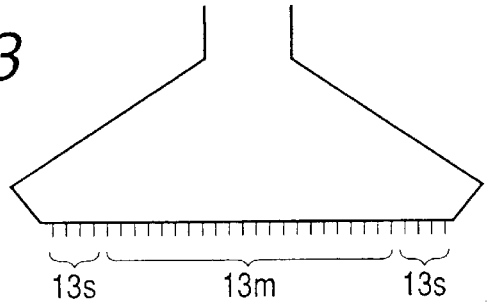
FIG. 23 is a cross-sectional view which shows schematically the structure of the common ink chamber of a liquid discharge head in accordance with the present invention.
Figure 24:
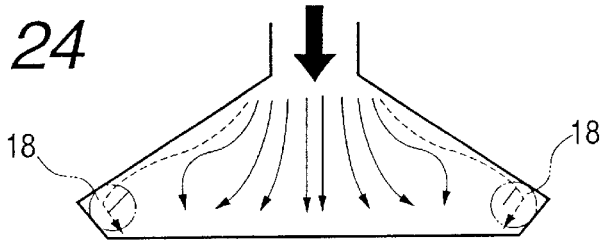
FIG. 24 is a cross-sectional view which shows schematically the state of ink flow that flows in the common ink chamber represented in FIG. 23.

FIG. 23 is a view which shows the sectional structure of the common ink chamber 15 in accordance with the present embodiment. FIG. 24 is a view which schematically shows the flowing condition of ink to be supplied here. In other words, it is not easy for ink to flow on both end portions of the common liquid chamber 15 in the longitudinal direction, which tends to be stagnated. Then, bubbles which reside here are not easily exhausted outside the recording head H1001. The sub-discharge ports 13*s* are provided in order to enhance the removability of bubbles from the both end portions 18 of the common ink chamber 15 in the longitudinal direction (hereinafter referred to as the "stagnating portion") when a suction recovery process is executed. More specifically, it is intended to enhance the bubble removability from the stagnating portion 18 at the time of suction recovery by forming the sub-discharge ports 13*s* near the stagnating portions 18.

For the present embodiment, the opening area of the main discharge port 13*m* is approximately 200 $\mu m^2$, and the opening area of the sub-discharge port 13*s* is approximately 300 $\mu m^2$. The larger the opening area of the sub-discharge port 13*s*, the smaller becomes the flow resistance when a suction recovery is performed. It is, therefore, preferable to make the opening area larger for the sub-disc harge port 13*s*.

For the present embodiment, the suction recovery process is executed bygone cap (not shown) for six colors at a time. As a result, ink of all the colors is mixed in the interior of the cap. For that matter, there is a fear that mixed-color ink in the interior of the cap adheres to the discharge port surface of the recording head H1001, and after the suction operation is suspended, the mixed-color ink in the interior of the cap is sucked by negative pressure exerted in the ink tank H1900 into the recording head H1001 through the discharge ports 13*m* and 13*s*. If printing is executed in this state, ink whose color is different from the one originally intended is discharged, which eventually degrades the printing quality to a considerable extent.

In order to prevent such drawback, there is a need for the execution of pre-discharges so that mixed-color ink, which has been sucked into the recording head H1001 after the suction recovery process, should be exhausted from the discharge ports 13*m* and 13*s*.

As to the recovery of the recording head H1001 by the execution of the pre-discharges, there are two characteristic cases which should be taken into consideration, namely, the case where an intense color mixture takes place in a part of discharge ports, but it can be recovered soon, and the other case where the mixed-color ink remains for a longer period of time.

Figure 25:
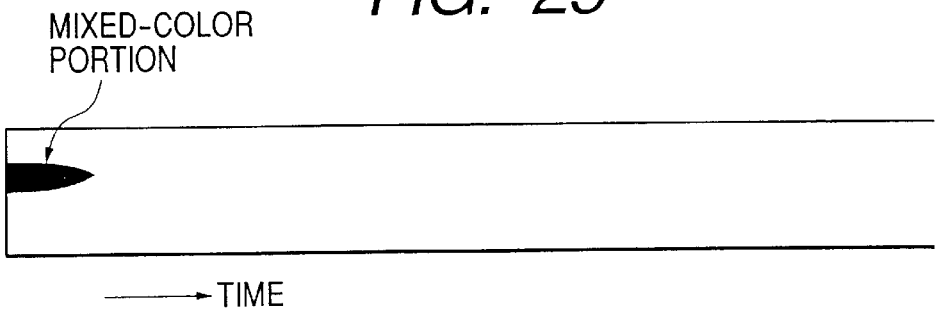
FIG. 25 is a conceptual view which shows one example of discharging,condition of ink of mixed colors.
Figure 26:
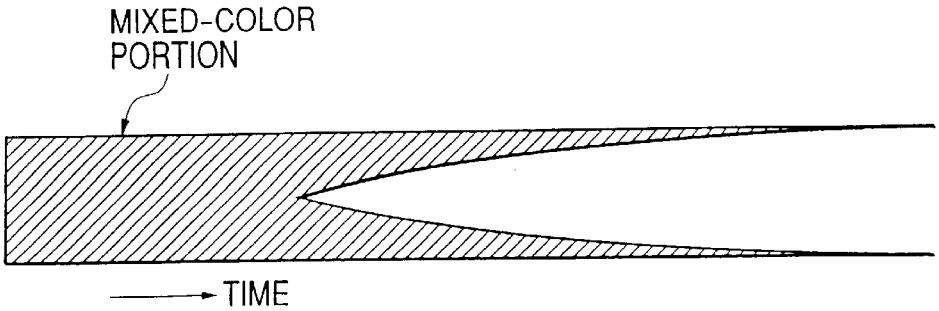
FIG. 26 is a conceptual view which shows another example of discharging condition of ink of mixed colors.

FIG. 25 and FIG. 26 are views which schematically illustrate these two characteristic cases. The case shown in FIG. 25 is such that the mixed-color ink which has been sucked into the common ink chamber 15 due to a suction recovery process is given a pre-discharge process immediately. The mixed-color ink is exhausted before it is dispersed in the common ink chamber 15. Therefore, from a part of discharge ports 13*m* in the arrangement direction of the discharge ports 13*m*, the mixed-color ink is discharged for a specific period. The degree of the color mixture in this mixed-color portion is intense (darker), but with a lesser frequency of pre-discharges, this mixed-color ink can be removed. FIG. 26 shows a case of the passage of several seconds or more since the mixed-color ink has been mixed with ink in the common ink chamber 15, and the subsequent execution;of pre-discharges. Here, the predischarge s are executed after the mixed-color ink has been dispersed in the common ink chamber 15. As a result, the degree of color mixture in the mixed-color portion is less intensive (lighter), but the mixed-color ink is discharged for a longer period of time from the discharge ports 13*m* almost over the entire area in the arrangement direction of the discharge ports 13*m*. If the re-discharge process is continued, the velocity of ink flow becomes relatively faster in the central portion of the common ink chamber 15 in the arrangement direction of the discharge ports 13*m*, and the recovery is completed earlier than on the both end portions in the arrangement direction of the discharge ports 13*m*. However, in the case as shown in FIG. 26, the frequency of pre-discharges should be set extremely high after all.

Figure 27:
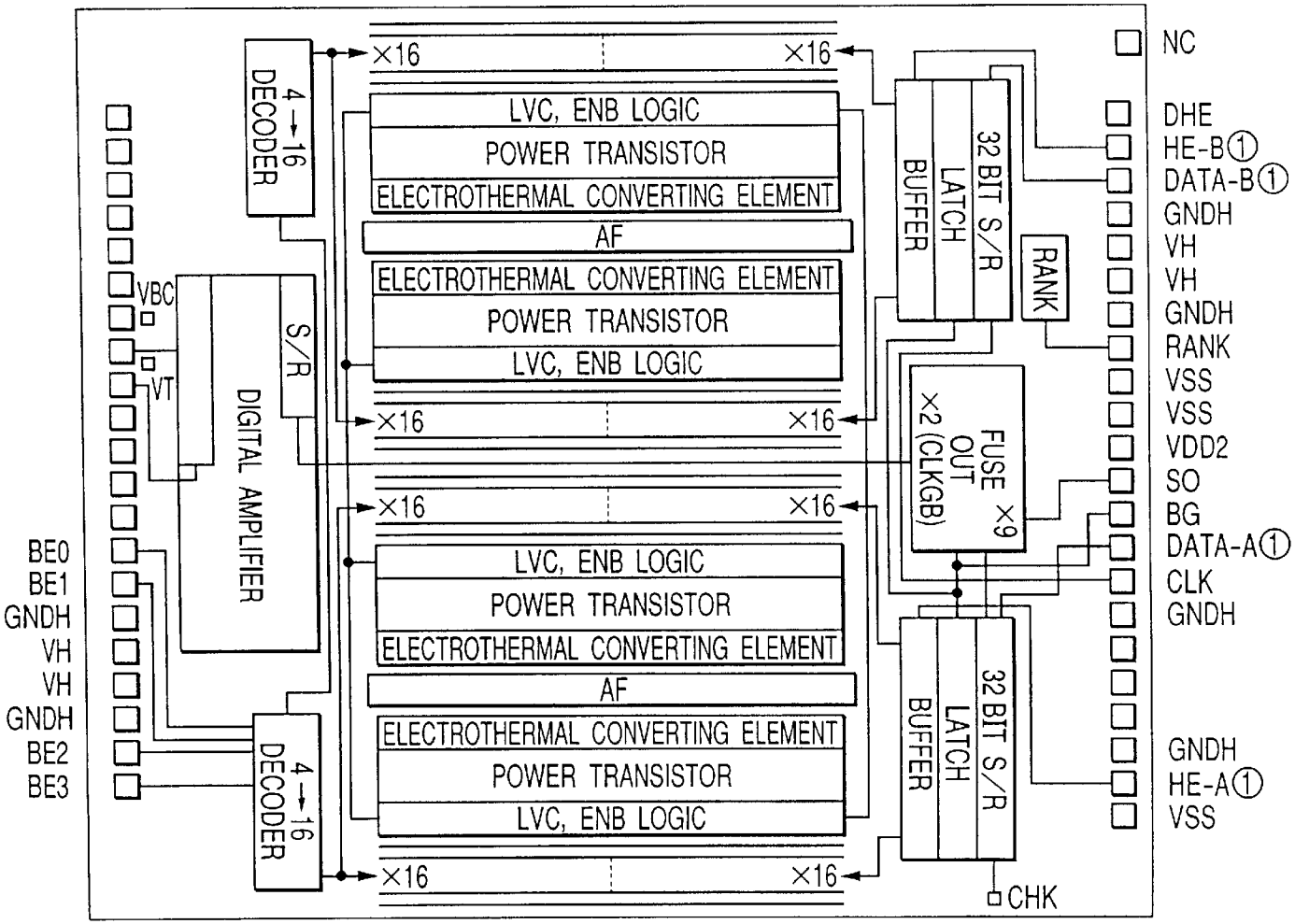
FIG. 27 is a block diagram which shows the electrical structure of one heat generating base plate of a liquid discharge head in accordance with the present invention.
Figure 28:
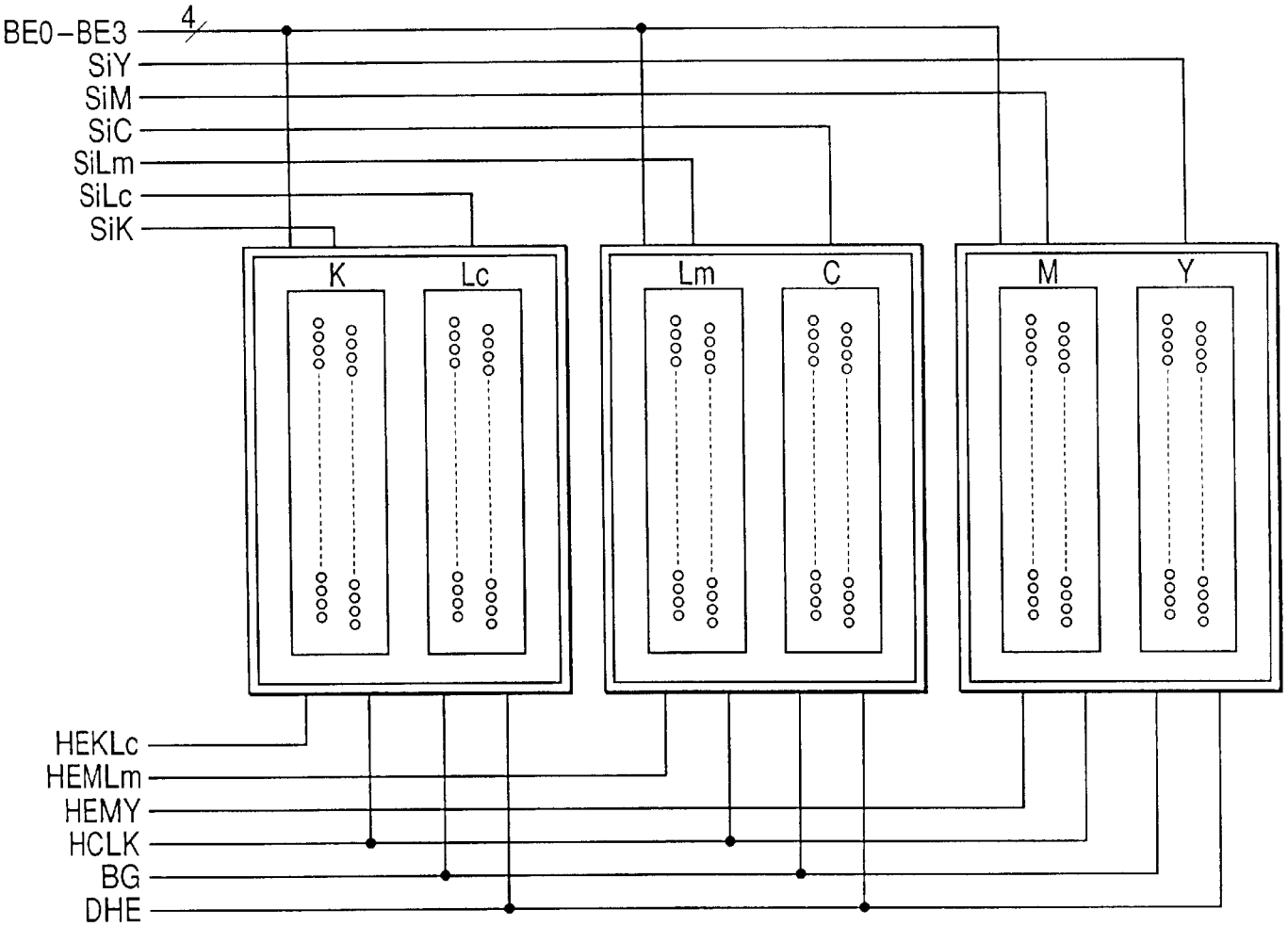
FIG. 28 is a diagram which shows signal lines for the electrothermal transducing elements of the sub-discharge ports of a liquid discharge head in accordance with the present invention.

FIG. 27 is a view which shows the electrical structure of one heat generating base plate 12. FIG. 28 is a view which shows the electrical structure on the portion of a recording head H1001. In other words, for the present embodiment, three heat generating base plates 12 are fixed to a supporting member 17, and a first heat generating base plate 12 is provided with two ink jet heads incorporated thereon to discharge black color ink (hereinafter represented by a letter K in some cases), and light cyan color ink (hereinafter represented by letters Lc in some cases), respectively. A second heat base plate 12 is provided with two ink jet heads incorporated thereon to discharge light magenta color ink (hereinafter represented by a letter Lm in some cases), and cyan color ink (hereinafter represented by letters C in some cases), respectively. A third heat base plate 12 is provided with two ink jet heads incorporated thereon to discharge magenta color ink (hereinafter represented by a letter M in some cases), and yellow color ink (hereinafter represented by letters Y in some cases), respectively.

Here, conceivably, there are three conditions as to the sub-discharge ports 13*s*: a case where the corresponding electrothermal transducing elements 11 are energized to discharge ink droplet normally; a case where although the corresponding electrothermal transducing elements 11 are energized, ink is not discharge, but ink retained in the ink chamber 14 is just heated; and a case where no electrothermal transducing elements 11 are energized.

When the electrothermal transducing elements 11 of the sub-discharge ports 13*s* are energized to discharge ink droplets normally, ink droplets are discharged from all the discharge ports 13*m* and 13*s*. Then, immediately after that, ink stagnation occurs evenly in the common ink chamber 15. Therefore, it is possible to exhaust the mixed-color ink or the like in the common ink chamber 15 efficiently by discharging ink droplets again from all the discharge ports 13*m* and 13*s*.

When the electrothermal transducing elements 11 of the sub-discharge ports 13*s* are energized, but no ink is discharged, ink droplets are discharged only from the main discharge ports 13*m*. Therefore, irrespective of driving the sub-discharge ports 13*s*, ink is in the state where it is not discharged. In this case, ink residing in the ink chambers 14 of the sub-discharge ports 13*s* is caused to lower its viscosity because of the electrothermal transducing elements 11. Then, when the electrothermal transducing elements 11 of the main discharge ports 13*m*, which are positioned on both end portions of the common ink chamber 15 in the longitudinal direction, are energized simultaneously, it becomes possible to efficiently exhaust ink residing on the stagnating portion 18 on both end portions of the common ink chamber 15 in the longitudinal direction.

When the electrothermal transducing elements 11 of the sub-discharge ports 13*s* are not driven, no ink is discharged from the sub-discharge ports 13*s* at all, but it is possible to discharge ink from the main discharge ports 13*m* in good condition.

The sub-discharge ports 13*s* are different from the main discharge ports 13*m*, and the electrothermal transducing elements 11 are driven by the application of heat enable signals HEKCL, the block divisional signals BE0 and BE3, or the sub-discharge port discharge signals DHE to enable the sub-discharge ports 13*s* to be driven independent of the main discharge ports 13*m*. Also, for the present embodiment, these signal lines are shared by two ink jet reads for use as shown in FIG. 28, thus making it possible to reduce the numbers thereof by half.

Now, the description will be made of a method for discharging ink droplets from the main discharge ports 13*m* and the sub-discharge ports 13*s*. Here, at first, the usual ink discharge operation will be described.

For the usual ink discharges at the time of printing, the operation is carried out by means of AND between the printing data signals and the heat pulse signals. With the printing data signals, the presence and absence of ink droplets are determined. The heat pulse signals are related to the discharge energy control. Also, it becomes excessively great electrically and thermally if all the numbers of operable discharge ports 13*m* and 13*s* are driven at a time. Usually, therefore, these are divided for driving.

Figure 29:
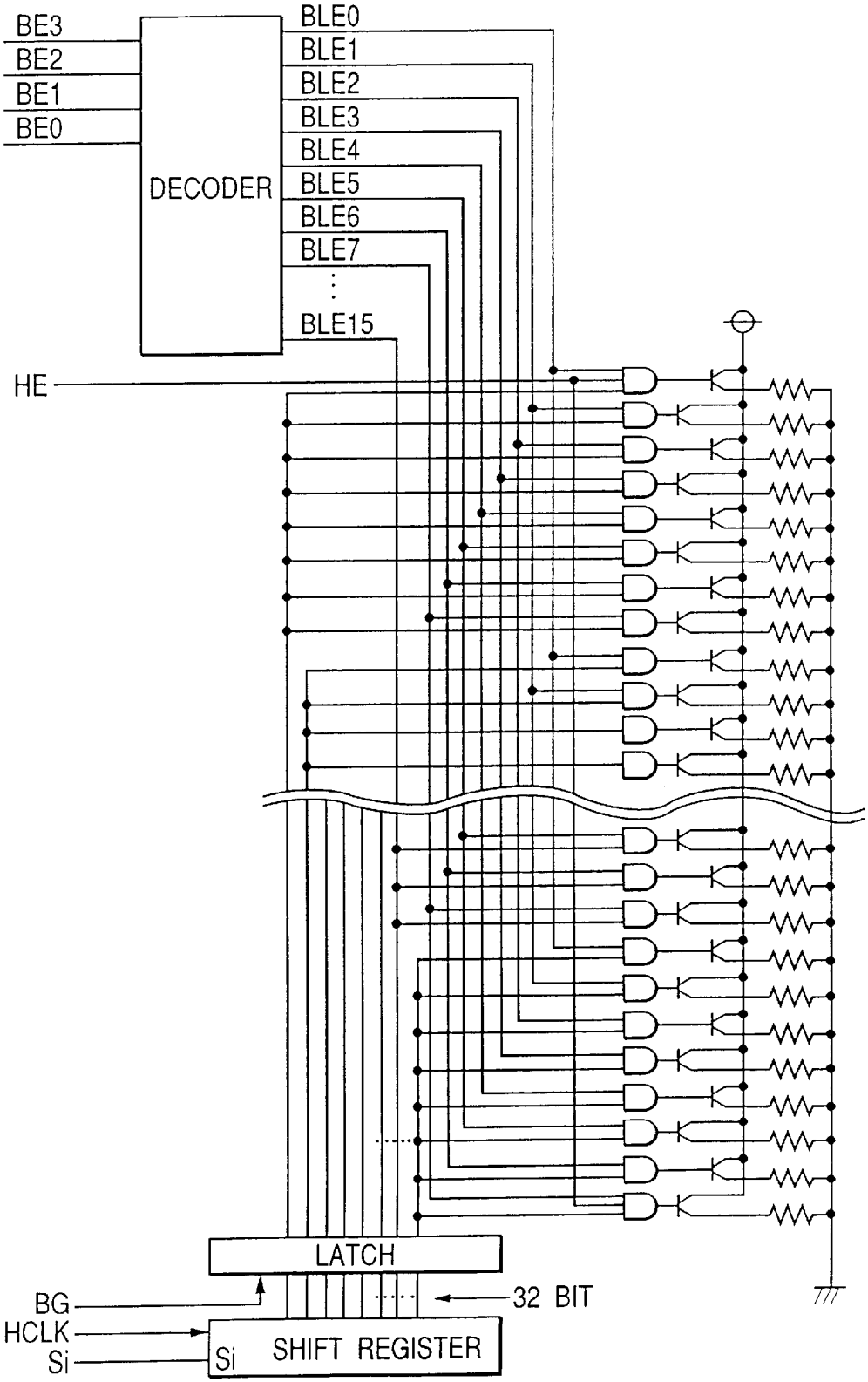
FIG. 29 is a view which shows the driving circuit of one color portion of a liquid discharge head in accordance with the present invention.
Figure 30:
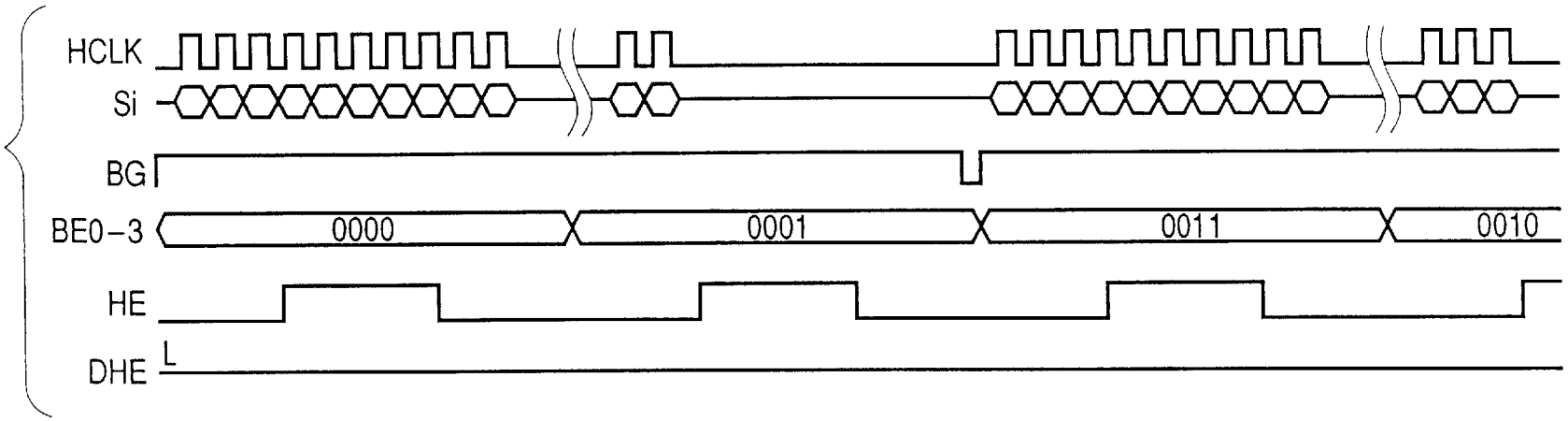
FIG. 30 is a view which shows the driving waveform at the timing of one color portion of a liquid discharge head in accordance with the present invention.

FIG. 29 is a view which shows a driving circuit for the electrothermall transducing elements 11 of an ink jet head dealing with one color portion. FIG. 30 is a view which shows the driving timing therefor. The ink jet head for one color portion is provided with 256 main discharge ports 13*m* which are divided into 16 by use of 32-bit shift registers, and four block signals.

The electrothermal transducing elements 11 are driven by power transistors to create film boiling in ink residing in the ink chamber 14 by the electrothermal transducing element 11 being heated, thus discharging ink from the main discharge ports 13*m*.

Printing data are serially transferred by use of HCLK signals and Si signals, and latched by BG signals. The block dividing signals enable the 16-divided electrothermal transducing elements 11, respectively, by decoding four signals BE0, BE1, BE2, and BE3, into 16 by use of a decoder. Thus, discharges are controlled by AND between the block designating signals thus selected, and the heat pulse signals HE.

In contrast, the discharges of ink droplets from the sub-discharge ports 13*s* can be controlled by the application of sub-discharge port discharging signals DHE, heat signals HE, block dividing signals BE0, BE1, BE2, and BE3, because no printing data are required.

Figure 31:
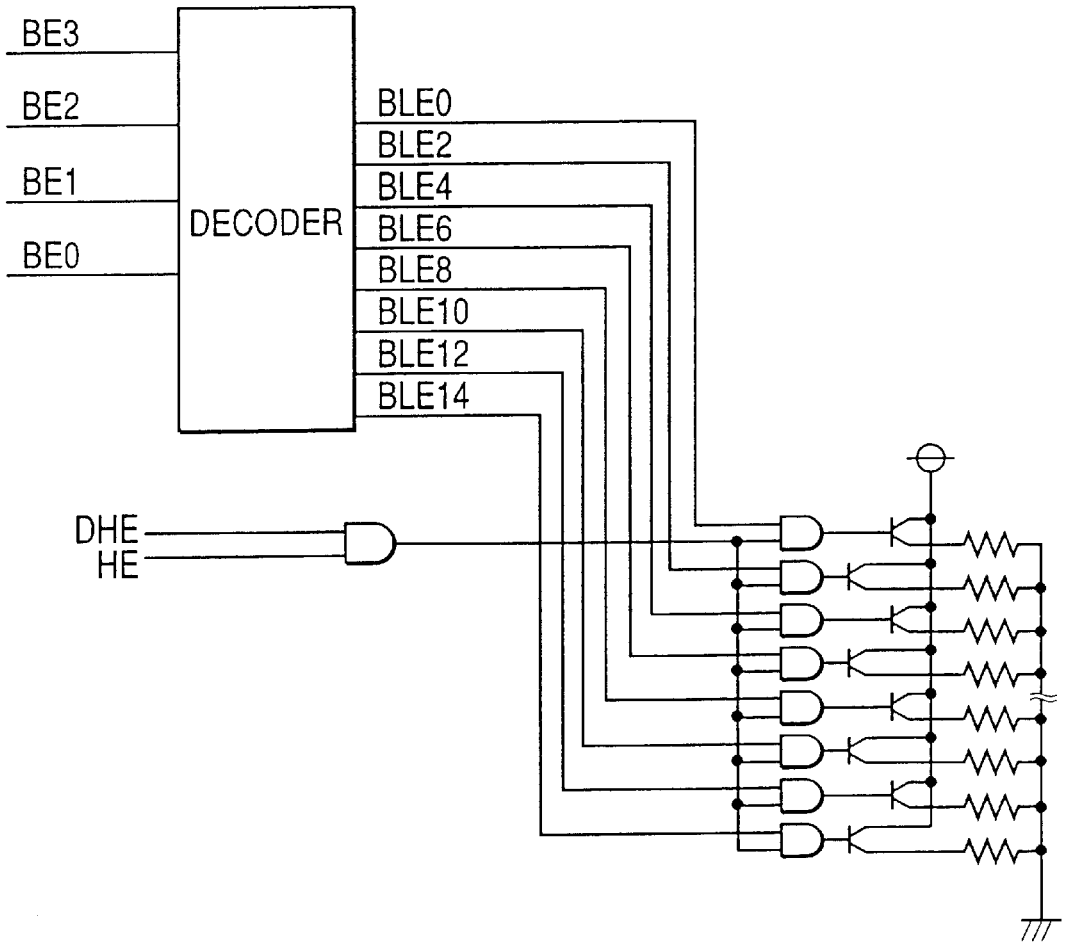
FIG. 31 is a view which shows the driving circuit of one color portion of a liquid discharge head in accordance with another embodiment of the present invention.
Figure 32:
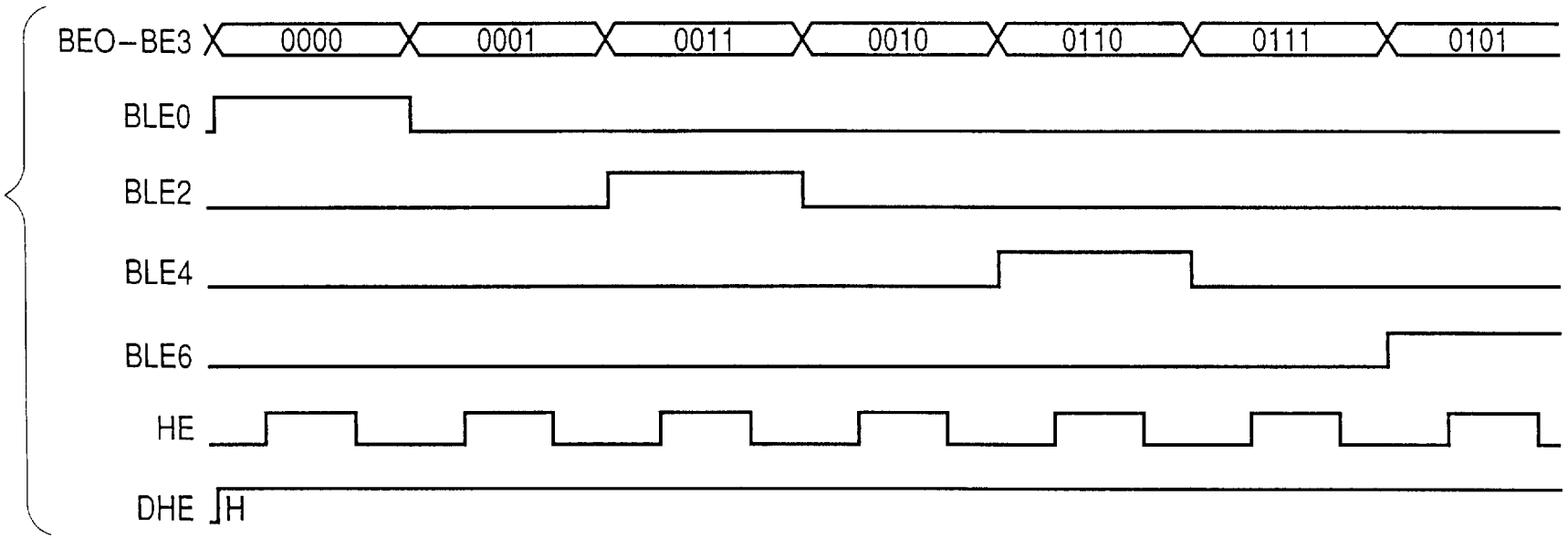
FIG. 32 is a view which shows the driving waveform at the timing of one color portion of a liquid discharge head in accordance with another embodiment of the present invention.

FIG. 31 and FIG. 32 are views which illustrate the driving circuit and driving timing for electrothermal transducing elements of sub-discharge ports 13*s* for one color portion, respectively. When the sub-discharge ports 13*s* are driven, DHE signals are turned ON from the outset. Then, while is witching block signals, the control is made by the heat signals HE. In this case, printing data may be transmitted corresponding to the required control, because the driving of the sub-discharge ports 13*s* is not related to the transfer of the printing data.

Figure 33:
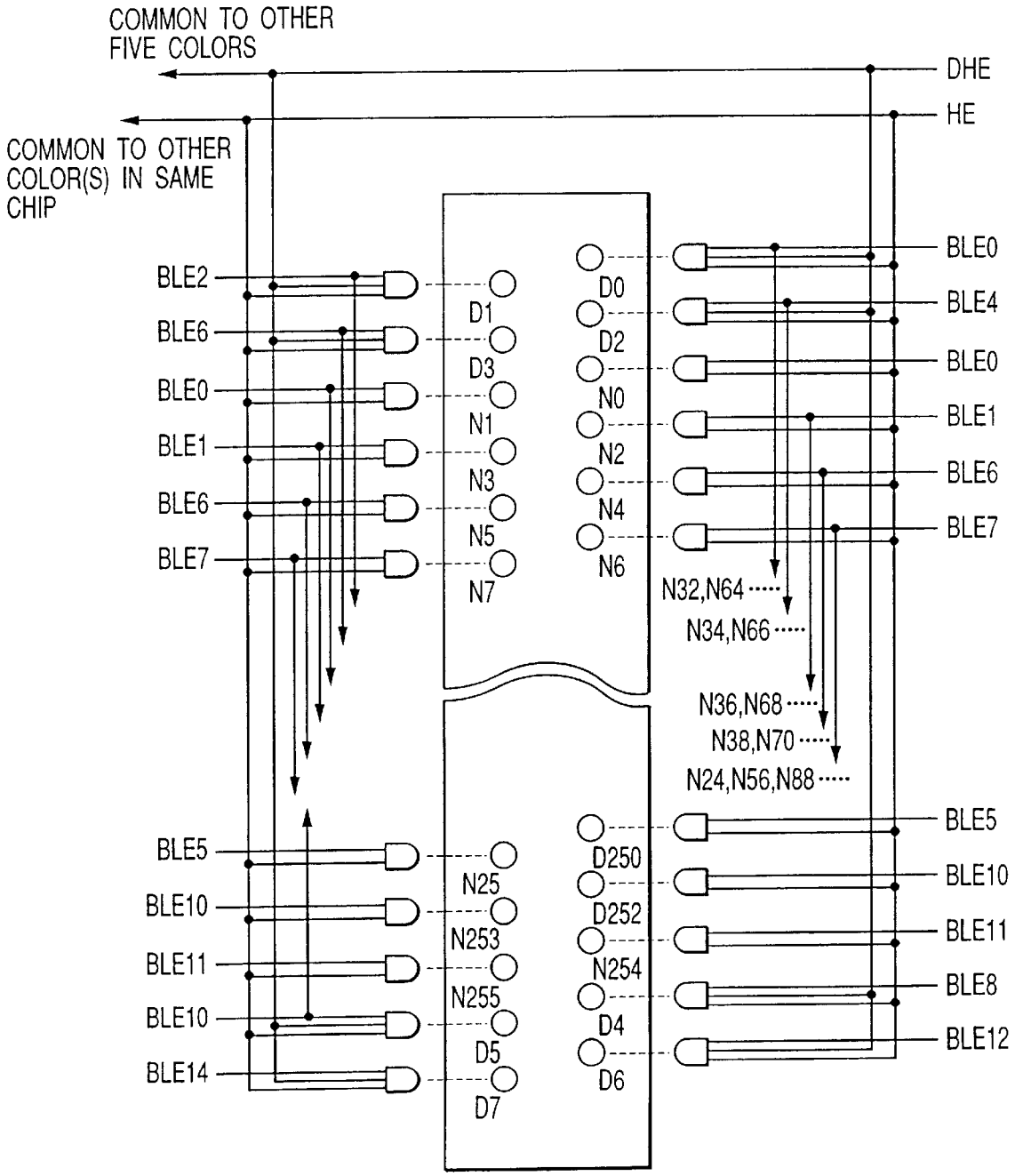
FIG. 33 is a view which shows the electric circuit in which the discharging order of sub-discharge ports is related to the electric circuit for a liquid discharge head in accordance with the present invention.

In conjunction with FIG. 33, the description will be made of the discharging order of the sub-discharge ports 13*s* which is related to an electric circuit. In FIG. 33, the central portion indicates the positional relations between the;discharge ports 13*m* and 13*s*. Reference numerals D0 to D7 designate the sub-discharge ports 13*s*, and N0 to N255, the main discharge ports 13*m*. The discharge ports 13*m* and 13*s* on the even-numbered array and odd-numbered array are arranged with a half pitch displacement, respectively.

Each two of sub-discharge ports 13*s* are arranged on the upper side and lower side of the respective arrays, and connected with each different bock enable signal line. As clear from FIG. 33, the sub-discharge ports 13*s* at D0 and D7 are connected with different block enable signal lines, respectively. Then, the block enable signals are those decoded ones of the block dividing signals BE0 to BE3 as shown in FIG. 31.

In this way, power dissipation is dispersed when the sub-discharge ports 13*s* are used, and no serious influence is exerted on the power source. Also, by the application of the block enable signals, it becomes possible to drive dummy heaters without any special signal lines to be added.

In this respect, it is to be understood that the discharge method for main discharge ports 13*m* and sub-discharge ports 13*s* is not necessarily limited to the one described above.

Figure 34:
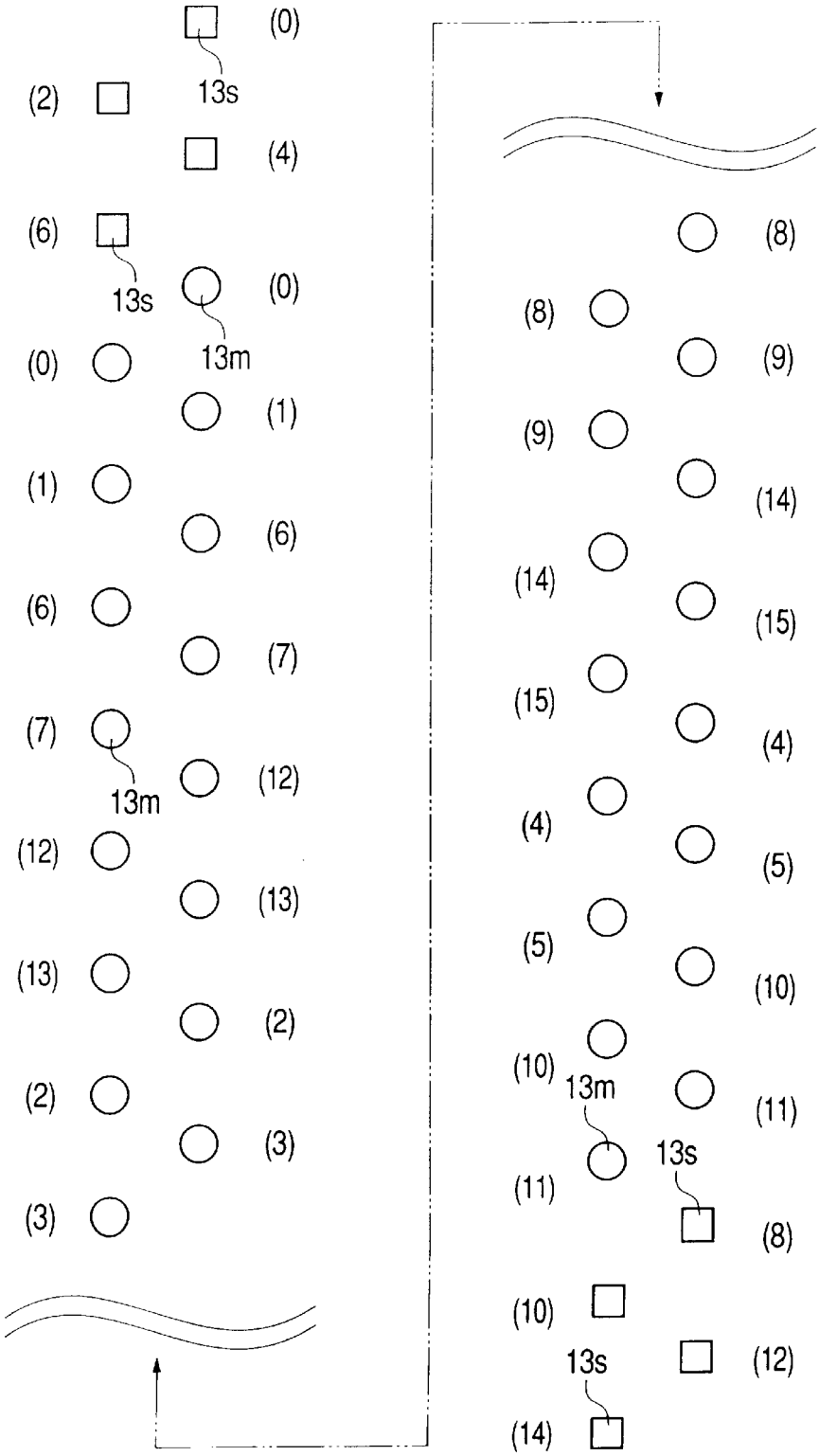
FIG. 34 is a conceptual view which shows the discharging order of the discharge ports of a liquid discharge head in accordance with the present invention.
Figure 35:
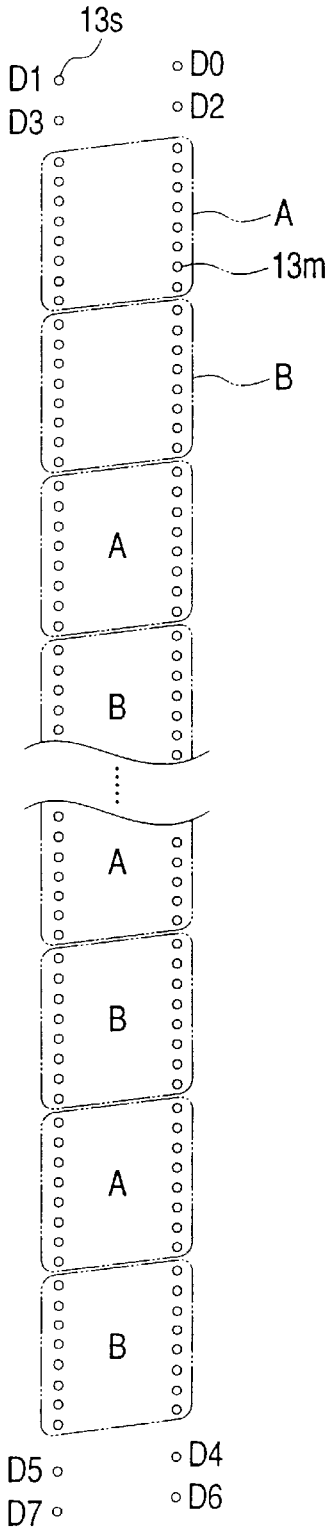
FIG. 35 is a plan view which shows one example of the discharge port arrangement of a liquid discharge head in accordance with-the present invention.
Figure 36:
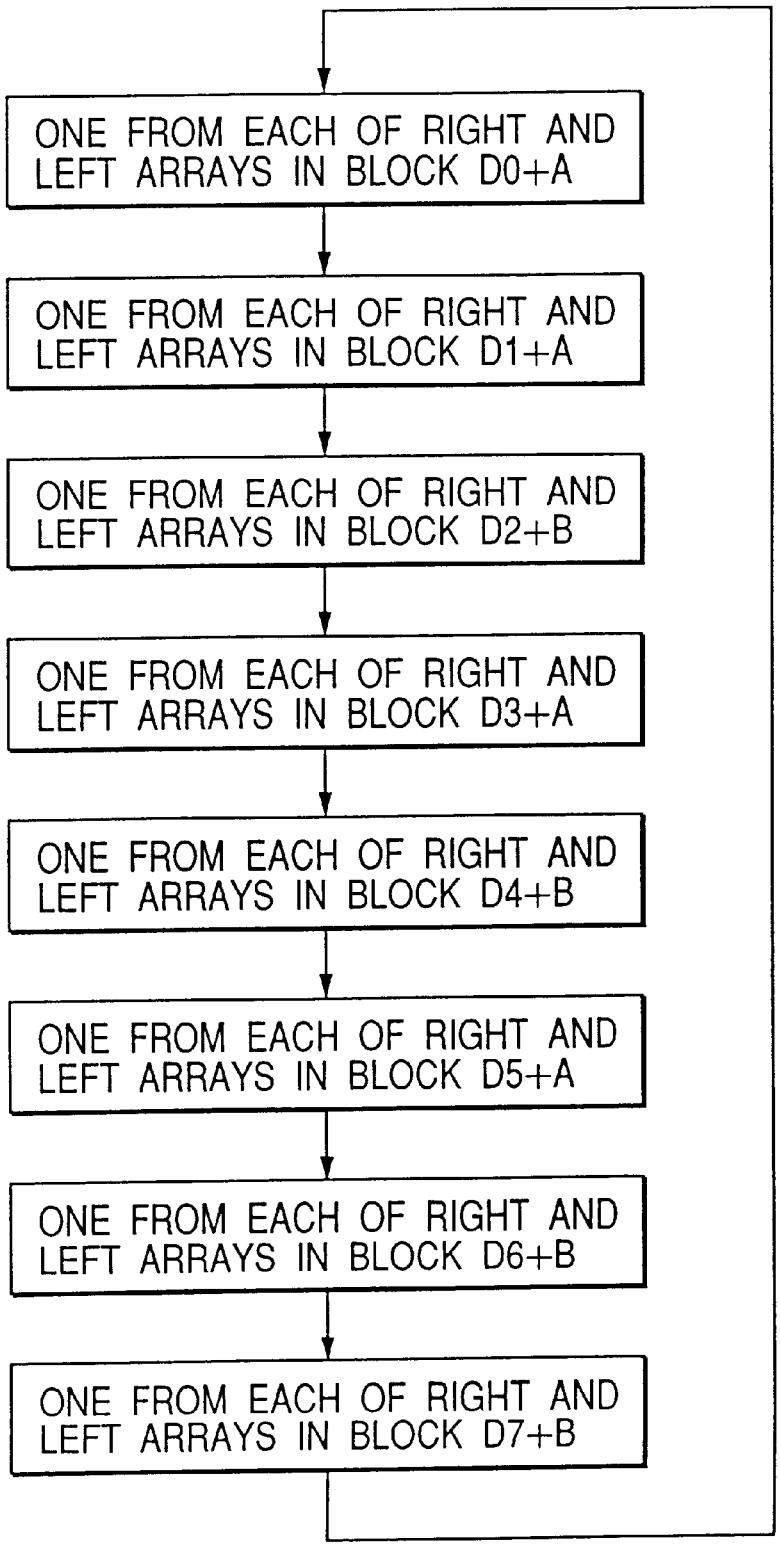
FIG. 36 is a conceptual view which shows the driving order of discharge ports represented in FIG. 35.

Now, in conjunction with FIG. 34, the description will be made of the discharging order including the discharge ports 13*m*. In FIG. 34, the circled numerals near the side of each of the discharge ports 13*m* and 13*s* indicates the block enable signal that corresponds to each of the discharge ports 13*m* and 13*s*. The pre-discharges are performed in the order indicated by the circled numerals. In this manner, it is possible to drive the electrothermal transducing elements 11 of the discharge ports 13*m* and 13*s* one after another from one end side of the common ink chamber 15 in the longitudinal direction. However, as shown in FIG. 35 which shows the arrangement condition of the discharge ports 13*m* and 13*s*, and FIG. 36 which shows the driving order thereof, it may be possible to perform discharges as described below by dividing the main discharge ports 13*m* into two sets, as block A and block B each having 16 ports, alternately in;the longitudinal direction of the common ink chamber 15. In other words, the liquid discharge operation from the sub-discharge ports 13*s* positioned on the end portion in the arrangement direction of the main discharge ports 13*m* is carried out in order of D0 and D3 from one end side in the arrangement direction of the main discharge ports 13*m*. Then, while the first and last sub-discharge ports D0 and D3 positioned on the one end side in the arrangement direction of the main discharge ports, and each of at least two main discharge ports 13*m* that discharges liquid simultaneously are selected from the block A, at least one of at least two sub-discharge ports D1 and D2 on the way, and at least two main discharge ports 13*m* that discharge liquid at the same time are selected from the block B. In continuation of discharges from the sub-discharge ports 13*s* positioned on one end portion in the arrangement direction of the main discharge ports 13*m*, the liquid discharge operation form the sub-discharge ports 13*s* positioned on the other end portion is carried out in the order of D4 to D7 from one end side in the arrangement direction of the main discharge port 13*m*. As in the previous case, while the first and last sub-discharge ports D4 and D7 positioned on the one end side in the arrangement direction of the main discharge ports 13*m*, and each of at least two main discharge ports 13*m* that discharges liquid at the same time are selected from the block A. In contract, at least one of the two sub-discharge ports D1 and D2 (the sub-discharge port D6 in the present embodiment) between them, and at least two main discharge ports 13*m* that discharge liquid at the same time are selected from the block B.

As shown in the Table 1, the pre-discharge processes used for the present embodiment in each of the 11 modes are executed at the respective timings indicated in Table 1. However, the pre-discharge D is in the mode that it its executed after suction recovery process, and the pre-discharge G is in the mode that it is executed after wiping process, respectively, which is the pattern pre-discharge process that includes the pre-discharges from the sub-discharge ports 13*s* to be described later.

TABLE 1

| Port Nos | Head | Nos of pre-discharges | Frequency | Discharges | Driving pulses | Timing | Pre-discharging positions |
|---|---|---|---|---|---|---|---|
| Sub-discharge | K | 200 | 10 kHz | All main discharge ports | Printing | Before pinting start 1 | Pre-discharge receptacle |
| A1 | C, M, Y | 200 | | Sub-discharge ports | Pulses | (Less than 0 to 12 hours) | |
| | Lc, Lm | 200 | | | | | |
| Sub-discharge | K | 500 | 10 kHz | All main discharge ports | Printing | Before pinting start 2 | Pre-discharge receptacle |
| A2 | C, M, Y | 500 | | Sub-discharge ports | Pulses | (Less than 12 to 24 hours) | |
| | Lc, Lm | 500 | | | | | |
| Sub-discharge | K | 1000 | 10 kHz | All main discharge ports | Printing | Before pinting start 3 | Pre-discharge receptacle |
| A3 | C, M, Y | 1000 | | Sub-discharge ports | Pulses | (Less than 24 to 120 hours) | |
| | Lc, Lm | 1000 | | | | | |

TABLE 1-continued

| Port Nos | Head | Nos of pre-discharges | Frequency | Discharges | Driving pulses | Timing | Pre-discharging positions |
|---|---|---|---|---|---|---|---|
| Sub-discharge B1 | K<br>C, M, Y<br>Lc, Lm | 3<br>3<br>3 | Printing Driving frequency | All main discharge ports<br>Sub-discharge ports | Printing Pulses | During color mode printing pre-discharge for every line | Pre-discharge receptacle Flowing |
| Sub-discharge B2 | K<br>C, M, Y<br>Lc, Lm | 3<br>3<br>3 | Printing Driving frequency | All main discharge ports<br>Sub-discharge ports | Printing Pulses | During K mode printing pre-discharge for every line | Pre-discharge receptacle Flowing |
| Sub-discharge B3 | K<br>C, M, Y<br>Lc, Lm | 10<br>10<br>10 | Printing Driving frequency | All main discharge ports<br>Sub-discharge ports | Printing Pulses | Stand by on K mode and color mode | Pre-discharge receptacle |
| Sub-discharge C | K<br>C, M, Y<br>Lc, Lm | 500<br>500<br>500 | 10 kHz | All main discharge ports<br>Sub-discharge ports | Printing Pulses | After wiping with wider medium | Pre-discharge receptacle |
| Sub-discharge D | K<br>C, M, Y<br>Lc, Lm | 5000<br>5000<br>5000 | 10 kHz | Pattern pre-discharge | Printing Pulses | Mixed-color prevention | Pre-discharge receptacle |
| Sub-discharge E | K<br>C, M, Y<br>Lc, Lm | 8191<br>8191<br>8191 | 12.5 kHz | All main discharge ports<br>Sub-discharge ports | Printing Pulses | During suction | Cap |
| Sub-discharge F | K<br>C, M, Y<br>Lc, Lm | 5000<br>5000<br>5000 | 10 kHz | All main discharge ports<br>Sub-discharge ports | Printing Pulses | No tank detection pre-discharges for preventing solidification | Pre-discharge receptacle |
| Sub-discharge G | K<br>C, M, Y<br>Lc, Lm | 1500<br>1500<br>0500 | 10 kHz | Pattern pre-discharge | Printing Pulses | After wiping | Pre-discharge receptacle |

In this respect, the amount of one discharge from the main discharge port 13*m* is approximately 4.5 picoliters for the present embodiment, and the amount of discharge from the sub-discharge port 13*s* is approximately 9 picoliters.

Figure 37:
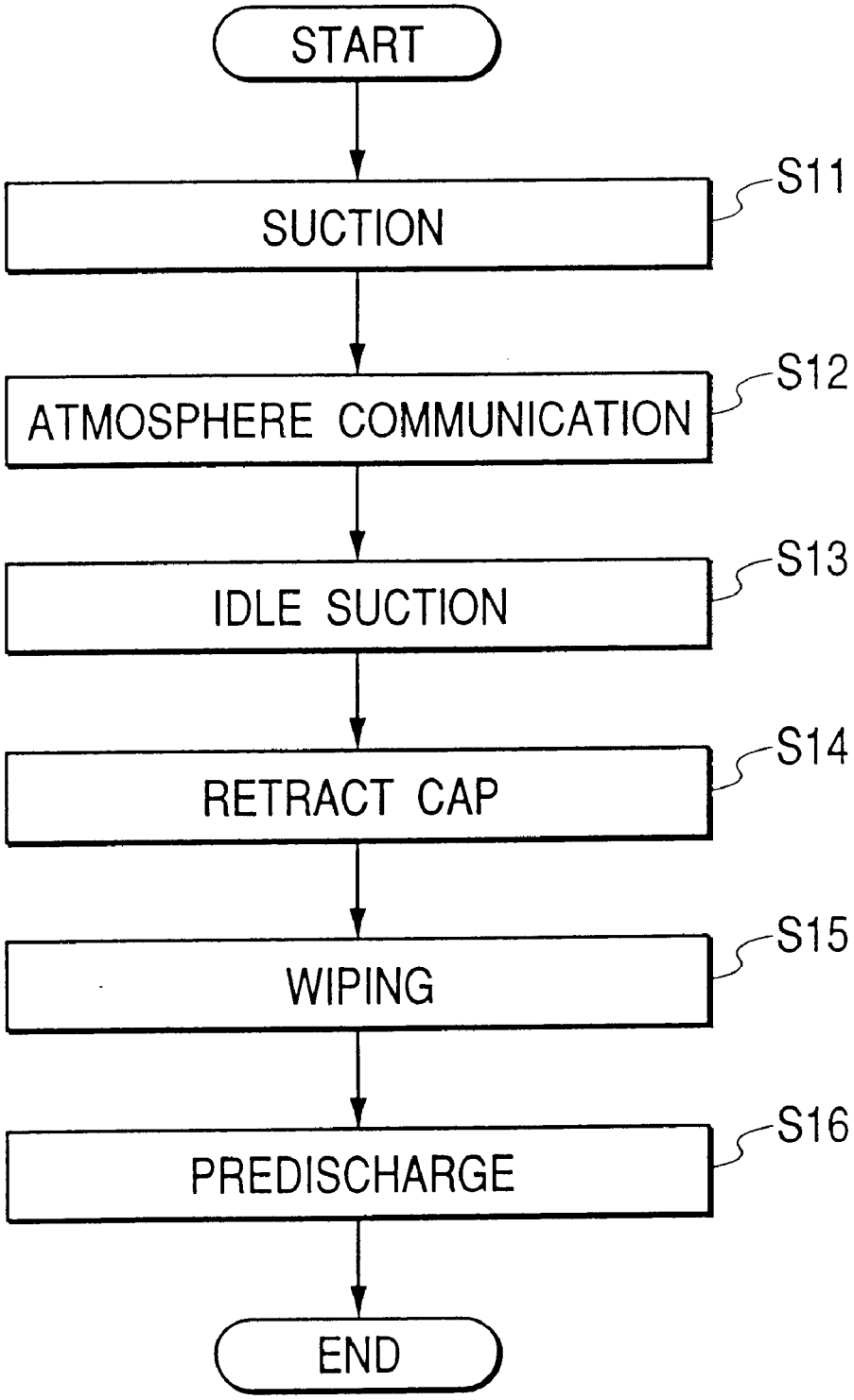
FIG. 37 is a flowchart which shows the procedure of a suction recovery operation for a liquid discharge head in accordance with the present invention.

Now, in accordance with a flowchart shown in FIG. 37, the description will be made of a series of suction recovery operation. At first, in step S11, the PG motor E0003 is driven to rotate the tube pump M5100 to be describe later, thus sucking the recording head H1001 through the discharge ports 13*m* and 13*s*. In step S12, the LF motor E0002 is driven to release the atmospheric communication valve M7001 to be described later. Then, the interior of the cap M5001 to be described later is sucked to make it the atmospheric pressure forcefully to finish the suction. As the tube pump M5100 rotates continuously, idle suction is executed in step S23 to exhaust remaining ink in the cap M5001 and the captube M5009 to a waste ink absorbent (not shown). Then, in step S24, the tube pump M5100 is suspended, and the cap M5001 is retracted from the discharge port surface. After that, in step S25, the wiping operation is executed for the discharge port surface to wipe off the mixed-color ink adhering to the discharge port surface then. Thus, it is made possible to prevent color mixture after the cap M5001 is retracted from the discharge port surface.

Consequently, in step S16, the pre-discharge process is carried out to exhaust mixed-color ink.

Figure 38:
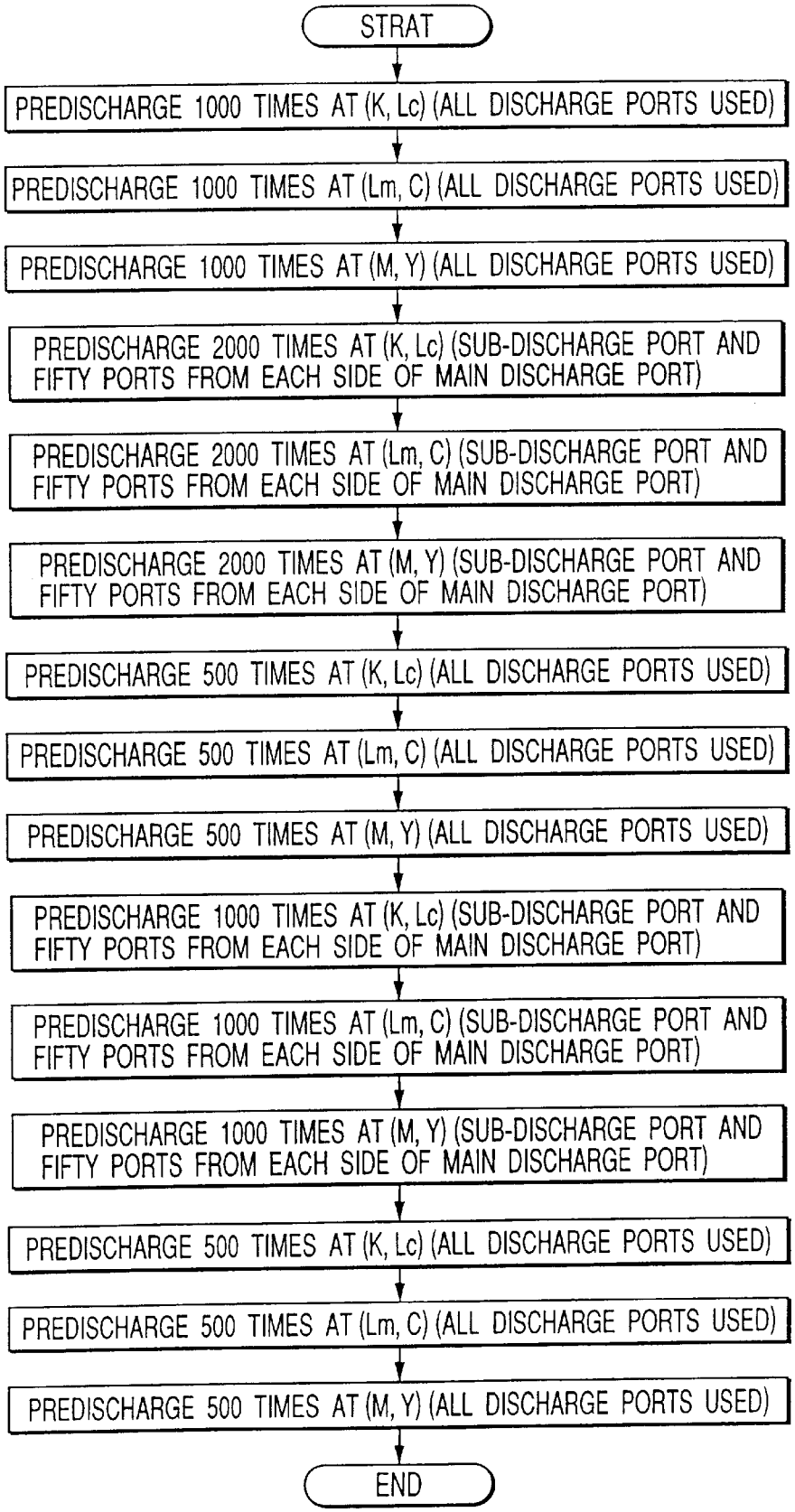
FIG. 38 is a flowchart which shows the procedure of a pre-discharging process for a liquid discharge head in accordance with the present invention.

Now, in accordance with a flowchart shown in FIG. 38, the pre-discharge process in the step S16 will be described further in detail. At first, for the first heat generating base plate 12 corresponding to the reference marks K and Lc, ink droplets are pre-discharged 1,000 times each from all the main discharge ports 13*m* and sub-discharge ports 13*s*, respectively. This process is repeated in accordance with the procedures shown in FIG. 34. Then, for the second heat generating base plate, 12 corresponding to the reference marks Lm and C, ink droplets are pre-discharged 1,000 times each from all the main discharge ports 13*m* and sub-discharge ports 13*s*, respectively. After that, for the third heat generating base plate 12 corresponding to the reference marks M and Y, ink droplets are pre-discharged 1,000 times each from all the main discharge ports 13*m* and sub-discharge ports 13*s*, respectively.

Then, for the first heat generating base plate 12 corresponding to the reference marks K and Lc, ink droplets are pre-discharged 2,000 times each from a total of 100 main discharge parts 13*m* (50 on one side) positioned on both end sides of the common liquid chamber 15 in the longitudinal direction, and all the sub-discharge ports 13*s*. This discharge is also repeated in accordance with the procedures shown in FIG. 34. After that, for the second heat generating base plate 12 corresponding to the reference marks Lm and C, ink droplets are pre-discharged 2,000 times each from 50 main discharge parts 13*m* each positioned on one side each of both end sides of the common liquid chamber 15 in the longitudinal direction, and all the sub-discharge ports 13*s*. Then, for the third heat generating base plate 12 corresponding to the reference marks M and Y, ink droplets are pre-discharged 2,000 times each from 50 main discharge parts 13*m* each positioned on one side each of both end sides of the common liquid chamber 15 in the longitudinal direction, and all the sub-discharge ports 13*s*.

Subsequently, ink droplets are discharge 500 times each form all the main discharge ports 13*m* and sub-discharge ports 13*s*, respectively. Likewise, for the second heat generating base plate 12 corresponding to the reference marks Lm and C, ink droplets are pre-discharged 500 times each from all the main discharge ports 13*m* and sub-discharge ports 13*s*. After that, for the third heat generating base plate 12 corresponding to the reference marks M and Y, ink droplets are pre-discharged 500 times each form all the main discharge ports 13*m* and sub-discharge ports 13*s*, respectively. Subsequently, for the first heat generating base plate 12 corresponding to the reference marks K and Lc, ink droplets are pre-discharged 1,000 times each from 50 main discharge ports 13*m* positioned on one side each of both end sides of the common liquid chamber 15 in the longitudinal direction, and all the sub-discharge ports 13*s*. Likewise, for the second heat generating base plate 12 corresponding to the reference marks Lm and C, ink droplets are pre-discharged 1,000 times each from 50 main discharge parts 13*m* each positioned on one side each of both end sides of the common liquid chamber 15 in the longitudinal direction, and all the sub-discharge ports 13*s*. Then, for the third heat generating base plate 12 corresponding to the reference marks M and Y, ink droplets are pre-discharged 1,000 times each from 50 main discharge parts 13*m* each positioned on one side each of both end sides of the common liquid chamber 15 in the longitudinal direction, and all the sub-discharge ports 13*s*.

Again, subsequently, ink droplets are discharge 500 times each form all the main discharge ports 13*m* and sub-discharge ports 13*s*, respectively. Likewise, for the second heat generating base plate 12 corresponding to the reference marks Lm and C, ink droplets are pre-discharged 500 times each from all the main discharge ports 13*m* and sub-discharge ports 13*s*. After that, for the third heat generating base plate 12 corresponding to the reference marks M and Y, ink droplets are pre-discharged 500 times each form all the main discharge ports 13*m* and sub-discharge ports 13*s*, respectively.

Figure 39:
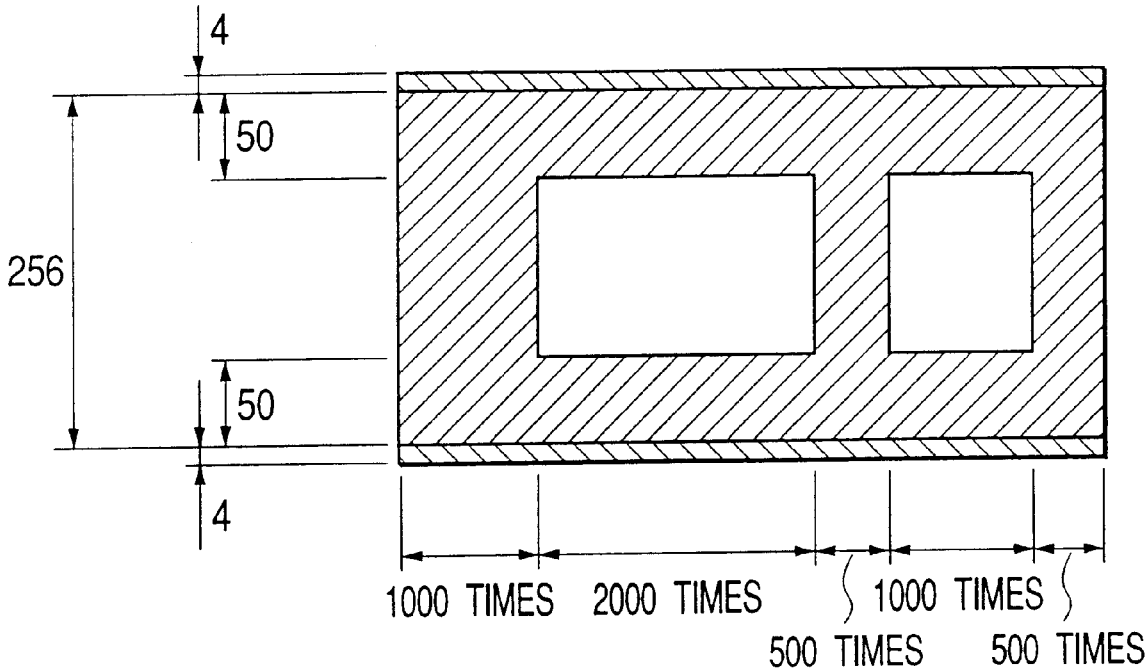
FIG. 39 is a conceptual view which shows the pre-discharge pattern for the pre-discharging process represented in FIG. 38.

FIG. 39 is a conceptual view which shows the pre-discharge patter in a pre-discharge mode such as this.

In this respect, the discharge frequency of the pre-discharge process is a value which is determined by the amount of ink mixed in the common ink chamber 15, and the time which has elapsed since the mixture as well, that is, the period of time during which the mixed-color ink has been dispersed in the common ink chamber 15. With the experiments using an actual apparatus, it has been confirmed that the discharge frequencies described above are sufficiently effective.

Figure 40:
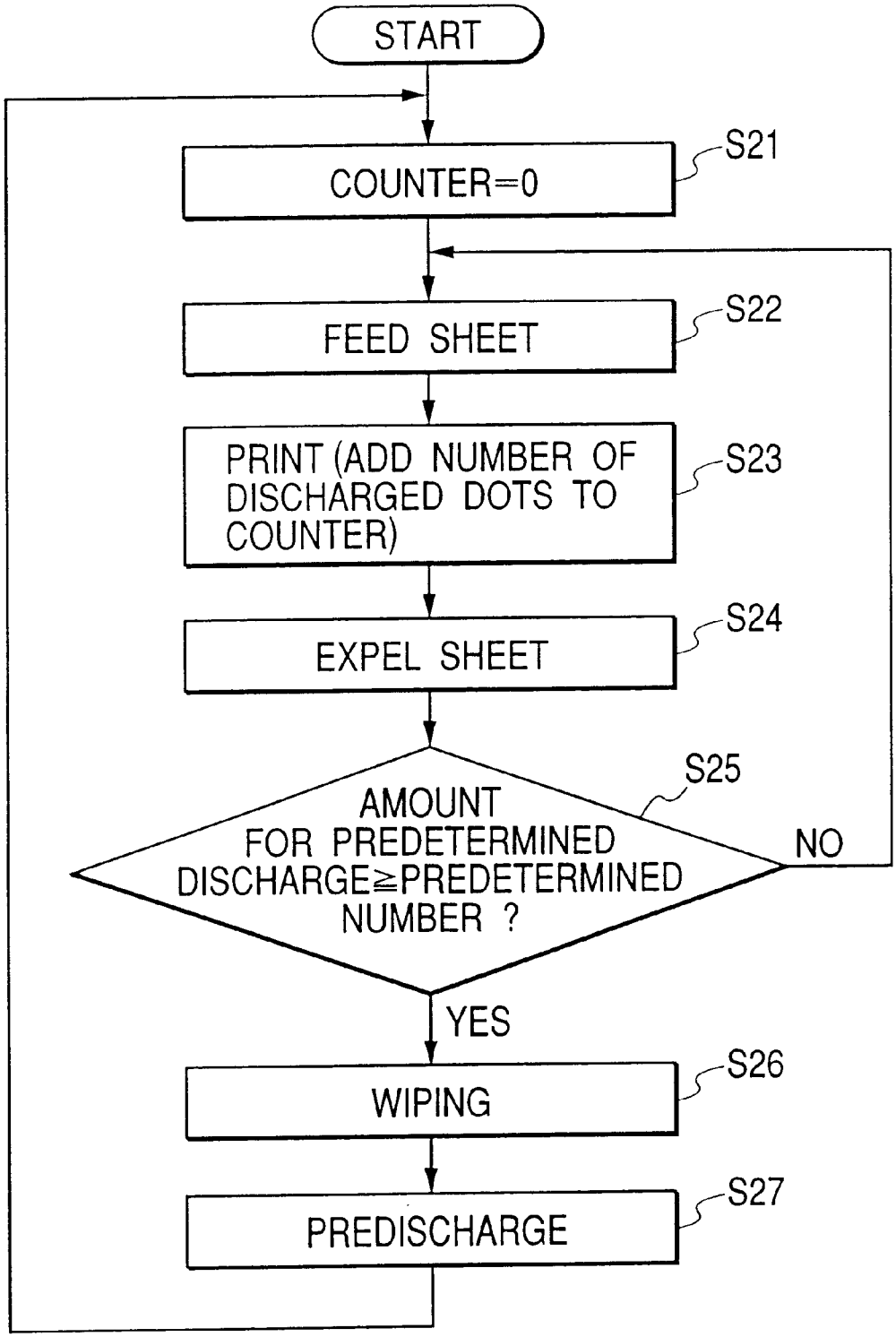
FIG. 40 is a flowchart which shows the procedure of a wiping process for a liquid discharge head in accordance with the present invention.

For the ink jet printer of the present embodiment, the wiping process is carried out after the discharge frequencies for the printing operation and pre-discharge process have reached the redetermined values. Now, in accordance with a flowchart shown in FIG. 40, the description will be made of the procedure of this wiping process.

At first in step S21, a counter for discharge dot numbers (not shown) is cleared to zero. Then, in step S22, the paper feed is executed in accordance with printing signals, and at the same time, in step S23, printing operation is carried out. At this juncture, the discharged dot numbers of discharged ink for the printing operation on a printing medium are counted, and added to a counted number. After the completion of printing operation, the printing medium is exhausted in step S25 after printing, and in step S26, the counted numbers and the predetermined value set in advance are compared. If the counted value is smaller than the predetermined value, the process returns to the step S22 without wiping process. Then, the process is on standby to wait for the input of printing signals. If the counted value is equal to or more than the predetermined value in the step S25, the process proceeds to step S26 where wiping process is executed to remove ink droplets adhering to the discharge port surface. Further, in order to prevent the color mixture due to the wiping process, pre-discharge process is executed in step S27, and then, in step S21, the counted value is reset to zero.

Figure 41:
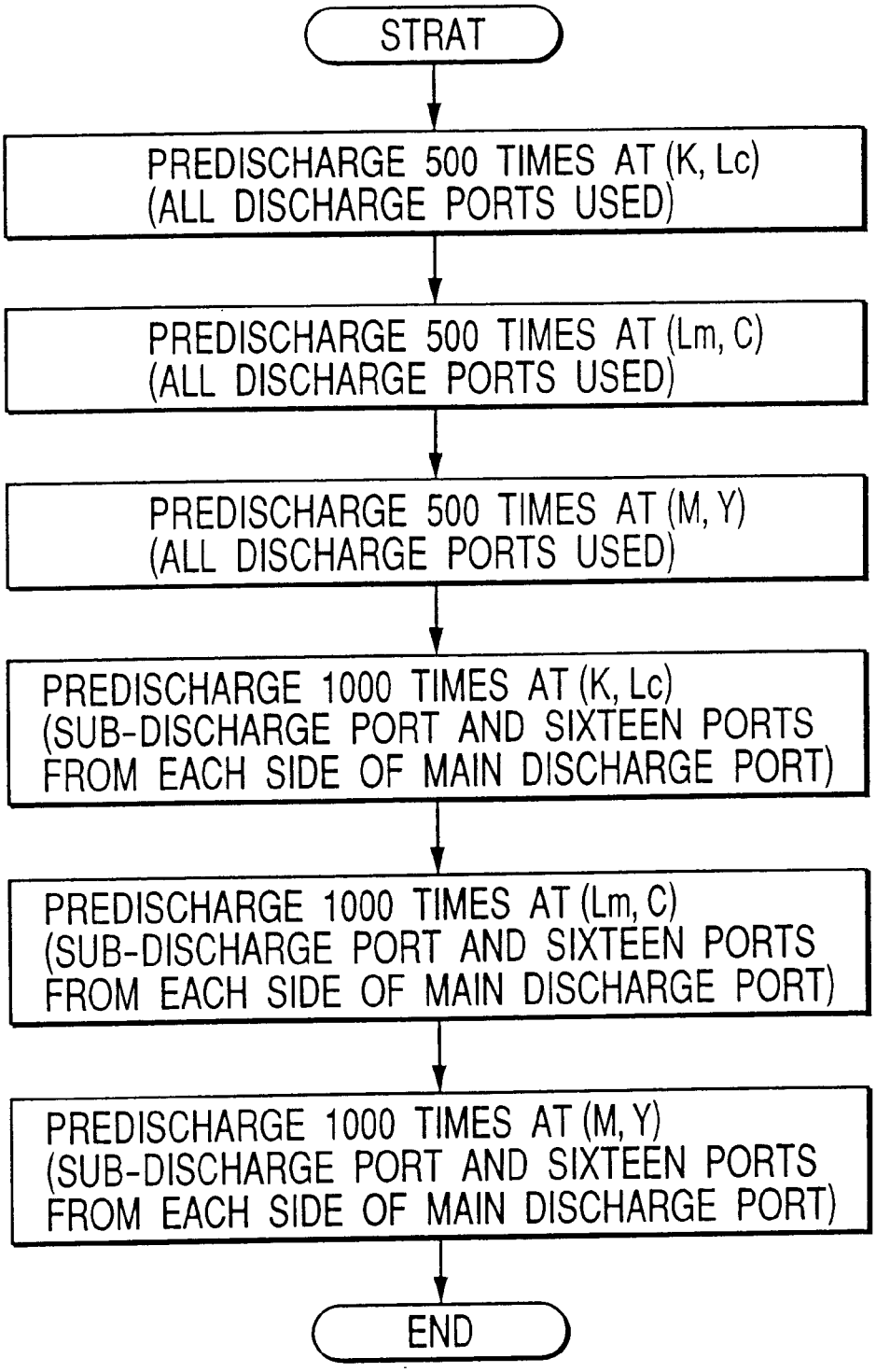
FIG. 41 is a flowchart which shows the procedure of a pre-discharging process for a liquid discharge head in accordance with the present invention.

Here, in accordance with a flowchart shown in FIG. 41, the description will be made of the contents of the pre-discharge process in the step S27 further in detail.

At first, for the first heat generating base plate 12 corresponding to the reference marks K and Lc, ink droplets are pre-discharged 500 times each from all the main discharge ports 13*m* and sub-discharge ports 13*s*, respectively. This process is repeated in accordance with the procedures shown in FIG. 34. After that, for the second heat generating base plate 12 corresponding to the reference marks Lm and C, ink droplets are pre-discharged, likewise, 500 times each from all the main discharge ports 13*m* and sub-discharge ports 13*s*, respectively. Then, for the third heat generating base plate 12 corresponding to the reference marks M and Y, ink droplets are pre-discharged 500 times each from all the main discharge ports 13*m* and sub-discharge ports 13*s*, respectively.

Then, for the first heat generating base plate 12 corresponding to the reference marks K and Lc, ink droplets are pre-discharged 1,000 times each from a total of 32 main discharge parts 13*m* (16 on one side) positioned on both end sides of the common liquid chamber 15 in the longitudinal direction, and all the sub-discharge ports 13*s*. This discharge is also repeated in accordance with the procedures shown in FIG. 34. Likewise, for the second heat generating base plate 12 corresponding to the reference marks Lm and C, ink droplets are pre-discharged 1,000 times each from 16 main discharge parts 13*m* each positioned on one side each of both end sides of the common liquid chamber 15 in the longitudinal direction, and all the sub-discharge ports 13*s*. After that, for the third heat generating base plate 12 corresponding to the reference marks M and Y, ink droplets are pre-discharged 1,000 times each from 516 main discharge parts 13*m* each positioned on one side each of both end sides of the common liquid chamber 15 in the longitudinal direction, and all the sub-discharge ports 13*s*.

Figure 42:
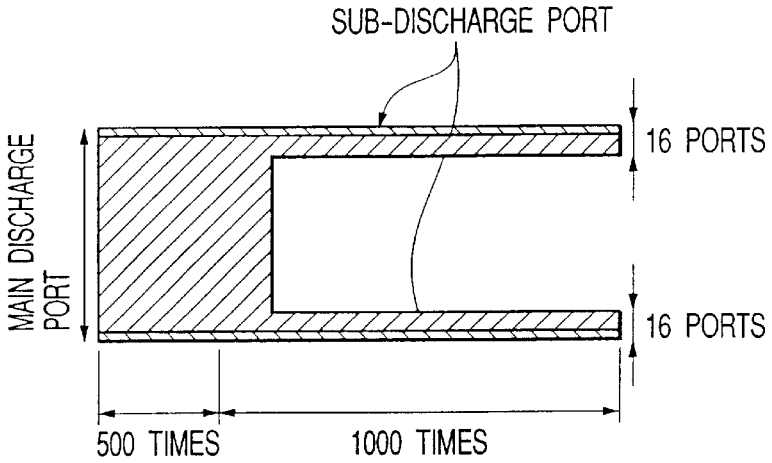
FIG. 42 is a conceptual view which shows the pre-discharge pattern for the pre-discharging process represented in FIG. 41.

FIG. 42 is a conceptual view which shows the pre-discharge patter such as this. However, in comparison with the pre-discharge process executed after the suction recovery process described above, only a small amount of ink is mixed in the common ink chamber 15. Therefore, it is possible to eliminate such color mixture by the execution of pre-discharge process whose frequency is comparatively small. Thus, it becomes possible to eliminate the color mixture without increasing the frequencies of pre-discharges more than actually needed, that is, without inviting the generation of ink mists following pre-discharges, which tends to contaminate inside the housing of a printing apparatus.

Figure 43:
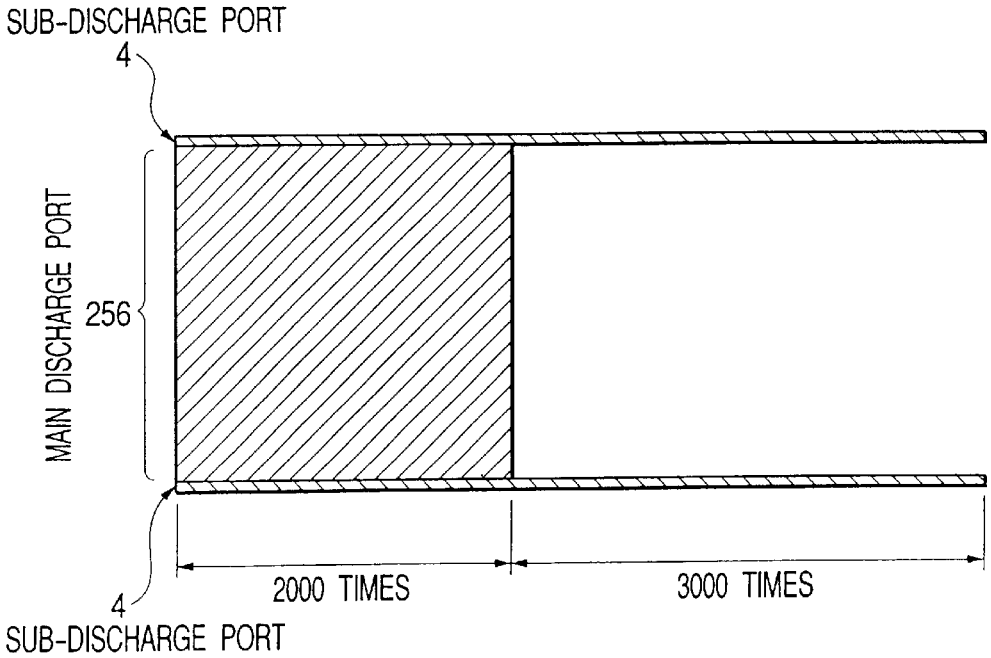
FIG. 43 is a conceptual view which shows another example of pre-discharge pattern for the pre-discharging process.

Here, the pre-discharge pattern is not necessarily limited to those described above. For example, as shown in FIG. 43, it may be possible to arrange so as to discharge ink droplets from all the main discharge ports 13*m*, and all the sub-discharge ports 13*s* 2,000 times each, and then, only from the sub-discharge ports 13*s*, ink droplets are discharged 3,000 times, for example.

Now, the description will be made of the structure of the tube pump M5100 that performs the suction recovery process.

The tube pump M5100 is connected with the cap M5001 through the pump tube M5019, and the cap tube M5009. The tube pump M5100 is connected with the PG motor E0003 through the driving switching means that switches the transmission paths of driving force between the aforesaid automatic carrier unit M3022 and this pump M5100, and the pump driving transmission gear train M5130 as well.

Figure 44:
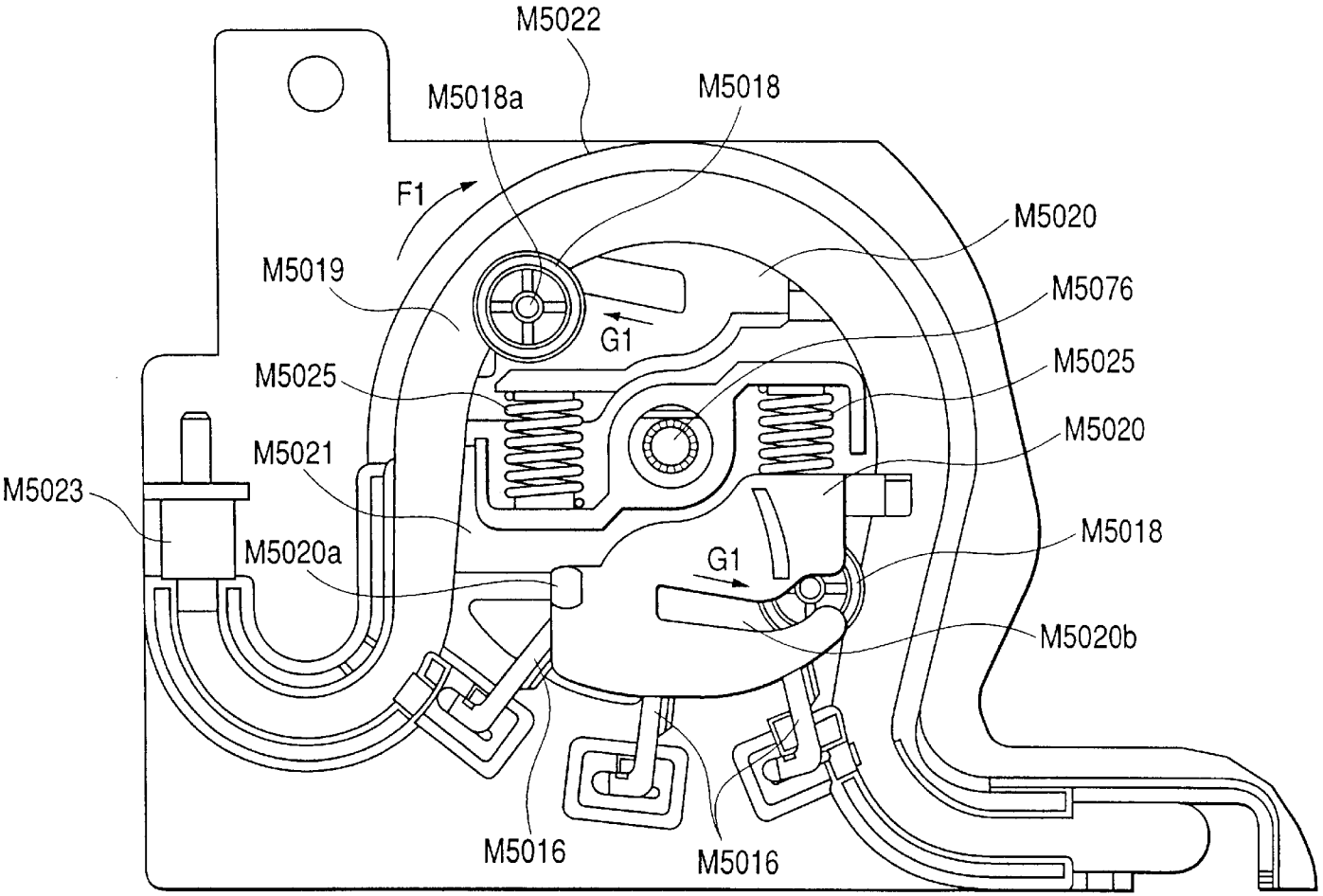
FIG. 44 is a front view which shows schematically the structure of a tube pump used for the suction recovery process, representing the state where the pump roller is pressurized to be in contact with the pump tube.
Figure 45:
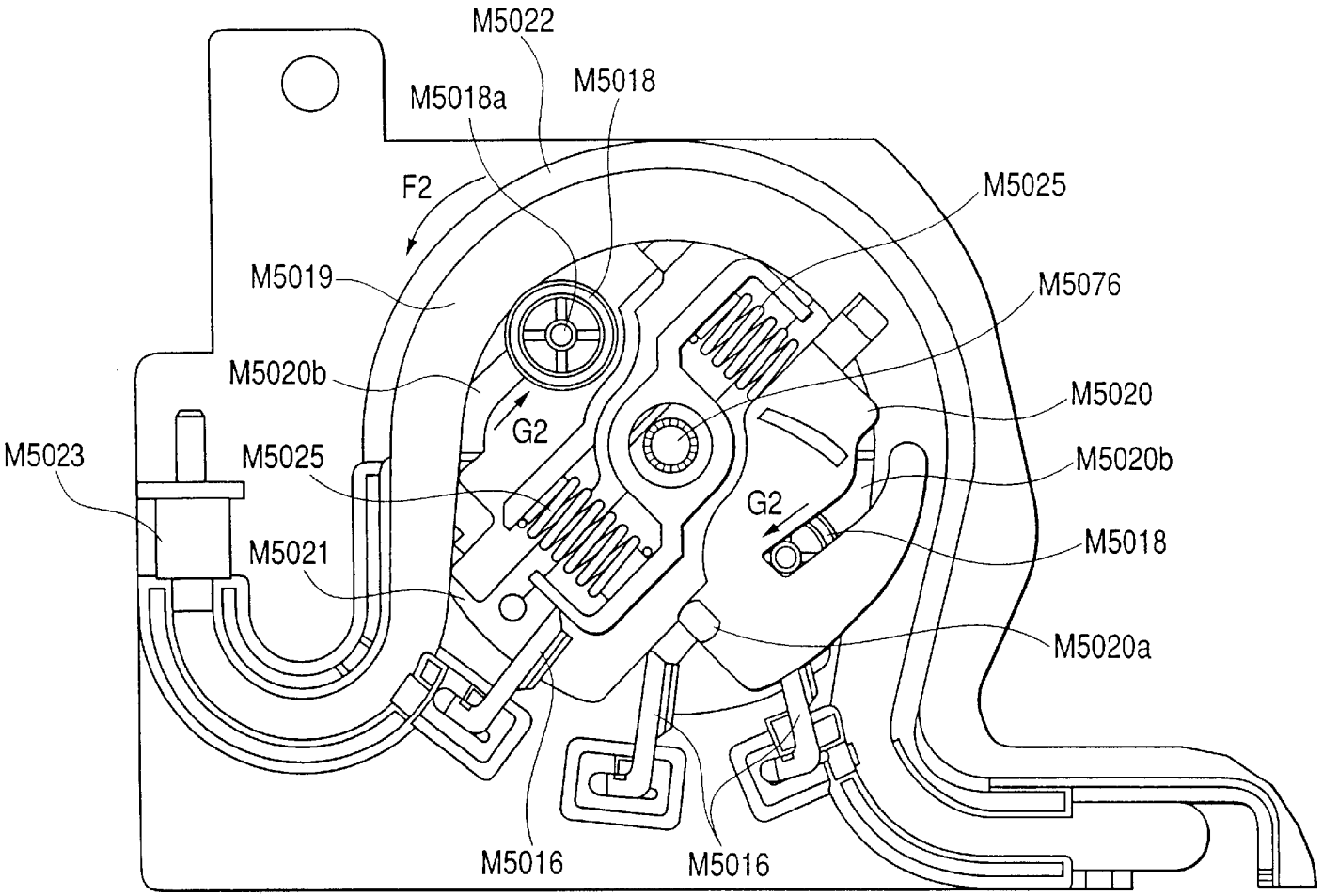
FIG. 45 is a front view which shows schematically the structure of a tube pump used for the suction recovery process, representing the state where the pressure exerted on the pump roller is released.

The tube pump M5100 is the one that generates pressure when the pump tube M5019 is squeezed by the pump roller M5018. FIG. 44 and FIG. 45 are views which illustrate the structure thereof. FIG. 44 shows the state where the pump roller M5018 is in contact with the pump tube M5019 under pressure. FIG. 45 shows the state where the contact pressure of the pump roller M5018 has been released from the pump tube M5019.

The pump M5100 is provided with the pump tube M5109 and the inner walls having a semi-cylindrical diameter (180 degrees or more) centering on the pump center shaft M5076, which comprises the pump tube guide M5022 that enables the pump tube M5019 to follow the inner walls; the pump roller M5018 that presses the pump tube M5019 to the pump tube guide M5022 to be in contact therewith and squeezed thereby; the pump roller holder M5020 that supports the pump roller M5018 rotatively and movably; the pump roller guide M5021 which supports the pump roller holder M5020 rotatively by the rotational shaft 5020*a*, and which is itself rotatively supported by the rotational shaft M5076; and the pump roller pressure spring M5025 that function to press the pump roller M5018 so that the pump tube M5019 to be in contact with the pump tube guide M5022 under pressure.

Here, each two pieces of the pump rollers M5018, pump roller holders M5020, and pump roller pressure springs M5025 are installed on the pump roller guide M5021 with an angular phase differential of 180 degrees with respect to the pump central shaft M5076.

Also, for the pump M5100, a mechanism is provided to release the contact pressure of the pump roller M5018 to the pump tube M5019 for squeezing the pump tube M5019.

The pump roller M5018 is structured so that its shaft may shift in the shifting groove M5020*b* provided for the pump roller holder M5020.

In the state shown in FIG. 44, the positional relations between the pump roller M5018 and the shifting groove M5020*b* of the pump roller holder M5020 is such that the distance from the pump central shaft M5076 to the pump roller M5018 is larger, and that the pump roller M5018 presses the pump tube M5019 (the inner walls of tube is closely in contact).

In the state shown in FIG. 45, the distance from the pump central shaft M5076 to the pump roller M5018 is smaller so that the pump tube M5019 is not in contact.

When the PG motor E0003 rotates in the regular rotational direction, each member of the pump M5100 rotates in the direction indicated by an arrow F2 in FIG. 45 centering on the pump central shaft M5076. The pump roller M5018 relatively moves in the shifting groove M5020*b* of the pump roller holder M5020 in the direction indicated by an arrow G2 by means of the friction force which generates between the pump roller and the pump tube M5019. Therefore, when the PG motor E0003 rotates regularly, the contact pressure of the pump roller M5018 is released so as not to generate suction pressure.

When the PG motor E0003 rotates in the reverse direction, each member of the pump M5100 rotates in the direction indicated by an arrow F1 in FIG. 44 centering on the pump central shaft M5076, and the pump roller M5018 relatively shifts in the shifting groove M5020*b* of the pump holder M5020 in the direction indicated by an arrow G1 by the biasing force of a roller dumper M5016 when it passes the roller dumper M5016. Therefore, when the PG motor E0003 rotate reversely, the contact pressure of the pump roller M5018 is activated to squeeze-the pump tube M5019 for exerting the suction pressure.

Figure 46:
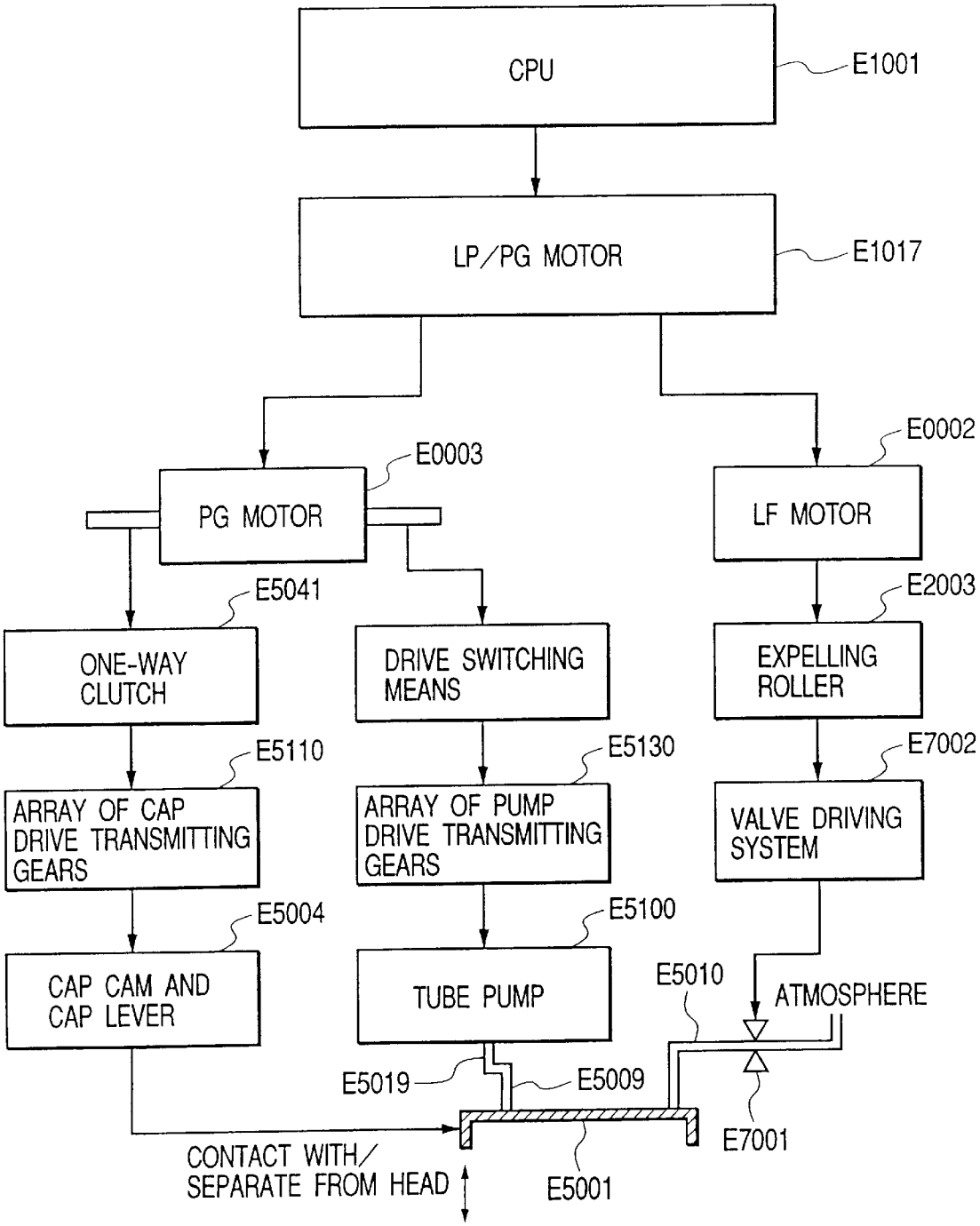
FIG. 46 is a conceptual view which shows the control of the suction recovery process of a liquid discharge head, and the driving system thereof in accordance with the present invention.

FIG. 46 is a view which schematically shows the structure of the control and driving system related to the suction recovery process. In other words, the CPU E1001 drives and controls the PG motor E0003 and the LF motor E0002 through the LP/PG motor driver E0017.

One end of the shaft for the PG motor E0003 is connected with the cap M5001 by way of a one way clutch M5041, a cap driving transmission gear train M5110, and a capping cam and cap lever M5004. Then, by the rotation of the PG motor E0003 in the regular direction, the cap M5001 is closely in contact with the recording element base plate H1100 of a recording head H1001.

The other end of the shaft for the PG motor E0003 is connected with the rotational shaft M5076 of a tube pump M5130 by way of drive switching means formed by a swinging arm M5026, a switching lever M5043, or the like, and a pump driving transmission gear train M5130. As described earlier, when the PG motor E0003 rotates reversely, the tube-pump M5130 generates suction pressure, but when the PG motor E0003 rotates regularly, the tube-pump M5130 cannot generate suction pressure. The LF motor E0002 drives to rotate the exhaust roller M2003. The exhaust roller M2003 is connected with the atmospheric communication valve M7001 through the valve driving system M7002 which is formed by a valve drive transmission gear train M5140, a valve clutch M5048, a valve cum M5036, and some others. The atmospheric communication valve M7001 enables a valve tube M5010 to open to or closed from the air outside, which is formed by the aforesaid valve lever M5038 and a valve rubber M5036. When the exhaust roller M2003 is driven in the reverse direction by the reverse rotation of the LF motor E0002, the atmospheric communication valve M7001 is open, and when the exhaust roller M2003 is driven to rotate in the regular direction by the regular rotation of the LF motor E0002, the atmospheric communication valve M7001 is closed.

Figure 47:
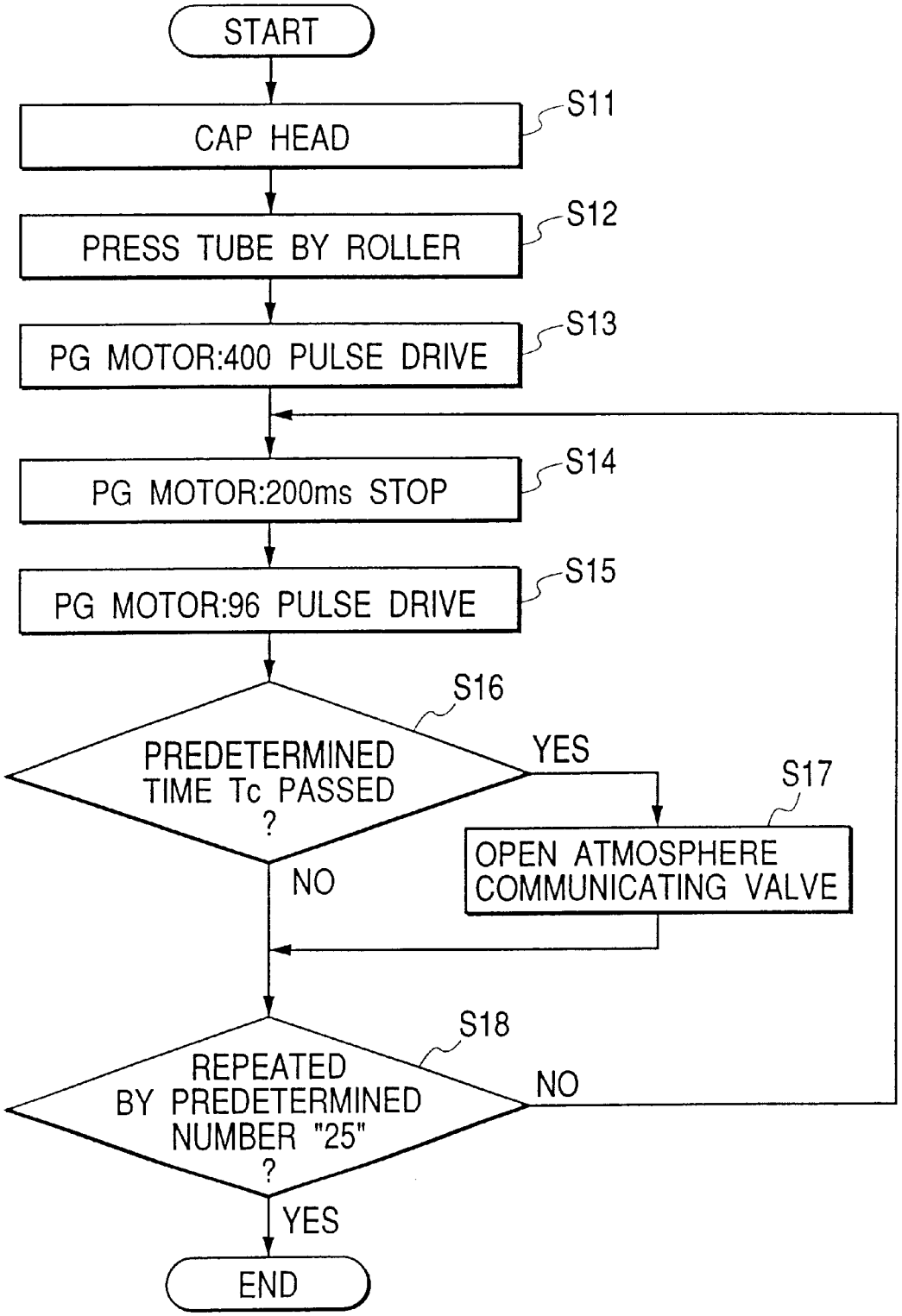
FIG. 47 is a flowchart which shows the operational sequence of the suction recovery process for a liquid discharge head in accordance with the present invention.
Figure 48:
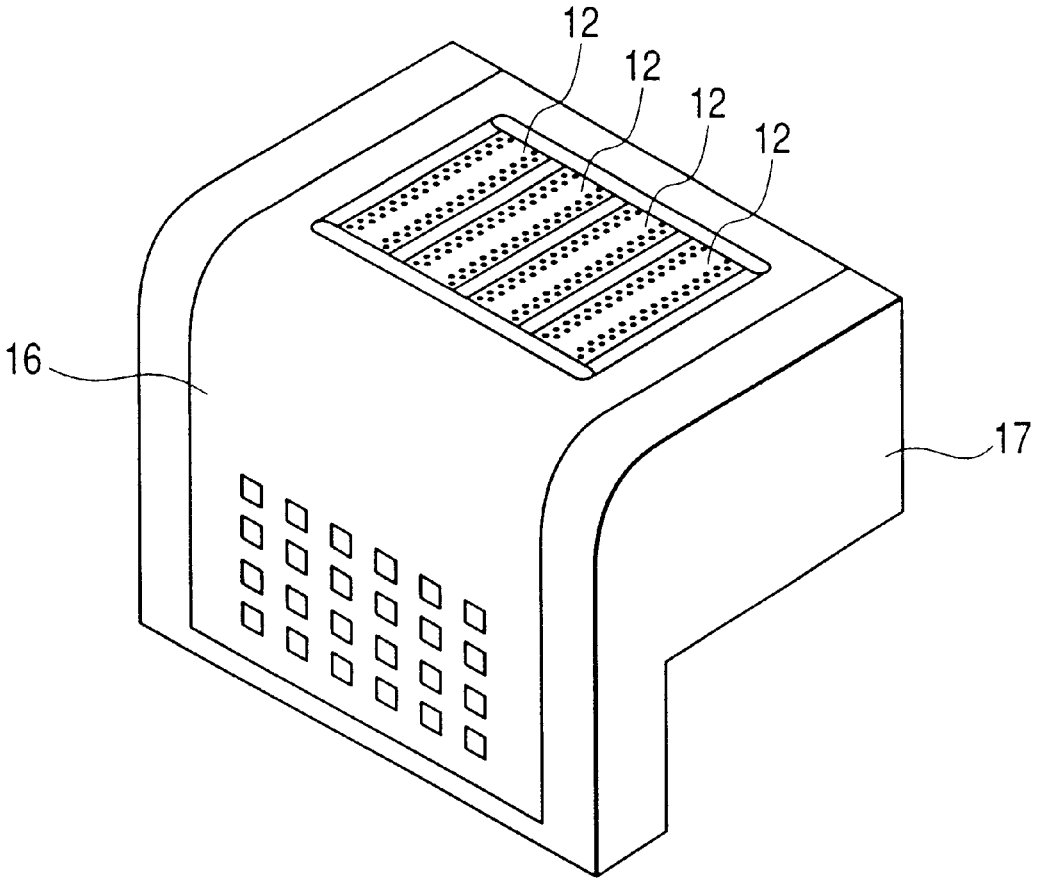
FIG. 48 is a perspective view which shows the outer appearance of the ink jet head of side shooter type in accordance with the background art.
Figure 49:
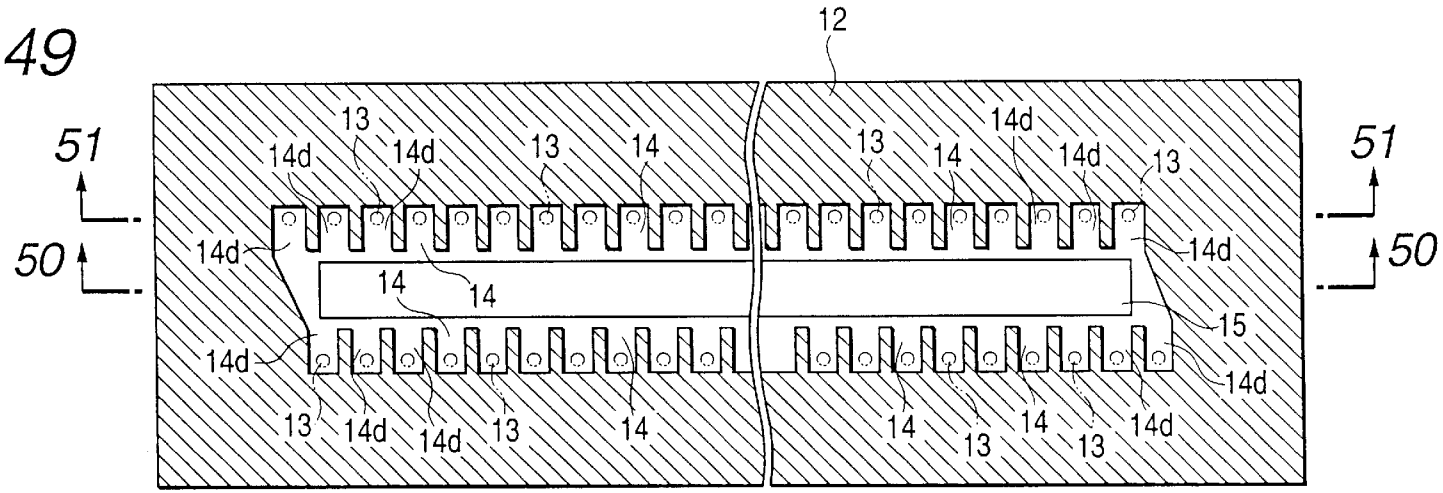
FIG. 49 is a cross-sectional view which shows the inner structure of the ink jet head represented in FIG. 48.
Figure 50:
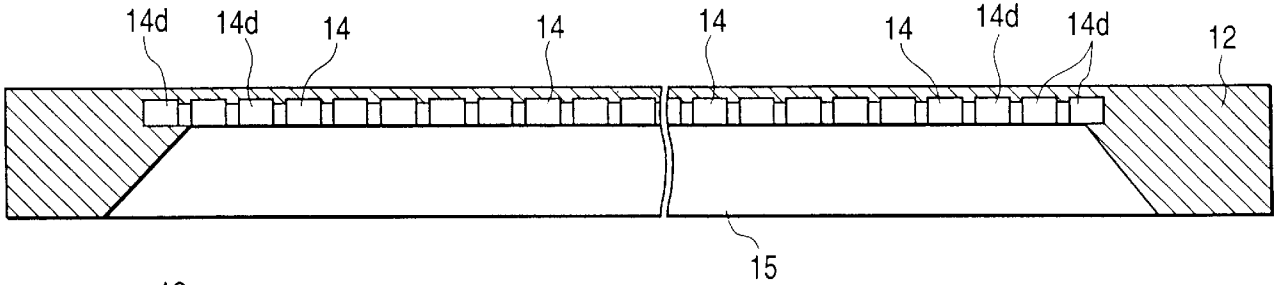
FIG. 50 is a cross-sectional view taken along line 50—50 in FIG. 49.
Figure 51:
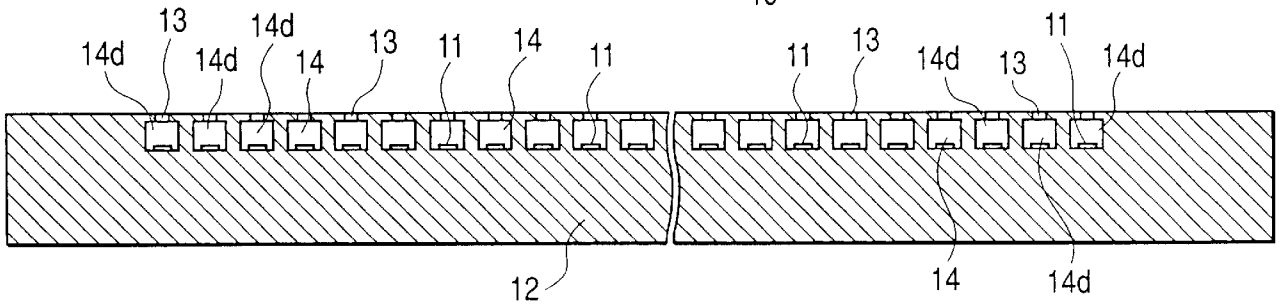
FIG. 51 is a cross-sectional view taken along line 51—51 in FIG. 49.

Now, in accordance with a flowchart shown in FIG. 47, the description will be made of the operational sequence of the suction recovery process. Here, in the following description, the PG motor E0003, which is a pulse motor, is assumed to enable the pump roller M5018 to complete one rotation (one cycle) centering on the rotational shaft M5076 with a portion of 478 pulses of an instruction pulse signal.

At first, the CPU E1001 rotates the PG motor E0003 regularly to drive the cap cam and capping lever M5004. Thus, the cap M5001 shifts to the recording element base plate H1100 (discharge port surface) side of the recording head H1001 so that the discharge port surface is capped (step S11). At this juncture, the tube pump M5100 operates by the regular rotation of the PG motor E0003. Then, however, since the contact pressure of the pump roller M5018 on the pump tube M5019 is released, the pump roller M5018 does not squeeze the pump tube M5019. No suction pressure is exerted, either. Also, in this state, the atmospheric communication valve M7001 is open.

Subsequently, the CPU E1001 drives the LF motor E0002 to rotate the sheet exhaust roller M2003 in the regular rotational direction in order to close the atmospheric communication valve M7001, and reversely rotates the PG motor E0003 by given instruction pulses at given rotation speed. Thus, the pump tube M5019 is pressured and squeezed by means of the pump roller M5018. In this manner, the pressure in the cap M5001 is caused to arrive at the predetermined target negative pressure (step S12, and step S13). For example, at a rotational speed of 700 PPS, the motor is driven only for 400 pulses. As a result, by the contact pressure of the pump roller M5018, the pump tube M5019 is squeezed, thus the negative pressure acting upon the recording element base plate H1100 of the recording head cartridge H1000 through the cap tube M5009 and the cap M5001. The ink and bubbles which become unstable for use of printing operation are compulsorily sucked from the discharge ports 13*m* and 13*s* on the recording element base plate H1100.

With the motor having been driven by the rotational speed of 700 PPS by a portion of 400 pulses as described above, the negative pressure rises to the target value of 0.19 atm, for example.

When the motor has been driven for a portion of 400 pulses completely, the CPU E1001 stops the PG motor E0003 for a period of predetermined time td, such as 200 ms (step S14). During this period of stoppage, the ink, which is sucked from the discharge ports 13*m* and 13*s* on the recording element base plate H1100 by the negative pressure in the cap M5001, is allowed to flow into the pump tube M5019. Then, the negative pressure in the cap M5001 is relaxed (lowered) to the extent of the volume of the ink thus having flown into it, because the tube pump M5100 is suspended. During this period, the negative pressure is assumed to be dropped by a degree of 0.02 atm, for example.

When this waiting period of the predetermined time td is over, the CPU E1001 again drives the PG motor E0003 in the reverse direction at given speed for given number of instruction pulses (that is, given driving amount). The motor is driven at the rotational speed of 700 PPS for 96 pulses, for example (step S15).

With the PG motor E0003 thus driven again, the negative pressure raised again almost by the same degree at which it has been lowered (0.02 atm, for instance). In other words, the negative pressure is raised to the target value of 0.19 atm. With the repeated suspension and driving of the PG motor E0003, it becomes possible to apply the negative pressure of almost the target value (0.17 to 0.19 atm, for instance) to the cap M5001 continuously.

Then, the CPU E1001 determines whether or not the time T has passed more than the predetermined time Tc (1.5 seconds, for instance) since the PG motor E0003 has begun to be driven in the step S13 (step S16). Then, if the predetermined time has not elapsed, it is determined whether or not the number n, in which the processes in the step S14 and the step S15 have been repeated, arrives at the predetermined value no (25 times, for instance) (step S18). If not, the process returns to the step S14 to repeat the procedures designated in the step S14 and step S15 again.

Also, in the step S16, if it is determined that the passage of the time T has reached the predetermined time Tc, the CPU E1001 rotates the LF motor E0002 regularly to drive the paper feed roller M2003 in the regular rotational direction, thus releasing the atmospheric communication valve M7001 (step S17). When the atmospheric communication valve M7001 is released, the interior of the cap M5001 presents the atmospheric pressure. Thus, ink suction from the recording head H1001 terminates. The predetermined time Tc and number Nc are adjusted to set the timing so that the atmospheric communication valve M7001 is released on the way of driving the PG motor M0003. Should the atmospheric communication valve M7001 is released which the PG motor E0003 is being driven, the ink which is sucked out from the recording head H1001 and resides in the cap M5001 is removed rapidly from the cap M5001. In this way, it becomes possible to reduce the amount of ink remaining on the discharge port surface of the head, which contribute effectively to the prevention of color mixture.

Here, for the present embodiment, the amount of suction is regulated by the time Tc that has passed since the PG motor E0003 beginning to be driven in the step S13 to the releasing of the atmospheric communication valve M7001.

After the atmospheric communication valve M7001 has been released, the PG motor E0003 is repeatedly suspended (instructed to wait) and driven until the number n of repetitions reaches the predetermined times nc.

In other words, ink remaining in the tubes M5009 and M5019 of the printer recovery device is exhausted to the waste ink absorbent provided for the printer main body with the repetition of the driving and suspension of the PG motor after the release of the atmospheric communication valve M7001 until the number n of repetitions reaches the predetermined times nc (this is called idle suction).

It is often attempted to make the tubes of the printer recovery device as thin as possible in order make the initial volume smaller at the time of suction for the purpose of enhancing the pump efficiency. In this case, even if the atmospheric communication valve M7001 is in a state of being released, small negative pressure is generated in the cap M5001 due to the flow resistance in the tubes when the idle suction are executed. If such negative pressure should exceed a certain threshold value provided for the head itself, ink is drawn out from the head to cause color mixture.

For the present embodiment, therefore, the driving and suspension of the PG motor E0003 are repeated even for the idle suction to minimize the generation of negative pressure in the cap, hence making it possible to avoid the drawback, such as color mixtures, suitably.

As described above, for the present embodiment, the tube pump M5100 is driven to rotate continuously to make the interior of the cap M5001 a targeted negative pressure as quickly as possible. After that, the driving and suspension of the tube pump M5100 is repeated plural times to maintain the interior of the cap M5001 within a given range near the targeted negative pressure. Therefore, it becomes possible to perform the suction recoveries in an appropriate amount of suction and the pressure thereof with respect to the recording head H1001.

Here, for the embodiment described above, the description has been made to regulate the driving of the tube pump M5100 by designating the driving speed and number of instructed pulse numbers for the PG motor E0003 in the step S13 and step S15. However, it may be possible to regulate the driving of the tube pump M5100 by the application of the driving speed and driving time of the PG motor E0003.

Also, for the embodiment described above, the driving of the PG motor E0003 is set at a portion of 96 pulses, while the suspension time is set at 200 ms. However, if these settings can be controlled more precisely, it becomes possible to manage the range of pressure much smaller in the interior of the cap M5001.

Also, for the present embodiment, the driving pulse numbers of the PG motor E0003 is fixed to be 96 pulses and the waiting time, 200 ms in the step S14 and step S15 where the driving and waiting are repeated for the PG motor E0003. However, it may be possible to change the driving pulse numbers and waiting time on the way. For example, if the viscosity is made higher for ink near the discharge ports 13*m* and 13*s* of the head due to being left intact or the like, it becomes difficult to let them exhausted because the flowability of overly viscous ink becomes inferior. In this case, it is effective to drive the PC motor E0003 greater only at the initial state of suction by repeating the driving and waiting of the PG motor. For example, while waiting is fixed at 200 ms, the first driving pulse number is set at 154, and the second number, at 134, the third number, at 115, and the fourth number and on, at 96. In this manner, the initial suction is made more intensive to exhaust the overly viscous ink quickly. Of course, it may be possible to attain the same effect by changing both the driving pulses and waiting time with the changes of the waiting time while the driving pulse number being fixed when the PG motor E0003 are repeatedly driven and suspended for waiting.

As described above, it is desirable to use the suction method optimally in accordance with the heat condition and the kinds of ink to be used.

What is claimed is:

1. A liquid discharge head comprising:

a common liquid chamber supplied with liquid, said common liquid chamber being extended along a longitudinal direction;

a plurality of main discharge ports arranged at a predetermined main interval respectively on both sides of said common liquid chamber along the longitudinal direction;

a plurality of auxiliary discharge ports arranged on both end sides of the arrangement direction of said main discharge ports, said auxiliary discharge ports being arranged at a predetermined auxiliary interval on both sides of said common liquid chamber along the longitudinal direction, wherein the auxiliary interval is larger than the main interval;

a plurality of liquid chambers to which said main and auxiliary discharge ports open and communicated with said common liquid chamber; and a plurality of discharge energy generating units provided for each liquid chamber corresponding to a main discharge port or an auxiliary discharge port to generate energy utilized for discharging liquid from said main discharge ports and said auxiliary discharge ports.

2. A liquid discharge head according to claim 1, further comprising at least one dummy liquid chamber arranged between a liquid chamber having an auxiliary discharge port open thereto, and a liquid chamber having a main discharge port open thereto, being communicated with said common liquid chamber, and having no discharge port.

3. A liquid discharge head according to claim 2, wherein said dummy liquid chamber and said liquid chamber having said auxiliary discharge port are arranged alternately.

4. A liquid discharge head according to claim 2, wherein said dummy liquid chamber is provided with a discharge energy generating unit.

5. A liquid discharge head according to claim 1, wherein an interval between auxiliary discharge ports and main discharge ports is two integral times or more and five integral times or less than the main interval of said main discharge ports.

6. A liquid discharge head according to claim 1, wherein the opening area of each of said auxiliary discharge ports is larger than the opening area of each of said main discharge ports.

7. A liquid discharge head according to claim 1, wherein the opening shape of each of said auxiliary discharge ports is different from the opening shape of each of said main discharge ports.

8. A liquid discharge head according to claim 1, wherein each said discharge energy generating unit includes electrothermal transducing elements for generating thermal energy to create film boiling in liquid.

9. A liquid discharge head according to claim 1, wherein the main interval is 600 dpi, and the arrangement interval per line is displaced by one half pitch to each other.

10. A method for driving a liquid discharge head which comprises a common liquid chamber supplied with liquid, said common liquid chamber being extended along a longitudinal direction, a plurality of main discharge ports arranged at a predetermined main interval respectively on both sides of said common liquid chamber along the longitudinal direction, a plurality of auxiliary discharge ports arranged on both end sides of the arrangement direction of said main discharge ports, said auxiliary discharge ports being arranged at a predetermined auxiliary interval on both sides of said common liquid chamber along the longitudinal direction, wherein the auxiliary interval is larger than the main interval, a plurality of liquid chambers to which said main and auxiliary discharge ports open and communicated with said common liquid chamber, and a plurality of discharge energy generating units provided for each liquid chamber corresponding to a main discharge port or an auxiliary discharge port to generate energy utilized for discharging liquid from said main discharge ports and said auxiliary discharge ports, said method comprising the following step of:

discharging liquid from said auxiliary discharge ports simultaneously in order to restore the discharge condition of liquid from said main discharge ports when liquid is discharged from said main discharge ports.

11. A method for driving a liquid discharge head which comprises a common liquid chamber supplied with liquid, said common liquid chamber being extended along a longitudinal direction, a plurality of main discharge ports arranged at a predetermined main interval respectively on both sides of said common liquid chamber along the longitudinal direction, a plurality of auxiliary discharge ports arranged on both end sides of the arrangement direction of said main discharge ports, said auxiliary discharge ports being arranged at a predetermined auxiliary interval on both sides of said common liquid chamber along the longitudinal direction, wherein the auxiliary interval is larger than the main interval, a plurality of liquid chambers to which said main and auxiliary discharge ports open and communicated with said common liquid chamber, and a plurality of discharge energy generating units provided for each liquid chamber corresponding to a main discharge port or an auxiliary discharge port to generate energy utilized for discharging liquid from said main discharge ports and said auxiliary discharge ports, said method comprising the following step of:

discharging liquid simultaneously from at least two of said main discharge ports adjacent to each other with having one of said auxiliary discharge ports and said common liquid chamber between them, said step being executed one after another from one end side in the arrangement direction of said main discharge ports.

12. A method for driving a liquid discharge head which comprises a common liquid chamber supplied with liquid, said common liquid chamber being extended along a longitudinal direction, a plurality of main discharge ports arranged at a predetermined main interval respectively on both sides of said common liquid chamber along the longitudinal direction, a plurality of auxiliary discharge ports arranged on both end sides of the arrangement direction of said main discharge ports, said auxiliary discharge ports being arranged at a predetermined auxiliary interval on both sides of said common liquid chamber along the longitudinal direction, wherein the auxiliary interval is larger than the main interval, a plurality of liquid chambers to which said main and auxiliary discharge ports open and communicated with said common liquid chamber, and a plurality of discharge energy generating units provided for each liquid chamber corresponding to a main discharge port or an auxiliary discharge port to generate energy utilized for discharging liquid from said main discharge ports and said auxiliary discharge ports, said method comprising the following steps of:

discharging liquid simultaneously from at least two of said main discharge ports adjacent to each other with having one of said auxiliary discharge ports and said common liquid chamber between them when liquid is discharged from said main discharge ports in order to restore the discharge condition of liquid from said main discharge ports, said step being performed plural times;

operating liquid discharge from one of said discharge ports one after another from one end side in the arrangement direction of said main discharge ports; and operating liquid discharges from at least two of said main discharge ports adjacent to each other having said common liquid chamber between them on one end side and the other end side alternately in the arrangement direction of said main discharge ports.

13. A method for driving a liquid discharge head which comprises a common liquid chamber supplied with liquid, said common liquid chamber being extended along a longitudinal direction, a plurality of main discharge ports arranged at a predetermined main interval respectively on both sides of said common liquid chamber along the longitudinal direction, a plurality of auxiliary discharge ports arranged on both end sides of the arrangement direction of said main discharge ports, said auxiliary discharge ports being arranged at a predetermined auxiliary interval on both sides of said common liquid chamber along the longitudinal direction, wherein the auxiliary interval is larger than the main interval, a plurality of liquid chambers to which said main and auxiliary discharge ports open and communicated with said common liquid chamber, and a plurality of discharge energy generating units provided for each liquid chamber corresponding to a main discharge port or an auxiliary discharge port to generate energy utilized for discharging liquid from said main discharge ports and said auxiliary discharge ports, said method comprising the following steps of:

discharging liquid simultaneously from at least two of said main discharge ports adjacent to each other with having one of said auxiliary discharge ports and said common liquid chamber between them when liquid is discharged from said main discharge ports in order to restore the discharge condition of liquid from said main discharge ports, said step being performed plural times;

dividing said main discharge ports into a first group and a second group one after another alternately in the arrangement direction thereof from one end side in the arrangement direction thereof;

operating liquid discharge from said auxiliary discharge ports one after another from one end side in the arrangement direction of said main discharge ports;

selecting from said first group said first and last auxiliary discharge ports positioned on one end side in the arrangement direction of said main discharge ports, and at least two of said main discharge ports each discharging liquid simultaneously; and selecting from said second group at least one of said discharge ports other than said first and last auxiliary discharge ports positioned on one end side in the arrangement direction of said main discharge ports, and at least two of said main discharge ports discharging liquid simultaneously.

14. A method for driving a liquid discharge head according to either one of claim 10 to claim 12, wherein liquid is discharged from said auxiliary discharge ports positioned on the other end side one after another in the arrangement direction of said main discharge ports.

15. A method for driving a liquid discharge head which comprises a common liquid chamber supplied with liquid, said common liquid chamber being extended along a longitudinal direction, a plurality of main discharge ports arranged at a predetermined main interval respectively on both sides of said common liquid chamber along the longitudinal direction, a plurality of auxiliary discharge ports arranged on both end sides of the arrangement direction of said main discharge ports, said auxiliary discharge ports being arranged at a predetermined auxiliary interval on both sides of said common liquid chamber along the longitudinal direction, wherein the auxiliary interval is larger than the main interval, a plurality of liquid chambers to which said main and auxiliary discharge ports open and communicated with said common liquid chamber, and a plurality of discharge energy generating units provided for each liquid chamber corresponding to a main discharge port or an auxiliary discharge port to generate energy utilized for discharging liquid from said main discharge ports and said auxiliary discharge ports, said method comprising the following steps of:

discharging liquid from at least all said main discharge ports as a first step when liquid is discharged from said main discharge ports in order to restore the discharge condition of liquid from said main discharge ports; and discharging liquid at least all said auxiliary discharge ports as a second step.

16. A method for driving a liquid discharge head according to either one of claims 10, 11, 12, 13, and 15 wherein liquid is ink and/or processing liquid for adjusting the printability of this ink to be discharged to a printing medium.

17. A method for driving a liquid discharge head according to either one of claims 10, 11, 12, 13, and 15 wherein the amount of liquid discharged from said main discharge ports is 5 picoliters or less.

18. A method for driving a liquid discharge head according to claim 13, further comprising the following steps of:

discharging liquid one after another from said auxiliary discharge ports positioned on the other end side in the arrangement direction of said main discharge ports;

selecting from said second group said first and last auxiliary discharge ports positioned on the other side in the arrangement direction of said main discharge ports, and at least two of said main discharge ports each discharging liquid simultaneously; and selecting from said first group at least one of said auxiliary discharge ports other than said first and last sub-discharge ports positioned on the other end side in the arrangement direction of said main discharge ports, and at least two of said main discharge ports discharging liquid simultaneously.

19. A method for driving a liquid discharge head according to claim 13 or claim 18, wherein at least two of said main discharge ports discharging liquid at the same time as one of said auxiliary discharge ports are away from this discharge port by two times or more the main interval of said main discharge ports.

20. A method for driving a liquid discharge head according to claim 13 or claim 18, wherein the amount of liquid discharged from one of said auxiliary discharge ports is larger than the amount of liquid discharged from said main discharge ports.

21. A method for driving a liquid discharge head according to claim 13 or claim 18, wherein the discharge driving frequency at the time of discharging liquid at the same time with said auxiliary discharge ports is smaller than the discharge driving frequency at the time of discharging liquid from said main discharge ports to a printing medium.

22. A method for driving a liquid discharge head according to claim 19, wherein said first step includes driving of a plurality of discharge energy generating units for generating discharge energy utilized for discharging liquid from said auxiliary dischange ports.

23. A method for driving a liquid discharge head according to claim 22, wherein by driving said discharge energy generating units, liquid is activated in said liquid chambers having said auxiliary discharge ports open thereto.

24. A method for driving a liquid discharge head according to claim 22, wherein by driving said discharge energy generating units, liquid is discharged from said auxiliary discharge ports.

25. A method for driving a liquid discharge head according to claim 19, wherein said first step and said second step are alternately repeated.

26. A method for driving a liquid discharge head according to claim 15, wherein said liquid discharge head is provided with one sheet of base, and a plurality of base plates installed on said base, and two kinds of said main discharge ports for discharging two kinds of liquids different from each other, respectively, and two kinds of said auxiliary discharge ports are formed for said plurality of base plates, and said first step and said second step are repeated one after another per said base plate.

27. A cartridge comprising:

a liquid discharge head which comprises a common liquid chamber supplied with liquid, said common liquid chamber being extended along a longitudinal direction, a plurality of main discharge ports arranged at a predetermined main interval respectively on both sides of said common liquid chamber along the longitudinal direction, a plurality of auxiliary discharge ports arranged on both end sides of the arrangement direction of said main discharge ports, said auxiliary discharge ports being arranged at a predetermined auxiliary interval on both sides of said common liquid chamber along the longitudinal direction, wherein the auxiliary interval is larger than the main interval, a plurality of liquid chambers to which said main and auxiliary discharge ports open and communicated with said common liquid chamber, and a plurality of discharge energy generating units provided for each liquid chamber corresponding to a main discharge port or an auxiliary discharge port to generate energy utilized for discharging liquid from said main discharge ports and said auxiliary discharge ports; and said cartridge further comprising a liquid tank retaining liquid to be supplied to said liquid discharge head.

28. A cartridge according to claim 27, wherein said liquid tank is detachably mountable on said liquid discharge head.

29. An image forming apparatus comprising:

a cartridge according to claim 27;

an installation unit for mounting said cartridge; and conveying means for conveying a recording medium to a printing position corresponding to said installation unit.

30. An image forming apparatus according to claim 29, wherein said installation unit is provided with a carriage capable of traveling to scan in the direction intersecting the carrying direction of the recording medium for liquid to be discharged from said liquid discharge head thereto.

31. An image forming apparatus according to claim 30, wherein said liquid discharge head is detachably mountable on said carriage through attaching and detaching means.

* * * * *

UNITED STATES PATENT AND TRADEMARK OFFICE

CERTIFICATE OF CORRECTION

PATENT NO. : 6,637,865 B1
DATED : October 28, 2003
INVENTOR(S) : Shuichi Murakami et al.

It is certified that error appears in the above-identified patent and that said Letters Patent is hereby corrected as shown below:

Column 4,
Line 10, “to” should read -- to as --.

Column 8,
Line 25, “open;thereto;” should read -- open thereto; --.

Column 10,
Line 17, “form” should read -- from --.

Column11,
Line 25, “discharging,condition” should read -- discharging condition --.

Column 16,
Line 61, “sourceikey;” should read -- source key; --, and
Line 67, “Elll” should read -- E1011 --.

Column22,
Line 34, “use” should read -- to use --; and
Line 46, “from” should read -- form --.

Column26,
Lines 3 and 4, “pitches” shoud read -- pitch --.

Column27,
Line 28, “execution;of” should read -- execution of --, and “predischarges” should read -- pre-discharges --; and
Line 67, “discharge,” should read -- discharged, --.

Column 30,
Line 46, “its” should read -- is --.

Column 31,
Line 34, “describe” should read -- described --.

Column 32,
Line 48, “discharge” should read -- discharged --; and
Line 49, “form” should read -- from --.

UNITED STATES PATENT AND TRADEMARK OFFICE

CERTIFICATE OF CORRECTION

PATENT NO. : 6,637,865 B1
DATED : October 28, 2003
INVENTOR(S) : Shuichi Murakami et al.

It is certified that error appears in the above-identified patent and that said Letters Patent is hereby corrected as shown below:

Column 33,
Line 9, “discharge” should read -- discharged --;
Line 10, “form” should read -- from --; and
Line 21, “patter” should read -- pattern --.

Column 34,
Line 28, “patter” should read -- pattern --.

Column 35,
Line 53, “rotate” should read -- rotates --.

Column 42,
Line 15, “at” should read -- from at --;
Line 46, “the” should read -- than the --;
Line 60, “claim 19,” should read -- claim 15, --; and
Line 63, “dischange” should read -- discharge --.

Column 43,
Line 6, “claim 19,” should read -- claim 15, --.

Signed and Sealed this

Tenth Day of August, 2004

JON W. DUDAS
*Acting Director of the United States Patent and Trademark Office*